US007090419B2

(12) United States Patent
Satoh et al.

(10) Patent No.: US 7,090,419 B2
(45) Date of Patent: Aug. 15, 2006

(54) RECORDING DEVICE

(75) Inventors: Hiroaki Satoh, Ebina (JP); Nobuhiro Katsuta, Ebina (JP); Yoshihira Rai, Ebina (JP); Akira Mihara, Ebina (JP); Kenichi Kawauchi, Ebina (JP); Hiroshi Ikeda, Ebina (JP); Naoki Morita, Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/778,048

(22) Filed: Feb. 17, 2004

(65) Prior Publication Data

US 2004/0160475 A1 Aug. 19, 2004

(30) Foreign Application Priority Data

Feb. 17, 2003 (JP) ..... 2003-037853
Aug. 27, 2003 (JP) ..... 2003-209085

(51) Int. Cl.
*B41J 13/076* (2006.01)
*B41J 2/01* (2006.01)
*B41J 2/155* (2006.01)

(52) U.S. Cl. ..... 400/641; 400/636; 400/637; 347/40; 347/104

(58) Field of Classification Search ..... 400/656, 400/636, 636.2, 636.3, 641; 347/104, 30
See application file for complete search history.

(56) References Cited

U.S. PATENT DOCUMENTS 5,636,929 A * 6/1997 Asano et al. ..... 400/641
5,847,719 A * 12/1998 Yamaguchi et al. ..... 346/134
5,882,129 A * 3/1999 Nakayama ..... 400/618
5,961,234 A * 10/1999 Uchikata ..... 400/636
6,619,795 B1 * 9/2003 Hiramatsu ..... 347/104
2002/0036682 A1 * 3/2002 Johnson ..... 347/104
2002/0135653 A1 * 9/2002 Otsuki ..... 347/104
2003/0048345 A1 * 3/2003 Matsumoto ..... 347/104

FOREIGN PATENT DOCUMENTS

EP 1231060 A1 * 8/2002
JP A 2-179754 7/1990
JP 05185661 A * 7/1993
JP A 5-330030 12/1993
JP A 8-132700 5/1996
JP 08217287 A * 8/1996
JP 08337011 A * 12/1996
JP 11348313 A * 12/1999
JP 2000211159 A * 8/2000
JP 2001225479 A * 8/2001
JP 2002120385 A * 4/2002
JP 2002179319 A * 6/2002

OTHER PUBLICATIONS

Machine translation of JP 2002-120385 to Hayashi et al. from Japanese Patent Office website.*
Machine translation of JP 11348313 to Mukasa et al. from Japanese Patent Office website.*

* cited by examiner

*Primary Examiner*—Daniel J. Colilla
(74) *Attorney, Agent, or Firm*—Oliff & Berridge, PLC

(57) ABSTRACT

A recording device for recording an image on a recording medium, the recording device comprising: a recording head having a liquid drop discharging surface for discharging liquid drops toward a recording medium; a liquid receptacle disposed at a position opposing a liquid drop discharging surface of the recording head, and able to accommodate the liquid drops; and a conveying device for conveying the recording medium between the recording head and the liquid receptacle, by a non-electrostatic attraction method.

28 Claims, 38 Drawing Sheets

40
40A
80
87
88
90
92
X
Y
Z

RECORDING DEVICE

CROSS-REFERENCE TO RELATED APPLICATION

This application claims priority under 35USC 119 from Japanese Patent Application Nos. 2003-37853 and 2003-209085, the disclosures of which are incorporated by reference herein.

BACKGROUND OF THE INVENTION

1. Field of the Invention

The present invention relates to an ink jet recording device which carries out recording by discharging ink from a recording unit onto a recording medium, and to a recording device which is used as an output device equipped with such functions, such as a fax machine, a copier, a printer, a multi-function device, a work station, or the like.

2. Description of the Related Art

The increase in popularity of color documents in offices in recent years has been remarkable, and various output devices therefor have been proposed. In particular, the ink jet method, which enables devices to be made compact and which is low cost, is used in various output devices.

A recording head used in the ink jet method is structured by an energy generating device, an energy converting device which converts the energy generated at the energy generating device into ink discharging force, an ink discharge opening from which ink drops are discharged by the ink discharging force, and an ink supply path which communicates with the ink discharge opening and supplies the ink. Examples of the energy generating device are devices using an electromechanical converting body such as a piezo element or the like, a device which forms an air bubble by heating the ink by an electrothermal converting element having a heat-generating resistor, and discharges an ink drop due to the formation of the air bubble, and the like.

In a recording head utilizing an electricity-heat converting element, because the electricity-heat converting element is compact, not only is it possible to dispose the ink discharge openings at a high density, but also, semiconductor integrated circuit manufacturing technology can be used as the technology for the manufacturing of the recording head. Therefore, a recording head provided with a large number of highly-precise ink discharge openings can be made to be compact, and can be manufactured at a low cost.

However, what is mainly popular these days is a printing method called serial scanning which carries out printing line-by-line by reciprocatingly moving a recording head while conveying a recording sheet. This method is compact and low cost, but has the disadvantage that the recording head must be scanned plural times in order to form an image over the entire sheet, and the printing speed is slow. In order to improve the printing speed, the number of scans must be reduced, and the recording head must be elongated. The technology which has pushed these features to their limits is a non-scanning printing system which carries out printing by a recording head disposed along the width of the sheet. This printing system is an ink jet recording device equipped with a recording head which corresponds to the width of the sheet and in which a large number of discharge openings are lined up along a length substantially equal to the width of the recording sheet. Recording is carried out by the recording sheet moving with respect to the recording head which is fixed.

In this way, in order to improve the printing speed and be able to handle application to use in the office, there has been proposed the ink jet recording device which, while continuously conveying a sheet, carries out printing by a non-scanning type recording head corresponding to the width of the sheet.

However, in the ink jet recording device, the conveyed state (e.g., fluctuations in speed) of the sheet below the recording head (the nozzle surface) greatly affects the printing performance. Accordingly, in a case in which a sheet is conveyed continuously, conveying the sheet stably at a constant speed is problematic.

To address this problem, structures have been proposed in which a sheet is conveyed in a state of being attracted to an electrostatically attracting belt or to an electrostatically attracting drum, and the sheet is conveyed at a constant speed (e.g., Japanese Patent Applications Laid-Open (JP-A) Nos. 2-179754 and 5-330030, which will be called Conventional Examples 1 and 2 hereinafter), and in which a sheet is conveyed while being nipped by two or more narrow belts for conveying and spurs (e.g., Japanese Patent Application Laid-Open (JP-A) No. 8-132700, which will be called Conventional Example 3 hereinafter).

On the other hand, in the ink jet recording device, poor discharging of ink drops arises and the image quality deteriorates due to dirtying of or ink drying at the nozzle surface of the recording head, and due to the generation of air bubbles in the ink flow path of the nozzle or the like, and the like. Thus, ink drops are discharged at times other than during printing (this is called "dummy jetting"), so as to prevent the ink from drying, and so as to remove dirt from the nozzle surface, and so as to discharge the air bubbles, which exist in the ink flow path, to the exterior together with the ink. Further, there is the need to provide a maintenance device which carries out maintenance such as wiping the nozzle surface to remove dirt from the nozzle surface and maintain the ink discharging performance, and the like.

Conventional Example 1 proposes a structure which carries out maintenance by a maintenance device abutting a recording head portion which is set in a posture different than that during printing.

In Conventional Example 2, an opening is provided at an electrostatically attracting drum, and a cap member, which receives the dummy jet, is disposed within the opening. Accordingly, when the sheet is conveyed (when printing is carried out), the sheet is conveyed by closing the opening. When dummy jetting is to be carried out, it is carried out by opening the opening. Further, wiping is carried out by wiping the entire head by a single blade.

Conventional Example 3 is a structure in which a recording head is raised from the printing position, and due to a maintenance device sliding, the maintenance device is positioned at a position facing the nozzle surface of the recording head, and maintenance is carried out.

When an electrostatically attracting method is employed as in Conventional Examples 1 and 2, the following problems arise. Because the force attracting the sheet depends on the electrical properties (the electrical resistance, the electrostatic capacity, i.e., the electrical conductivity, the dielectric constant, the thickness of the paper, and the like), the thickness and the type of paper which can be stably conveyed by electrostatic attraction are limited. Poor attraction may occur due to changes in the electrical properties of the sheet due to the printing (the adhesion of the ink) and due to fluctuations in the ambient temperature and humidity of the device.

Moreover, there are cases in which the locus of flying of the ink drop discharged from the nozzle is distorted due to effects of the attracting electrical field, and the printing is poor. In addition, there are cases in which an ink mist or dirt floating about due to the effects of the attracting electrical field adheres to the nozzle surface of the recording head, or to the conveying belt or the conveying drum, or to the sheet.

Further, with Conventional Example 1, there is also the disadvantage that the recording device becomes large.

In Conventional Examples 1 and 3, a belt is provided at a position facing the recording head (the nozzle surface) in order to convey the sheet (i.e., in order to ensure the position of the sheet). Therefore, the maintenance device cannot be disposed at that position, and a drawback arises in that a complex mechanism is needed in order to move both the recording head and the maintenance device.

Because maintenance is carried out by moving the recording head, dummy jetting cannot be carried out during continuous printing. The drawback arises that, at the time of dummy jetting, printing must be interrupted, and the produceability deteriorates.

A pushing device, which pushes (urges) the recording medium when the recording medium is conveyed, is generally provided. However, in Conventional Examples 1 through 3, there are cases in which the pushing forces (the urging forces) in the widthwise direction of the recording medium become unbalanced. As a result, problems may arise such as the recording medium moves at an incline such that the image is slanted, and wrinkles in the paper arise such that paper jamming occurs.

Moreover, in Conventional Examples 1 through 3, when the pushing device are structured so as to always abut conveying rollers, the pushing forces applied by the pushing device are about 5 to 30 [gf] each, and are therefore sufficiently small. However, the conveying roller, whose both end portions are held by bearings or the like, is usually a both-end supported beam structure. Therefore, in such a structure, flexure, although slight, arises due to the total pushing force of the pushing device. In order to reduce such flexure, it suffices to make the members thick and sturdy. However, this leads to the device becoming larger and more expensive. In addition, when dealing with a wider recording medium by increasing the number of urging members of the pushing device in order to more reliably transmit driving force from the conveying rollers to the recording medium, the flexure increases even more, which is a cause of an imbalance in the conveying. Therefore, the balance of the urging forces in the widthwise direction of the recording medium must be ensured by taking into consideration the way of urging of the pushing forces of the pushing device (i.e., the urging positions) and the flexure of the conveying roller. This leads to the device becoming more complex and expensive.

The designing of the conveying device is carried out by using the maximum width of recording media as a reference. Generally, it is possible to handle recording media of smaller sizes than that. When printing onto a recording medium of the maximum size, a balance of urging forces in the widthwise direction of the recording medium can be obtained. However, when a smaller-sized recording medium is conveyed by being aligned at an end portion (side registration), even if the pushing device were to be provided so as to have left-right symmetry, the recording medium would be conveyed in an unbalanced state with respect to the flexure of the conveying roller, and there would be the concern that slanted conveying and wrinkling of the sheet would arise.

In a case in which the recording medium is conveyed by the driving forces of conveying rollers being transmitted to the recording medium by the recording medium being pushed against the conveying rollers by pushing device, the recording medium which is positioned within the printing region is simultaneously nipped by plural pushing device and conveying rollers. Accordingly, even if the pushed state or the nipped state changes as the recording medium moves, the recording medium is nipped in a uniform state on average, and the moving speed is stable. However, when printing at the upstream-most recording head array starts, the majority of the recording medium is not being nipped, and as the recording medium moves, the entire recording medium is gradually nipped. The same situation arises also when the downstream-most recording head array finishes printing. These differences in the states of the recording medium (the pushing and the nipping of the recording medium) cause fluctuations in the moving speed of the recording medium, and are a deterrent to achieving good image quality.

SUMMARY OF THE INVENTION

In order to overcome the above-described drawbacks, according to the present invention, there is provided a recording device which can form images of high image quality while ensuring produceability. Further, according to the present invention, there is provided a recording device which can stably convey various types of recording media. Moreover, according to the present invention, there is provided a recording device in which maintenance operations can be realized by a relatively simple structure. In addition, according to the present invention, there is provided a recording device in which dummy jetting can be carried out during continuous printing. Further, according to the present invention, there is provided a recording device in which a recording medium can be stably conveyed even if ink drops are carried thereon. Yet further, according to the present invention, there is provided a recording device which, by having a structure which maintains the moving speed of a recording medium constant from the start to the finish of printing, can form a high quality image.

A first aspect of the present invention is a recording device for recording an image on a recording medium, the recording device comprising: a recording head having a liquid drop discharging surface for discharging liquid drops toward a recording medium; a liquid receptacle disposed at a position opposing the liquid drop discharging surface of the recording head, and able to accommodate the liquid drops; and a conveying device for conveying the recording medium between the recording head and the liquid receptacle, by a non-electrostatic attraction method.

Operation of the recording device of the first aspect will be described.

By conveying the recording medium by the conveying device between the recording head and the cap, liquid drops are discharged from the recording head to the recording medium, and an image is formed on the recording medium.

At this time, because the conveying device does not employ an electrostatic attraction method (i.e., is a non-electrostatic attraction type conveying device), the conveying device can stably convey the recording medium, without being dependent on the material, the thickness, or the like of the recording medium, or changes in the electrical properties of the recording medium due to the adhesion of the liquid drops thereto, or changes in the ambient temperature and humidity. Further, the adhesion of dirt to the sheet and the conveying device due to electrostatic attraction is prevented. Accordingly, high quality image formation is possible.

By discharging liquid drops from the recording head to the liquid receptacle which is disposed at a position opposing the liquid drop discharging surface (i.e., by carrying out dummy jetting), the liquid drop discharging performance of the recording head is maintained within a constant range, and high quality image formation is possible.

Further, because the liquid receptacle is disposed at a position opposing the liquid drop discharging surface of the recording head, dummy jetting can be carried out during continuous printing (during the time from after a preceding recording medium has passed by the recording head until the leading end of the next recording medium reaches that position). The produceability (the speed of carrying out printing with respect to a plurality of sheets) is improved.

Moreover, dummy jetting can be carried out without moving the recording head or the liquid receptacle. Therefore, the mechanism for carrying out dummy jetting is simplified.

The "recording medium" which is the object of image recording in the recording device of the present invention encompasses a wide variety of media, provided that they are an object to which ink drops are discharged by a recording device. Further, the "image" or "recorded image" obtained at the recording device of the present invention widely encompasses patterns of dots on a recording medium which patterns are obtained by the ink drops adhering to the recording medium. Accordingly, the recording device of the present invention is not limited to use in recording characters or images onto recording paper. The recording medium of course encompasses recording paper, OHP (overhead projector) sheets and the like, and in addition thereto, also encompasses, for example, substrates or the like on which wiring patterns or the like are formed. Further, "image" includes not only general images (characters, drawings, photographs and the like), but also wiring patterns such as mentioned above, as well as three-dimensional objects, organic thin films, and the like. The liquid which is discharged is not limited to color inks. For example, the recording device of the present invention can be applied to liquid drop jetting devices in general which are used for various industrial applications such as the manufacture of color filters for displays which is carried out by discharging color inks onto high polymer films or glass, the formation of bumps for parts packaging which is carried out by discharging solder in a molten state onto a substrate, the formation of EL display panels which is carried out by discharging an organic EL solution onto a substrate, the formation of bumps for electrical packaging which is carried out by discharging solder in a molten state onto a substrate, and the like.

Other aspects of the present invention will be described in the last part of the following DETAILED DESCRIPTION OF THE INVENTION section.

BRIEF DESCRIPTION OF THE DRAWINGS

Preferred embodiments of the present invention will be described in detail based on the following figures, wherein.

DETAILED DESCRIPTION OF THE INVENTION

Figure 1:
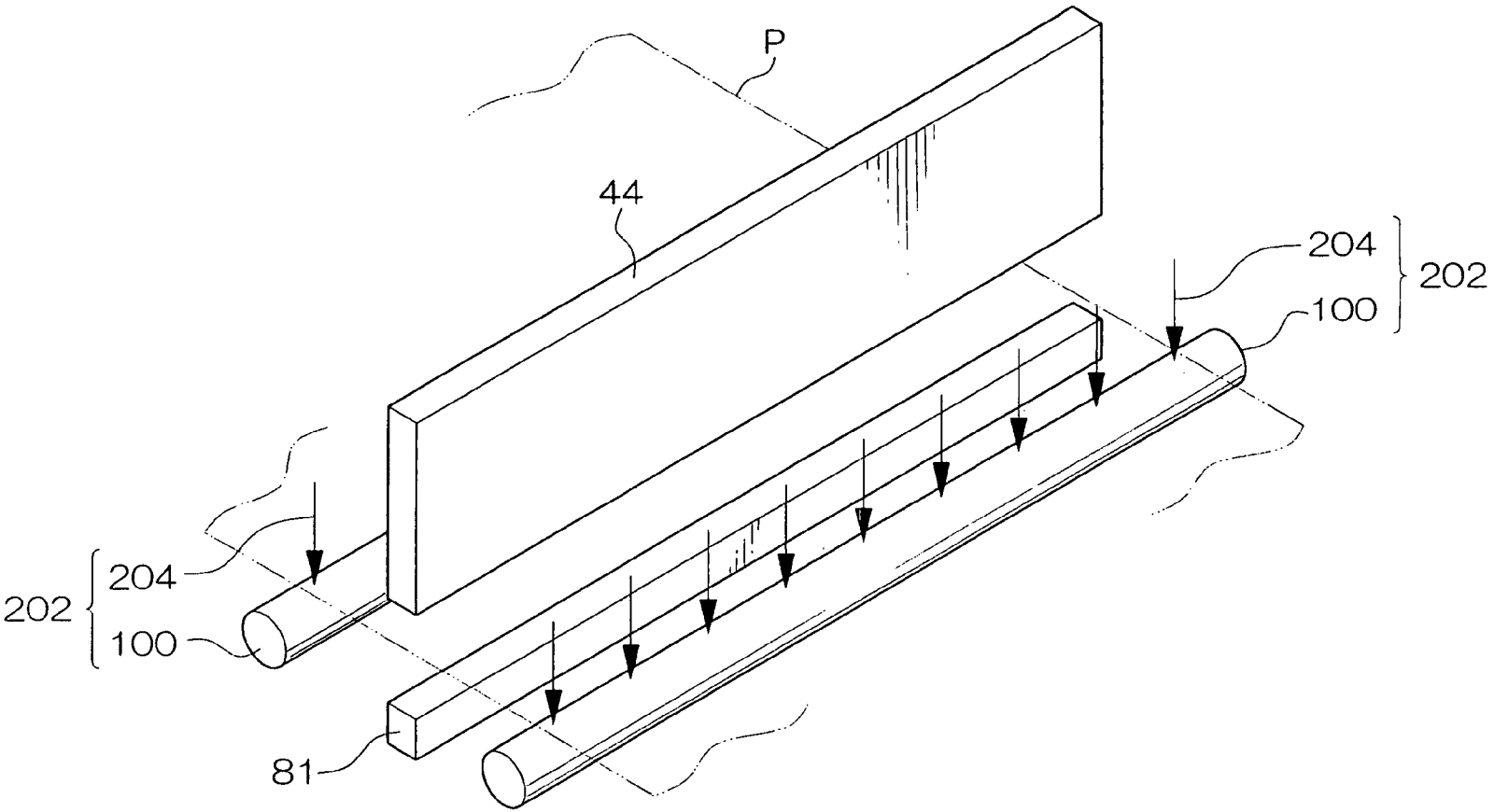
FIG. 1 is a schematic structural view of a recording device relating to a first embodiment of the present invention.

Embodiments of the present invention will be described hereinafter. Note that, in the embodiments from the second embodiment on, structural elements which are similar to those described previously are denoted by the same reference numerals, and detailed description thereof is omitted.

FIRST EMBODIMENT

An ink jet recording device relating to an embodiment of the present invention will be described.

As shown in FIG. 1, a recording device 200 is basically structured by a recording head 44 which directly transfers ink to a sheet without contacting the sheet, a maintenance device 81 disposed so as to face a nozzle surface 40A of the recording head 44, and conveying device 202 conveying the sheet between the recording head 44 and the maintenance device 81.

The recording head 44 transfers ink directly to a sheet without contacting the sheet, and may be any of a thermal ink jet system, a piezo-type ink jet, a continuous-flow-type ink jet, an electrostatic-suction-type ink jet, or the like.

Any of a water-based ink, an oil-based ink, a so-called solid ink which is solid at ordinary temperatures, a solvent ink, or the like may be employed as the ink which is used. The coloring material in the ink may be a pigment or a dye.

Figure 2:
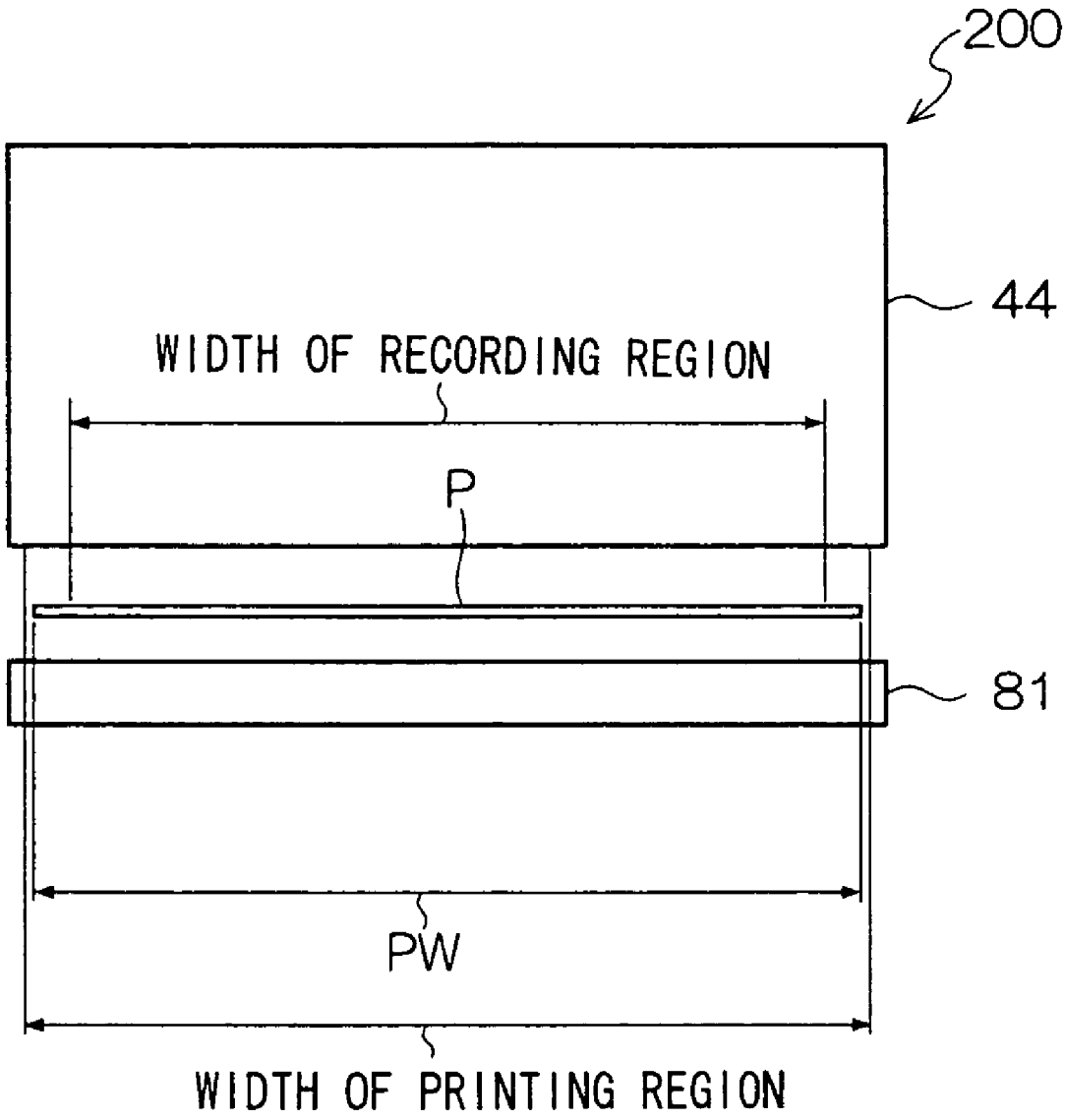
FIG. 2 is a diagram for explanation of a printing region of the recording device relating to the first embodiment of the present invention.

As shown in FIG. 2, the recording head 44 has a printing region which corresponds to a maximum sheet width PW of a sheet P, such that printing can be carried out over the entire width of the sheet without scanning the recording head 44. Namely, printing is completed merely by the sheet passing one time beneath the recording head 44.

In a case in which printing margins are set at the sheet, the printing region of the recording head 44 is a width corresponding to a recording region in which the print margins are subtracted from the maximum sheet width PW (i.e., is a width which is the same as or larger than the recording region).

Generally, conveying of the sheet at a slant of a predetermined angle with respect to the conveying direction arises (i.e., skewing arises), and there are also requests for printing without borders or the like. Therefore, the printing region of the recording head 44 is preferably structured to be larger than the recording region.

Figure 3:
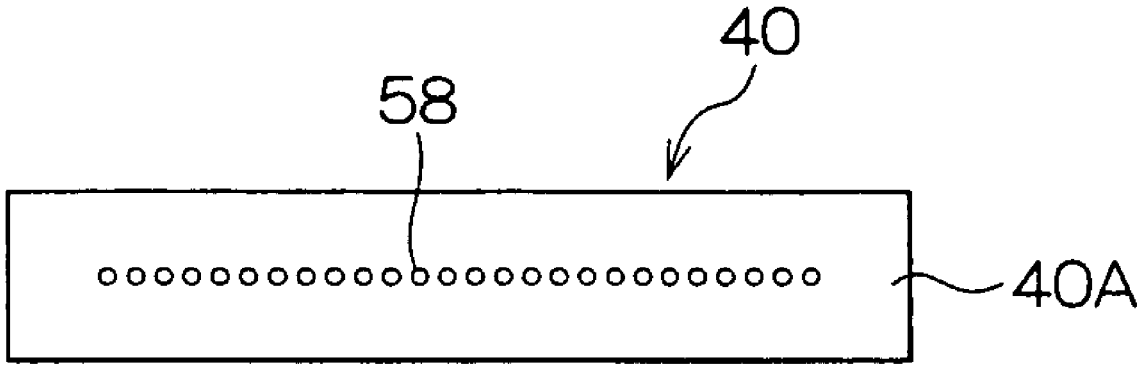
FIG. 3 is a diagram for explanation of a variation of a unit recording head relating to the first embodiment of the present invention.

The recording head 44 may be structured by a monolithic elongated head (a head tip) in which nozzles are formed in one row along the printing region. However, it is preferable that the recording head 44 is formed from a combination of short heads (head tips, hereinafter called "unit recording heads") 40 (see FIG. 3). Unit recording heads (short heads) are easier to mass manufacture, and it is much easier to increase the yield of individual short recording heads than monolithic elongated heads. Accordingly, the structuring of the recording head 44 by combining unit recording heads 40 enables a less expensive structure.

Figure 4:
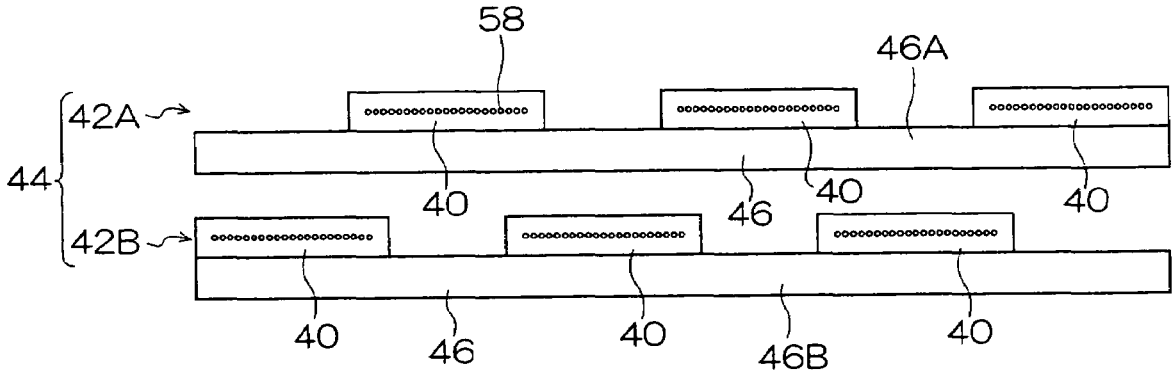
FIG. 4 is a diagram for explanation of a variation of a recording head relating to the first embodiment of the present invention.

For example, as shown in FIG. 4, the recording heads 40, at each of which nozzles 58 are lined up in one row at the nozzle surface 40A, are attached to common substrates 46A, 46B with the nozzle rows thereof coinciding, so as to be disposed to be offset from one another. In this way, the recording head 44, which can print without interruption in the printing region, can be structured. In this case, inexpensive devices (recording heads) which are mass produced can be used in the recording head 44, and the recording head 44 which is low cost and can print over the entire width can be structured. Moreover, by attaching recording head arrays 42A, 42B to the common substrates 46A, 46B respectively, the structures of the recording head arrays 42A, 42B are simplified, and manufacturing and highly precise adjustment are also easier.

Figure 5:
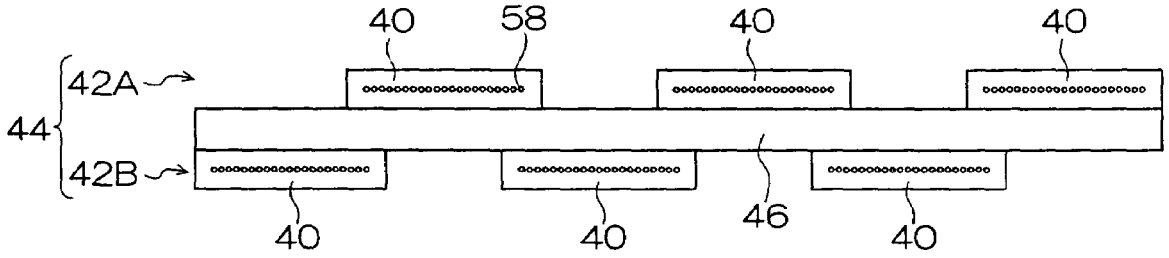
FIG. 5 is a diagram for explanation of a variation of the recording head relating to the first embodiment of the present invention.

However, the recording head 44 is not limited to this structure. As shown in FIG. 5, a plurality of the unit recording heads 40 can be attached to both sides of a single common substrate 46 so as to form the recording head arrays 42A, 42B. By utilizing such a structure, the common substrate 46 can be used in common and the recording head 44 can be made compact.

A commercially available or known serial recording type ink jet recording head may be used as the unit recording head. Further, it is possible to structure the unit recording head only from a head tip, and ink may be supplied to a plurality of head tips through an ink flow path provided at the common substrate 46. Moreover, it is preferable if each of the unit recording heads can be individually replaced.

Figure 6:
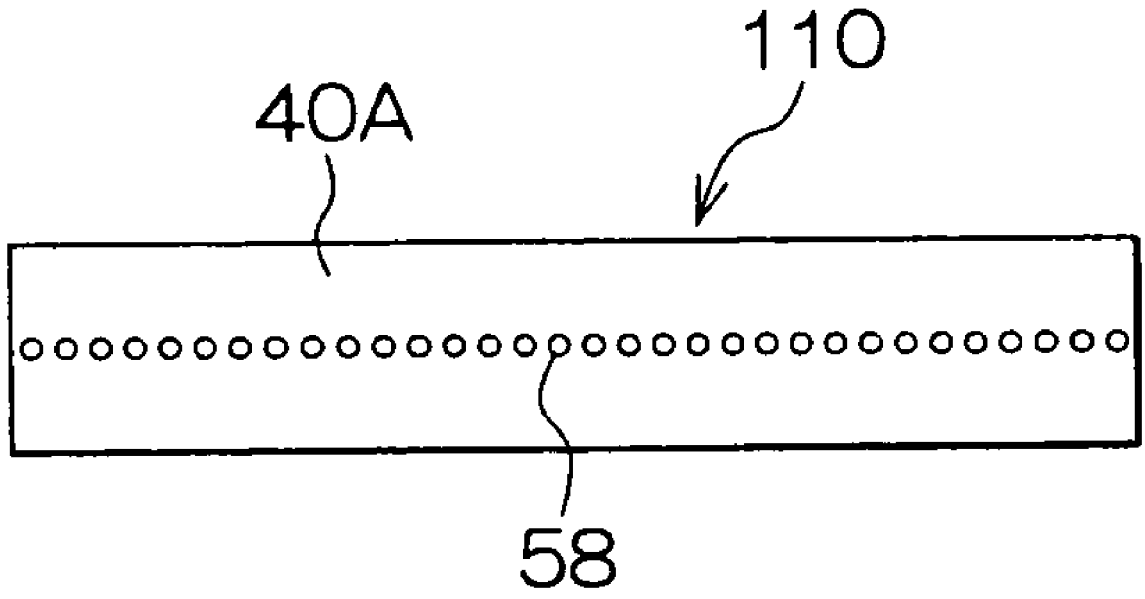
FIG. 6 is a diagram for explanation of a variation of the unit recording head relating to the first embodiment of the present invention.
Figure 7:
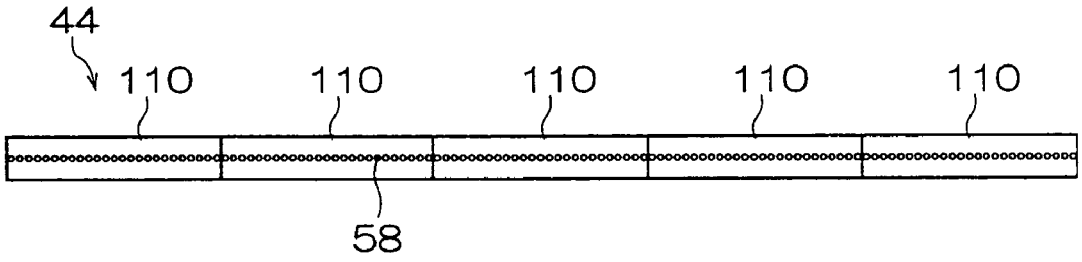
FIG. 7 is a diagram for explanation of a variation of the recording head relating to the first embodiment of the present invention.

The recording head 44 may be structured (see FIG. 7) by disposing, continuously and along the widthwise direction, unit recording heads 110 (see FIG. 6) in which the nozzles 58 of the unit recording head 40 are formed to the end portions in the direction in which the nozzles are lined up. In order to make the nozzle pitches match at the connecting portions between the respective unit recording heads, the end portions of the unit recording heads 110 must be manufactured with high precision. However, this is the structure that enables the recording head 44 to be made the most compact.

Figure 8:
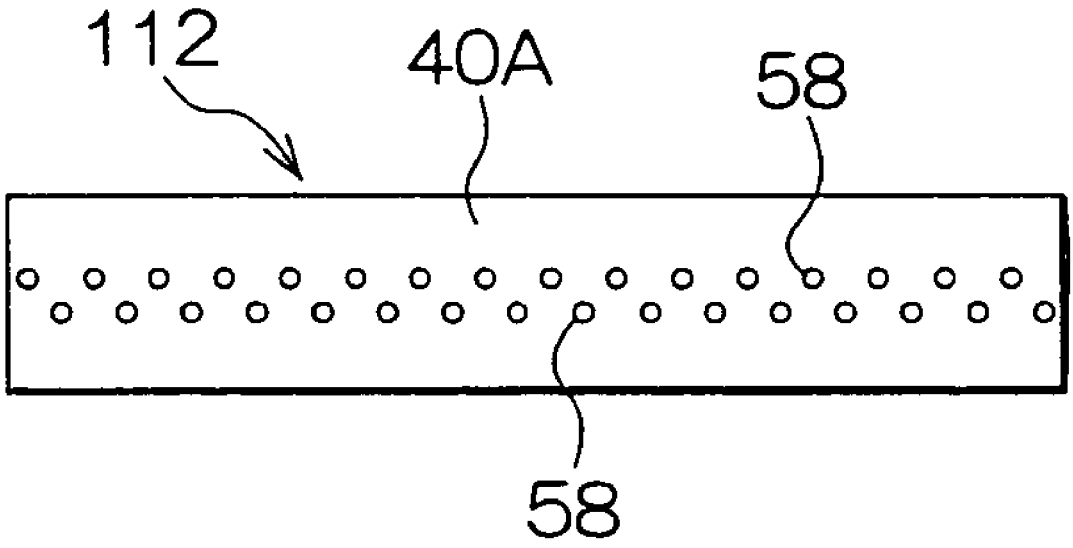
FIG. 8 is a diagram for explanation of a variation of the unit recording head relating to the first embodiment of the present invention.

Description has been given in which the nozzles of the unit recording heads 40, 110 are lined up in the form of a single straight line. However, the present invention is not limited to the same. For example, as shown in FIG. 8, the nozzles may be arranged in a staggered manner.

The maintenance device 81, which is disposed so as to face the recording head 44, is at least provided with ink receiving portions which accommodate the ink which has been discharged from the recording head 44 at times of non-printing. The maintenance device 81 is for maintaining constant the printing (ink transferring) performance of the recording head 44. In this way, because the maintenance device 81 having the ink receiving portions is disposed so as to oppose the recording head 44, the ink which is transferred from the recording head 44 at times of non-printing is reliably accommodated.

The recording head 44 must discharge ink at times of non-printing (hereinafter called "dummy jetting") for the purpose of returning, to its initial state, the ink drop discharging performance due to the drying of the ink (and water-based inks and solvent inks in particular).

Even in the case of oil-based inks and solid inks which hardly dry out, there is the need to carry out dummy jetting in order to return the discharging performance to its initial state by eliminating the effects caused by minute air bubbles forming at the interior of the recording head 44 during printing, and the effects caused by ink and minute dirt adhering to the nozzle surface (the ink drop discharging surface).

The maintenance device 81 (the ink receiving portion) accommodates the ink drops at the time of this dummy jetting. The maintenance device 81 may be provided with ink absorbing members such that the accommodated ink drops do not fly out. Or, the maintenance device 81 may be structured so as to discharge the ink to an ink disposal device provided at another place, via a member into which ink seeps or a tube member or the like.

It suffices for the maintenance device 81 to have at least the above-described ink receiving function. However, the maintenance device 81 may be structured so as to have other maintenance functions, in order to maintain the ink drop discharging performance. For example, the maintenance device 81 may be provided with a wiper member which cleans the nozzle surface, or may have a capping function for keeping the nozzle surface airtight and protecting the nozzle surface. Moreover, the maintenance device 81 may have a vacuum function for sucking ink and the like from the nozzles.

It is not absolutely necessary for the maintenance device 81 to have functions other than the ink receiving function, e.g., the aforementioned wiping function and capping function and the like. For example, mechanisms which achieve these functions (a wiping mechanism, a capping mechanism, and the like) may be provided at the recording head.

The conveying device 202 conveys the sheet by a method other than electrostatic attraction (which hereinafter will be called a "non electrostatic attraction method"). Namely, the conveying device 202 is not particularly limited provided that it can stably convey the sheet at a constant speed between the recording head 44 and the maintenance device 81. For example, a combination of conveying rollers or a conveying belt and pushing device, or the like, can be considered.

The conveying device 202 is preferably disposed at a position which is different than the position of the recording head 44 in the sheet conveying direction. This is in order to be able to easily place the maintenance device 81 at the position facing the recording head 44.

For example, it can be thought to structure the conveying device 202 by (see FIG. 1) a conveying roller 100, which abuts the reverse surface of the sheet and applies driving force to the sheet, and urging device 204, which pushes the sheet against the conveying roller 100.

The reason for this is as follows: in the case in which an electrostatic attraction method is utilized, there is the concern that the state of the electrostatic attraction may not be stable depending on the thickness of the sheet or the material of the sheet. In contrast, by pushing the sheet against the conveying rollers 100 by the urging device 204, the driving force from the conveying rollers 100 is reliably transmitted to the sheet and the sheet can be conveyed stably, regardless of the thickness, the material and the like of the sheet.

The urging device 204 may be a type which carries out urging by an urging member directly contacting the sheet, or may be a type in which the sheet is not directly contacted. The blowing of air or the like can be thought of as an example of the latter method. Such methods are excellent from the standpoint that the printed sheet is not contacted.

Figure 9:
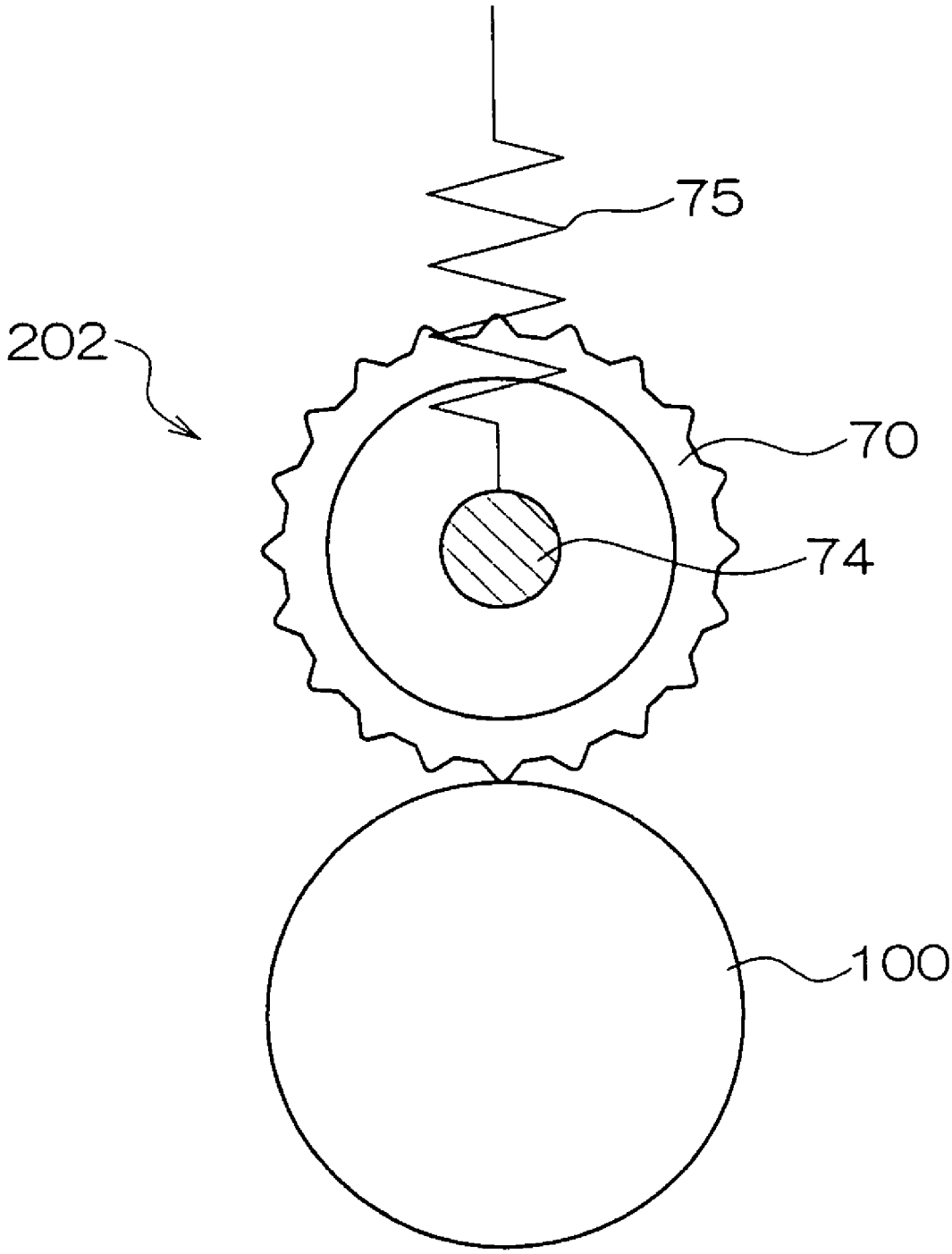
FIG. 9 is a diagram for explanation of a conveying device relating to the first embodiment of the present invention.

On the other hand, as shown in FIG. 9, a star wheel 70, to which the urging forces of springs 75 are applied via a shaft 74, can be thought of as an example of the former type. Namely, regardless of the thickness and the material of the sheet P, the sheet P is pushed against the conveying rollers 100 by the star wheels 70 which are elastically urged with respect to the conveying rollers 100. As a result, driving force is reliably transmitted from the conveying rollers 100, and the sheet P is stably conveyed.

The configuration of the star wheel 70 is not particularly limited provided that the surface area of contact thereof with the sheet can be kept to a minimum. The material of the star wheel 70 may be metal, plastic, or the like. For example, an SUS 631 H material, which is obtained by subjecting SUS 631 H to hardening processing at a high temperature, is suitable. The method of manufacturing the star wheel 70 also is not particularly limited, but etching, pressing, laser machining, or the like may be used.

Accordingly, even if the star wheels 70 contact the recording surface of the sheet P, the surface area of contact with the recording surface, onto which the ink has just been transferred, can be kept to a minimum, and the effects on the printed image quality can be kept to a minimum.

The pushing force applied by the star wheel 70 which is urged via the shaft 74 is preferably 5 gf to 30 gf, and 10 gf to 20 gf is even more preferable. If the pushing force is smaller than 5 gf, the sheet cannot be sufficiently pushed. If the pushing force is greater than 30 gf, the sheet is damaged.

Note that, in the case of forming a star wheel group by a plurality of star wheels 70, the star wheels 70 are preferably supported by a common shaft. The intervals between the star wheels 70 is preferably 50 mm or less, in order to suppress localized floating up and deformation of the sheet.

When the printing region is large, it is preferable to divide the shaft 74 into plural sections, and to have a plurality of the star wheels 70 rotatably supported at each section. This is because the shaft 74 deflects and the star wheels 70 urge the sheet non-uniformly, and localized floating up and deformation of the sheet cannot be suppressed.

Any type of conventionally known conveying roller can be used as the conveying roller 100. In order to reliably transmit driving force to the sheet, it is preferable to use a roller at which the coefficient of friction of the surface thereof is large and which has excellent wear resistance. For example, a rubber roller in which the outer peripheral surface of a metal roller is covered with rubber, or a ceramic roller in which the outer peripheral surface of a metal roller is coated with ceramic powder, can be considered.

Figure 10:
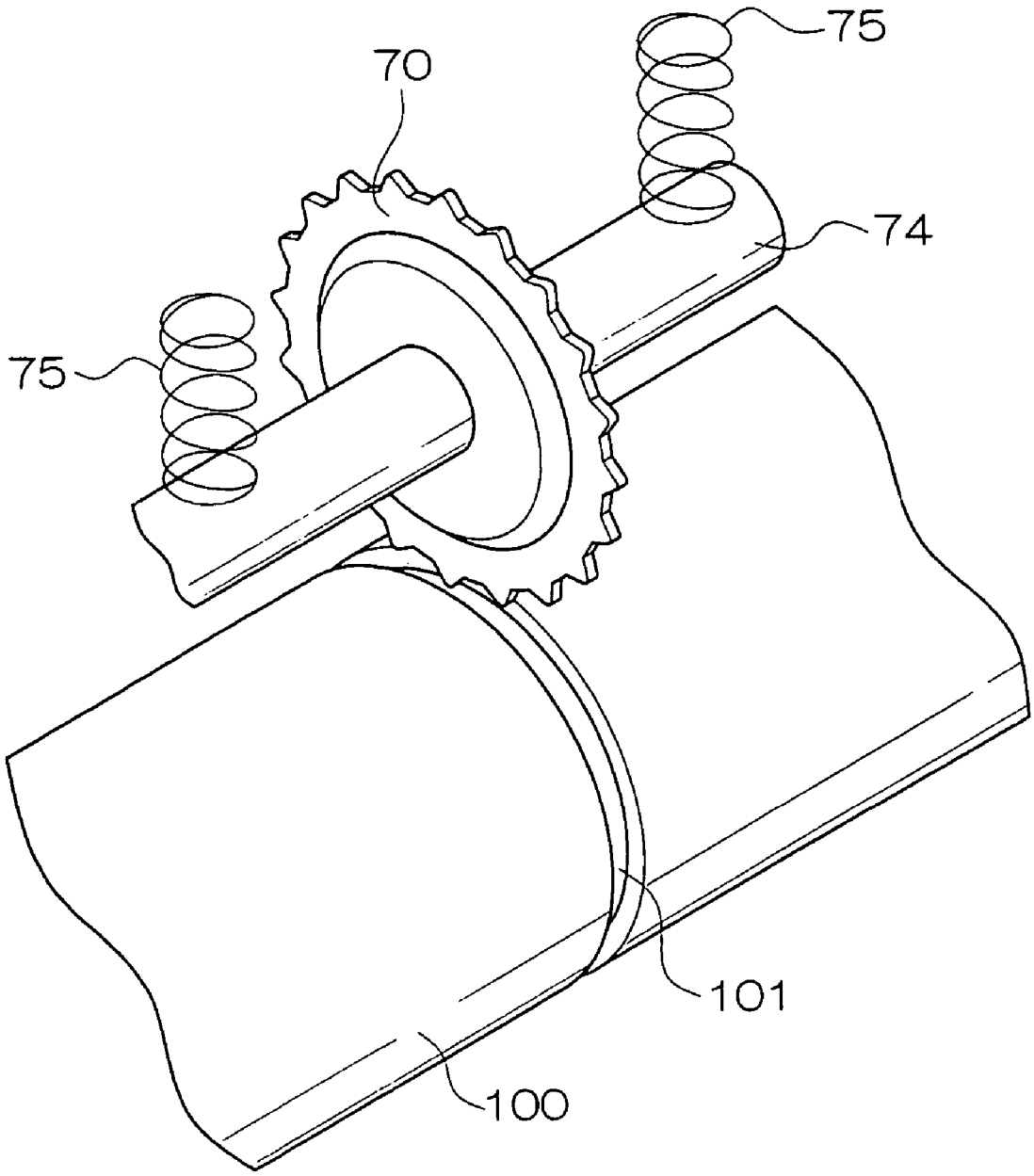
FIG. 10 is a perspective view for explanation of a breakage avoiding portion of a conveying roller relating to the first embodiment of the present invention.

Note that breakage avoiding portions are provided at the conveying roller 100 so that the addenda of the star wheels 70 contacting the conveying roller 100 do not break because the star wheels 70 are elastically urged toward the conveying roller. For example, if the conveying roller is a rubber roller, the rubber covering the outer peripheral surface corresponds to the breakage avoiding portion. Further, if the conveying roller 100 is a ceramic roller, as shown in FIG. 10, grooves 101, which run along the circumference of the roller at regions opposing the star wheels 70, correspond to the breakage avoiding portions. However, in a case in which the grooves 101 are provided, it is preferable to provide a restricting device so that the amounts of the addenda of the star wheels 70 which enter into the grooves 101 are not excessive and the resistance to the conveying of the sheet does not increase. For example, a structure which abuts the shaft 74 and restricts the amount of entry of the star wheels 70 can be considered.

Operation of the recording device 200 relating to the present embodiment will be described.

In the recording device 200, the printing region of the recording head 44 is the same as or larger than the recording region. Therefore, the coloring material is transferred from the recording head 44 to the sheet and an image is formed due to the sheet being conveyed continuously between the recording head 44 and the maintenance device 81.

If the conveying device 202 is a non-electrostatic attraction type conveying device, e.g., is structured by the conveying roller 100 and the urging device 204, regardless of changes in the material and the thickness of the sheet and the adhesion of the coloring material to the sheet, which result in the electrostatic characteristics changing, and regardless of changes in the ambient temperature and humidity, the sheet is reliably pushed against the conveying rollers 100 by the urging device 204, and the driving force is reliably transmitted from the conveying rollers 100 to the sheet. As a result, the sheet is conveyed stably, and a high image quality printing is possible.

If the urging device 204 are star wheels 70 which are elastically urged by the springs 75, the surface area of contact with the sheet to which ink drops or the like have adhered is limited to a minimum, and high image quality printing is possible. In this way, even if the star wheels 70 which are urged by the springs 75 are used as the urging device 204, it is possible to reliably avoid breakage and deformation of the addenda of the star wheels 70 caused by contact with the conveying rollers 100, by providing the breakage avoiding portions at the conveying rollers 100 (e.g., the grooves 101 provided in ceramic rollers).

When the conveying device 202 are disposed at positions which are different than the recording head 44 in the conveying direction, it is possible to easily dispose the maintenance device 81 at a position facing the nozzle surface 40A of the recording head 44.

On the other hand, because the maintenance device 81 is disposed so as to oppose the nozzle surface 40A of the recording head 44, the coloring material can be transferred without moving the recording head 44 (i.e., with the recording head 44 in the same state as during the state of printing). For example, if the recording head 44 is an ink jet type, by discharging ink drops toward the maintenance device (i.e., by carrying out dummy jetting), the air bubbles existing in the recording head 44 are expelled, and the ink drop discharging performance is returned to its initial state.

In particular, during the period of time when, during continuous printing, the trailing end of a preceding sheet has passed by until the leading end of the next sheet arrives, ink drops are discharged toward the maintenance device 81. The ink drop discharging performance, which varies during continuous printing, is maintained constant, and high image quality printing is possible.

Namely, dummy jetting can be carried out without interrupting the printing operation during continuous printing. Therefore, the printing capacity (produceability) can be maintained high while high image quality printing is made possible.

Note that, in order, to carry out dummy jetting, there is no need for mechanisms which move the recording head 44 and the maintenance device 81, and a simple device structure can be realized.

SECOND EMBODIMENT

A recording device relating to a second embodiment of the present invention will be described.

Figure 11:
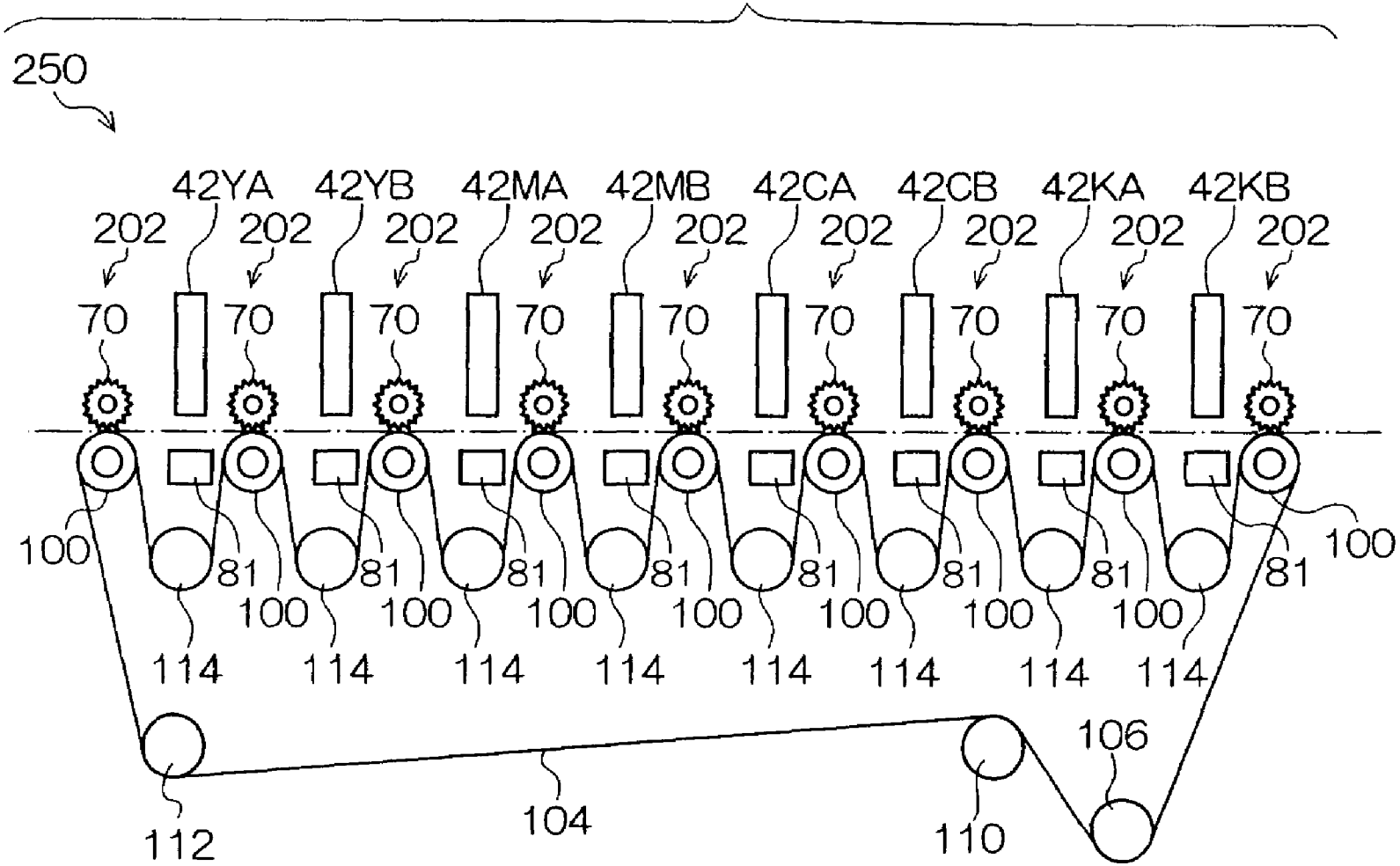
FIG. 11 is a diagram for explanation of a recording device relating to a second embodiment of the present invention.

As shown in FIG. 11, in a recording device 250 relating to the present embodiment, the recording head 44 is structured by a combination of a plurality of the recording head arrays 42A, 42B (see FIG. 4). By disposing a plurality of the recording heads 44 (the recording head arrays 42A, 42B) along the conveying direction, multi-color printing is possible. Here, recording heads 44Y, 44M, 44C, 44K (hereinafter called 44Y through 44M, and the same will apply to other members as well) (i.e., recording head arrays 42YA, 42YB through 42KA, 42KB), which can discharge ink drops of the respective colors of yellow, magenta, cyan and black, are disposed from the conveying direction upstream side, such that color printing is possible. However, the colors and numbers of the inks of the recording heads are not limited to those described above, and recording heads of other colors may be added, or a structure having a plurality of recording heads of the same color may be used.

In this case, the conveying device 202 are disposed between the respective recording head arrays, and at the upstream side of the upstream-most recording head array 42Y, and at the downstream side of the downstream-most recording head array 42KB.

Note that it is preferable that there is a single driving source 106 for the plurality of conveying device 202 which are disposed in this way. This is because, when there are a plurality of drive sources, it is difficult to keep the driving speeds and the fluctuation characteristics of the plurality of drive sources the same, and as a result, speed fluctuation components of the respective drive sources are compounded and affect the conveying speed of the sheet. As a result, even if the speed fluctuation components of the respective drive sources are sufficiently small, there is the concern that, due to the aforementioned compounding thereof, fluctuations in the speed of the sheet will manifest themselves as a deterioration in the printed image quality. A stepping motor or a servo motor, for example, can be considered for the driving source 106.

It is preferable that driving force be transmitted from the single drive source 106 to the plural conveying device 202 by a common driving member 104. A known drive transmitting member can be used as the driving member 104. However, a flat belt structure which can transmit the driving force by the frictional force of the surface without the meshing of teeth is preferable in particular. This is because, in a case in which gears (the meshing of teeth) are used, there is the great concern that periodic fluctuations in the speed of the respective teeth will arise and defects in image quality which can be easily perceived by humans will arise in the printed image.

As shown in FIG. 11, in a case in which the flat belt 104 is used as the driving member, when the flat belt 104 is trained around the conveying member 202, e.g., the conveying rollers 100, there is the need to work the angle of training of the flat belt 104 by using idler rollers 114, in order to compensate for the ease of slippage. It is preferable that the flat belt has little expandability/contractability and is difficult to deform. Both mechanical strength and a coefficient of friction can be achieved by utilizing a cloth of resin fibers as the core material, and utilizing any of various types of rubber (chloroprene rubber, nitrile rubber) or polyurethane as the surface layer. Further, a metal belt made of SUS or nickel may be used.

Figure 12:
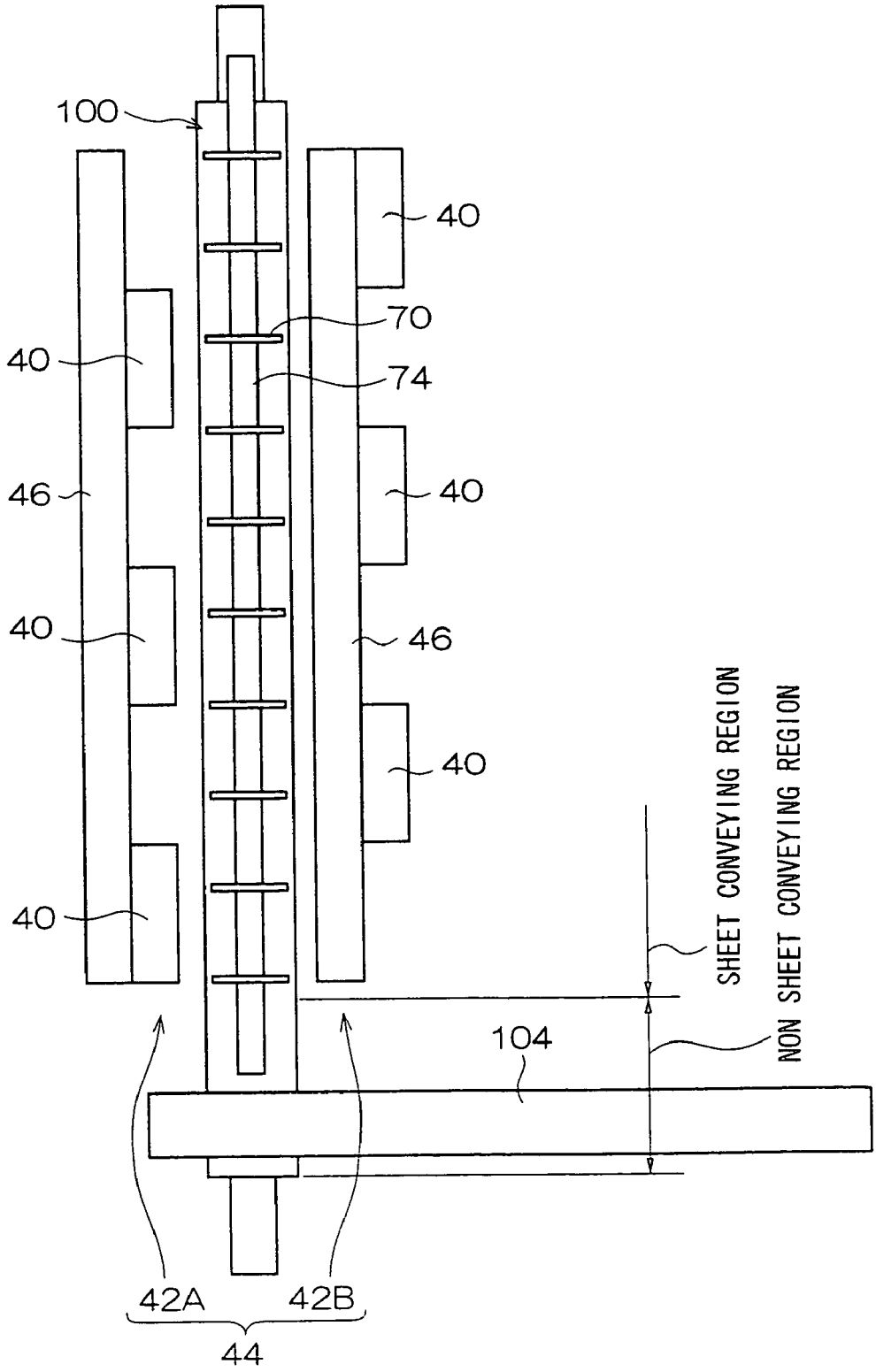
FIG. 12 is a partial diagram for explanation of a driving/conveying mechanism relating to the second embodiment of the present invention.

When the flat belt 104 is trained around the conveying roller 100, as shown in FIG. 12, the flat belt 104 is trained around a region where the sheet is not conveyed (hereinafter, "non sheet conveying region") at the outer side of the sheet conveying region of the conveying roller 100. In this case, the non sheet conveying region of the conveying roller 100 must have the same diameter as the sheet conveying region, and is preferably machined by the same machining process/method as the sheet conveying region. For example, when the sheet conveying region of the conveying roller 100 is a rubber roller covered by rubber or is coated with ceramic powder, the non sheet conveying region of the conveying roller 100, at which region the flat belt is trained around, is formed by the same process.

Operation of the recording device 250 which is structured in this way will be described.

Even when the recording device 250 is structured from the plurality of recording heads 44Y through 44K (the recording head arrays 42YA through 44KB), by providing the non electrostatic attraction type conveying device 202 between the respective recording head arrays and at the upstream side of the upstream-most recording head array 42YA and at the downstream side of the downstream-most recording head array 42KB, the sheet can be stably conveyed to the respective recording head arrays 42 (the recording heads 44) and printing can be carried out at a high image quality, regardless of changes in the paper quality, the thickness or the like of the sheet, or the adhesion of ink to the sheet, or changes in the electrostatic characteristics such as changes in the ambient temperature and humidity or the like.

In particular, when the conveying device 202 is structured by the conveying roller 100 and the urging device 204, by disposing the conveying device 202 between the recording head arrays 42, deformation of the sheet arising due to the adhesion of ink thereto is suppressed by the sheet being pushed against the conveying rollers 100 by the urging device 204, e.g., the urged star wheels 70. Accordingly, it is possible to reliably prevent the nozzle surfaces 40A from being damaged and the sheet from being dirtied due to the sheet contacting the nozzle surfaces 40 of the recording heads 44 due to the sheet deforming due to the adhesion of ink thereto.

By driving the plural conveying device 202, e.g., the conveying rollers 100, by the single drive source 106, fluctuations in the conveying speed of the sheet due to the compounding of fluctuations in the speeds of plural drive sources are prevented.

Further, because the driving force is transmitted from the drive source 106 to the conveying device 202 by the common driving member 104, dispersion in the conveying speeds among the respective conveying device 202 is suppressed.

In the case of a structure in which the flat belt 104 is trained around the conveying rollers 100 via the idler rollers 110 through 114, periodic speed fluctuation components of the respective teeth, such as in the case in which a chain and gears are used, are suppressed, and the appearance of such periodic fluctuations in the image formed on the sheet can be reduced.

In particular, by training the flat belt 104 around the non sheet conveying region, which is subjected to the same processing as and has the same diameter as the sheet conveying region of the conveying roller 100, even if there is run-out which is caused by the machining precision of the conveying roller 100 or the way of holding the conveying roller 100 (bearings or the like), periodic fluctuations in speed do not arise, and the sheet is conveyed at the same speed as the moving speed of the flat belt 104. Accordingly, periodic fluctuations in speed are reduced even more reliably.

Note that, in a structure in which the idler rollers 114 are provided in order to work the angles at which the flat belt 104 is trained around the conveying rollers 100, strictly speaking, periodic fluctuations in speed caused by the machining precision or the way of holding the idler rollers 114 do arise. However, the idler rollers 114 are relatively small and may be formed of a single material. Therefore, inexpensive and highly accurate machining thereof is easy. On the other hand, the conveying rollers 100 are large, and are structured by a plurality of materials, e.g., a metal core and a covering material. Therefore, it is difficult to machine the conveying rollers 100 at a high accuracy. Or, the conveying rollers 100 become extremely expensive parts.

Figure 27:
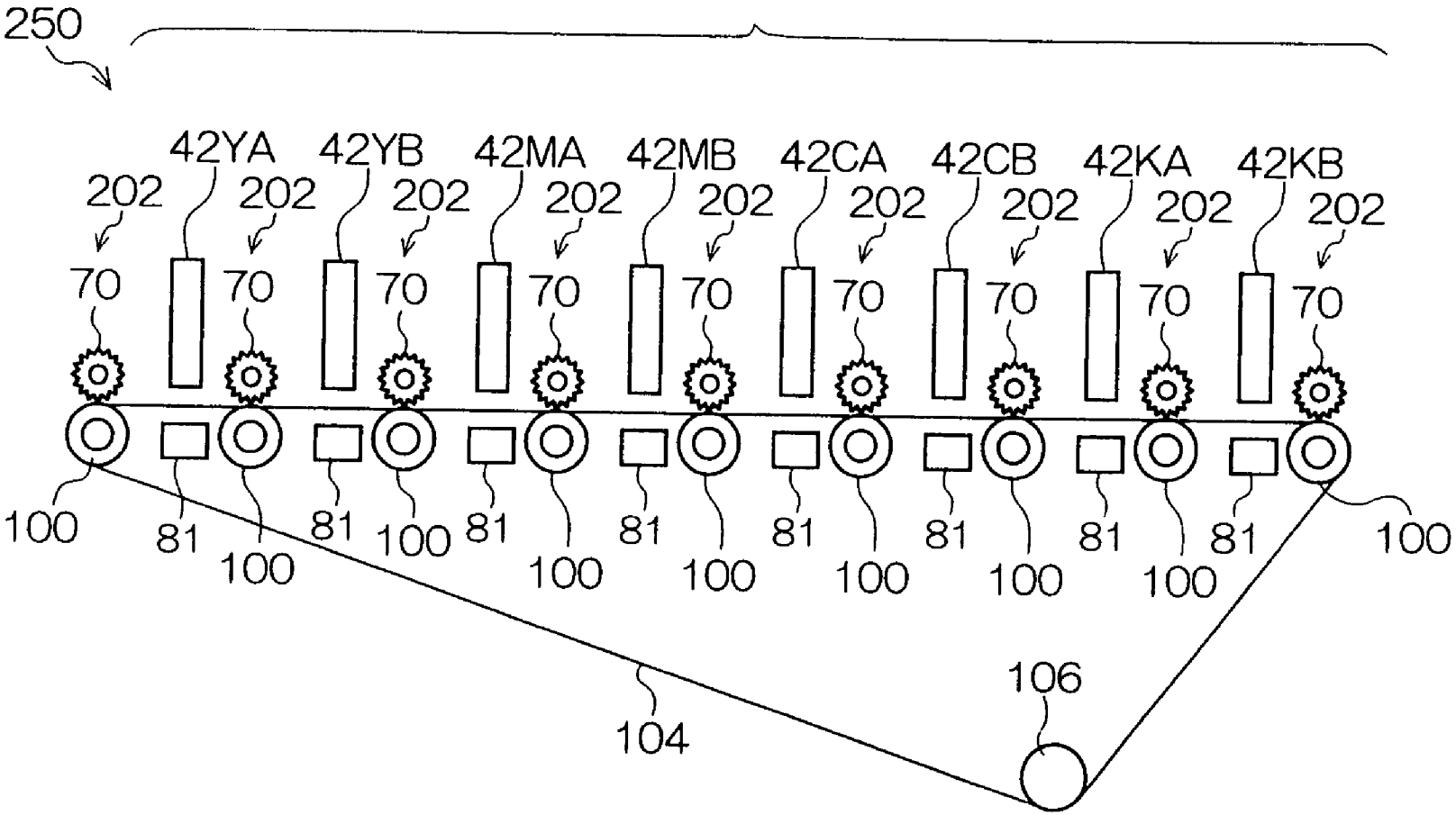
FIG. 27 is a diagram for explanation of another example of the driving/conveying mechanism relating to the second embodiment of the present invention.

Further, in the driving/conveying structure relating to the present embodiment, the flat belt 104 is employed as the common driving member. Therefore, the idler rollers 114 are disposed between the conveying rollers 100 in order to ensure the angles of training of the flat belt 104 around the conveying rollers 100. However, if a structure is used in which there is almost no need to consider sliding such as in the case of a chain for example, as shown in FIG. 27, the idler rollers 110 through 114 can be eliminated such that the driving member 104 contacts the surfaces of the conveying rollers 100.

EXAMPLE 1

An ink jet recording device, to which a recording device relating to Example 1 of the present invention is applied, will be described. Note that structural elements which are similar to those of the embodiments are denoted by the same reference numerals, and detailed description thereof is omitted.

(Overall Structure of Ink Jet Recording Device)

First, the overall structure of the ink jet recording device will be described.

Figure 13:
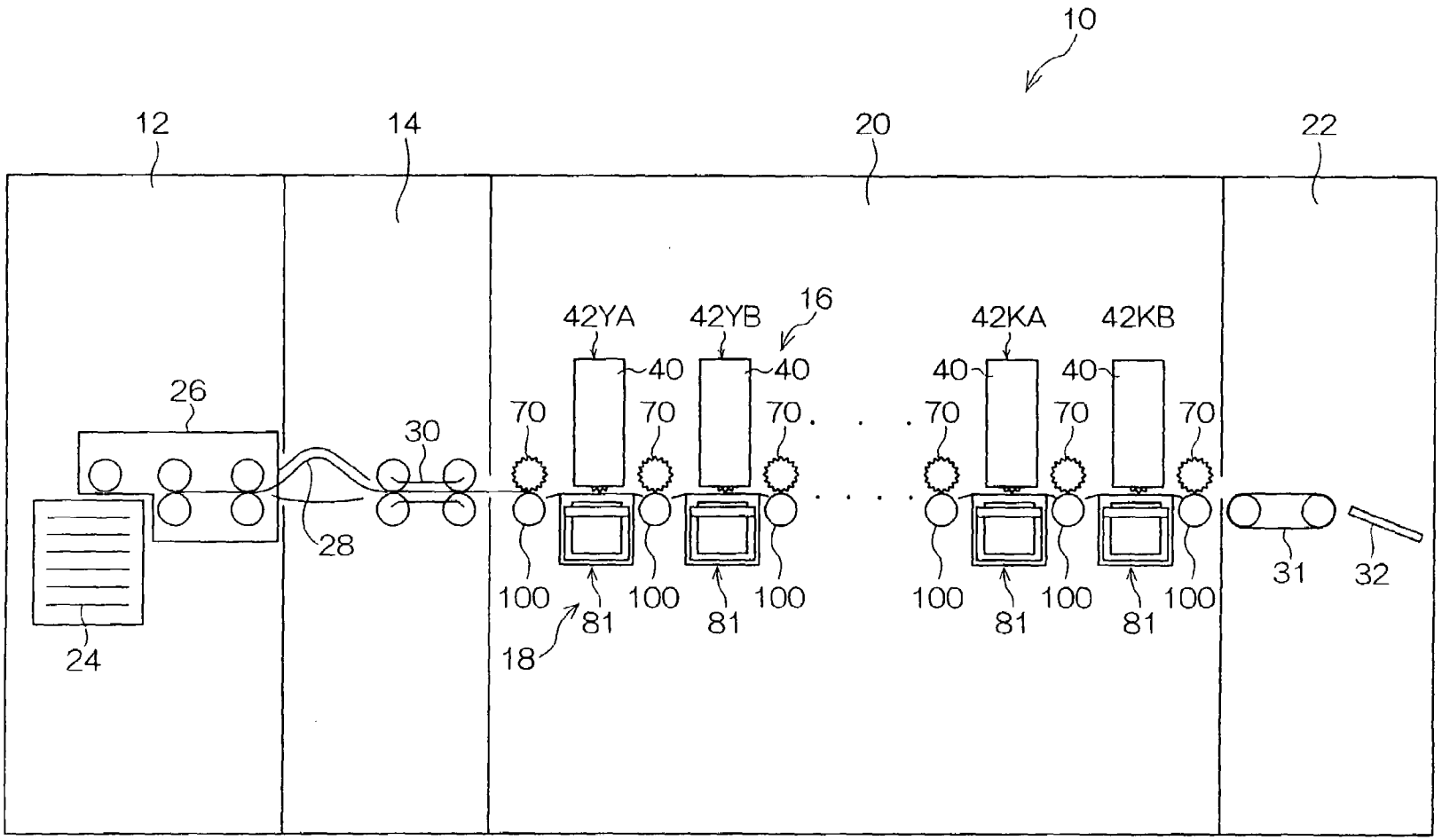
FIG. 13 is a schematic structural diagram showing a recording device relating to Example 1 of the present invention.

As shown in FIG. 13, an ink jet recording device 10 is structured basically from a recording section 20 and a discharging section 22. The recording section 20 has a sheet supplying section 12 which feeds out a sheet, a registration adjusting section 14 which controls the posture of the sheet, a recording head section 16 forming an image on the sheet by discharging ink drops, and a maintenance section 18 carrying out maintenance of the recording head section 16.

The discharging section 22 discharges the sheet on which an image has been formed in the recording section 20.

The sheet supplying section 12 is formed from a stocker 24 in which sheets are stocked in a stacked manner, and a conveying device 26 which removes the sheets one-by-one from the stocker 24 and conveys them to the registration section 14.

The registration section 14 has a loop forming portion 28 and a guiding member 30 which controls the posture of the sheet. Due to the sheet passing through this section, the skewing of the sheet is corrected by utilizing the stiffness of the sheet, and the conveying timing is controlled and the sheet is fed into the recording section 20.

In the recording section 20, a sheet conveying path along which the sheet is conveyed is formed between the recording head section 16 and the maintenance section 18. Ink drops are discharged from the recording head section 16 and an image is formed on the sheet which is being continuously (without stopping) conveyed along the sheet conveying path. The recording head section 16 and the maintenance section 18 are each formed as a unit. The recording head section 16 can be separated from the maintenance section 18 across the sheet conveying path. Accordingly, if there is a paper jam, the jammed sheets can be easily removed. Detailed description of the recording section 20 is not included here as it will be given later.

The sheet discharging section 22 accommodates the sheets, on which images have been formed in the recording section 20, in a tray 32 via a sheet discharging belt 31.

(Structure of Recording Head Section)

Figure 14:
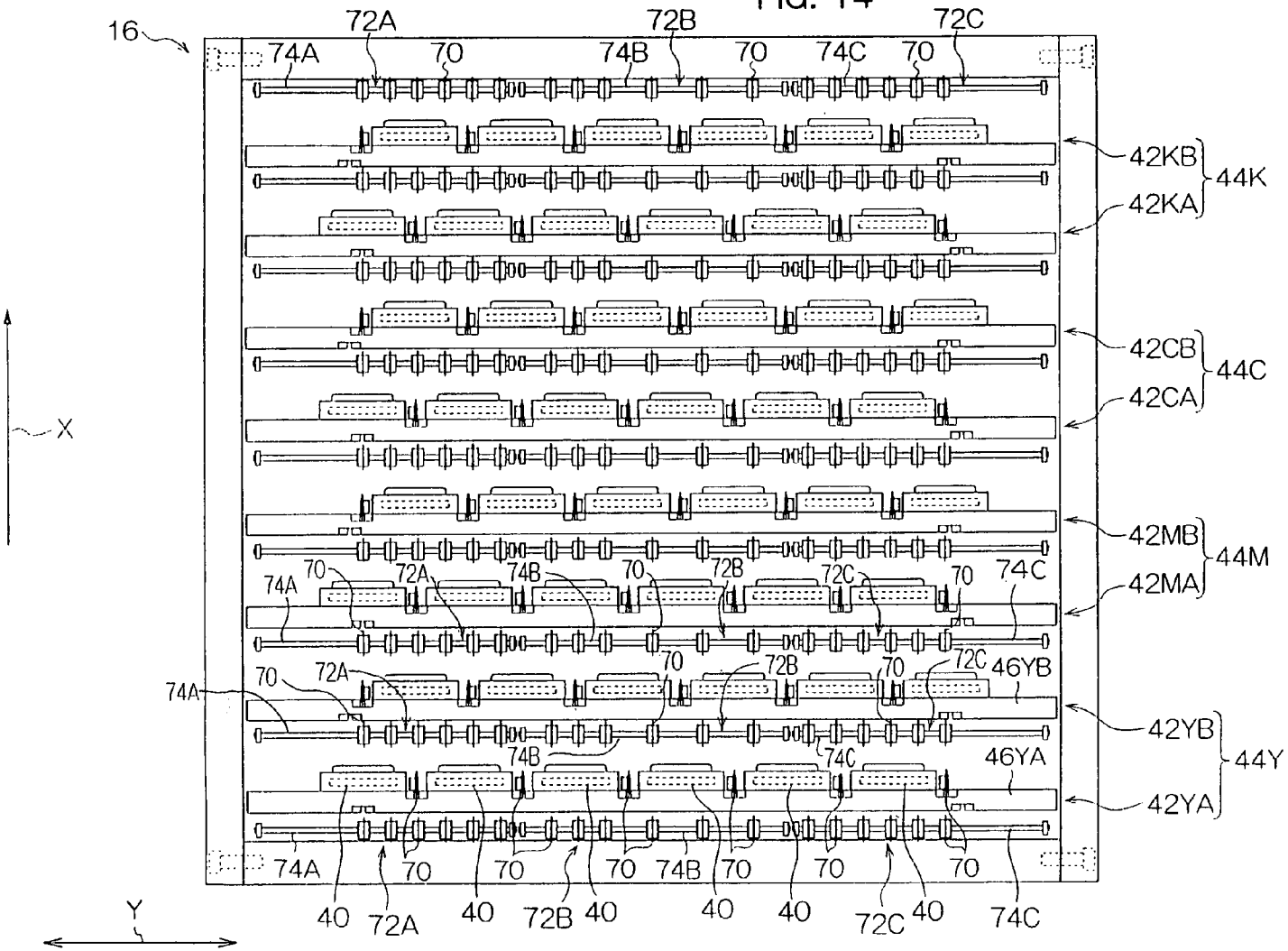
FIG. 14 is a schematic plan view of a recording head section relating to Example 1 of the present invention.

Next, the recording head section 16 will be described in detail with reference to FIGS. 14 through 19. FIG. 14 is a schematic diagram, as seen from above, of the recording head section 16 (a plan view seen from above in order to achieve better correspondence with FIG. 20).

As shown in FIG. 14, the recording head section 16 is basically structured by eight of the recording head arrays 42 being disposed at uniform intervals in the sheet conveying direction. At each of the recording head arrays 42, six of the unit recording heads 40 are disposed at uniform intervals with respect to the sheet widthwise direction (the direction of arrow Y, hereinafter called the "widthwise direction" upon occasion) which is orthogonal to the sheet conveying direction (the direction of arrow X, hereinafter called the "conveying direction" upon occasion).

Figure 15:
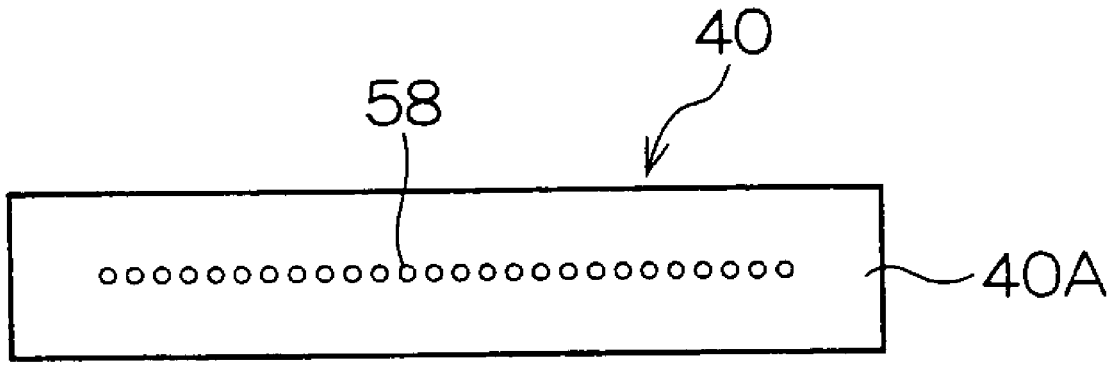
FIG. 15 is a plan view of a unit recording head relating to Example 1 of the present invention.

As shown in FIG. 15, at the unit recording head 40, the nozzles 58 which discharge ink are formed on a single straight line at the nozzle surface 40A, and ink drops are discharged therefrom by the known thermal ink jet method. In the present Example, the density at which the nozzles are lined up at the unit recording head 40 is 800 nozzles which is 800 dpi, the jetting frequency is 7.56 kHz, and a pigment ink is used.

The recording head arrays 42A, 42B are each formed by attaching six of the unit recording heads 40 to the common substrate 46 (which will be described later) along a single straight line, such that the direction in which the nozzles are lined up coincides with the widthwise direction.

Figure 16:
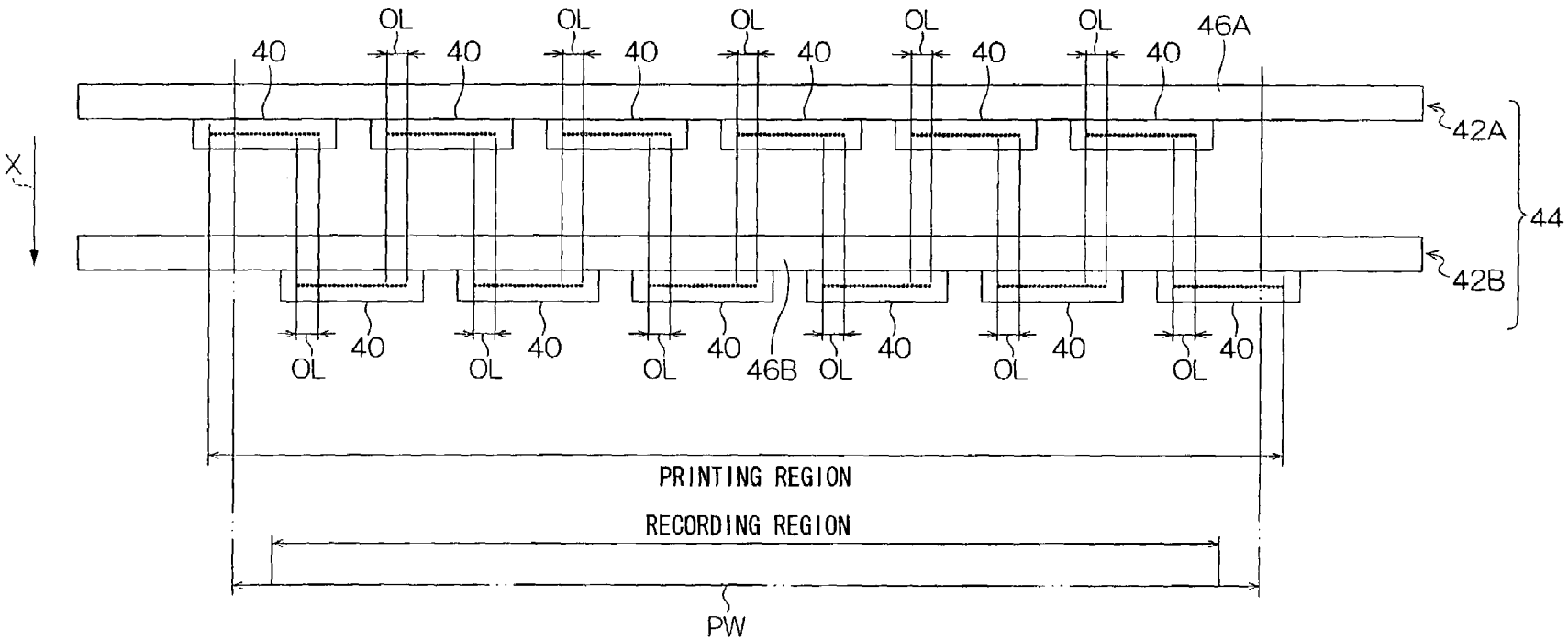
FIG. 16 is a structural diagram for explanation of a recording head array relating to Example 1 of the present invention.

As shown in FIG. 16, at each of the recording head arrays 42A, 42B, six of the unit recording heads 40 are disposed at uniform intervals. By arranging the unit recording heads 40 so as to be offset from one another in the widthwise direction at the recording head arrays 42A, 42B, respective portions of the nozzle rows of the unit recording heads 40 are disposed such that there are overlap regions OL at which there is overlap between the recording head arrays 42A, 42B. By providing these overlap regions OL in this way, it is possible to prevent regions where printing cannot be carried out from arising within the printing region. Namely, by discharging ink drops from the nozzles 58 of the unit recording heads 40 of the pair of recording head arrays 42A, 42B, printing of a single color onto the sheet is carried out. In the present Example, this combination of the pair of the recording head arrays 42A, 42B is called the recording head 44.

In the recording head 44 of the present Example, the printing region is 12 inches, which is set to be wider than 297 mm which is the width of the short side of an A3 sheet (the width of the long side of an A4 sheet) which is the maximum sheet width PW.

The recording heads 44 are structured so as to enable full-color printing by printing yellow (Y), magenta (M), cyan (C), and black (K) in that order from the conveying direction upstream side. When necessary, the respective recording heads 44 will be differentiated by adding the letter Y, M, C, K to the reference numeral of the corresponding recording head (i.e., will be differentiated as 44Y, 44M, 44C, 44K) (see FIG. 14). Hereinafter, the same holds for other members as well.

The structures of the recording heads 44Y through 44K are the same. Therefore, in FIG. 14, reference numerals are applied only to the structural elements of the recording head 44Y, and are not applied to the structural elements of the other recording heads 44M through 44K.

Figure 17:
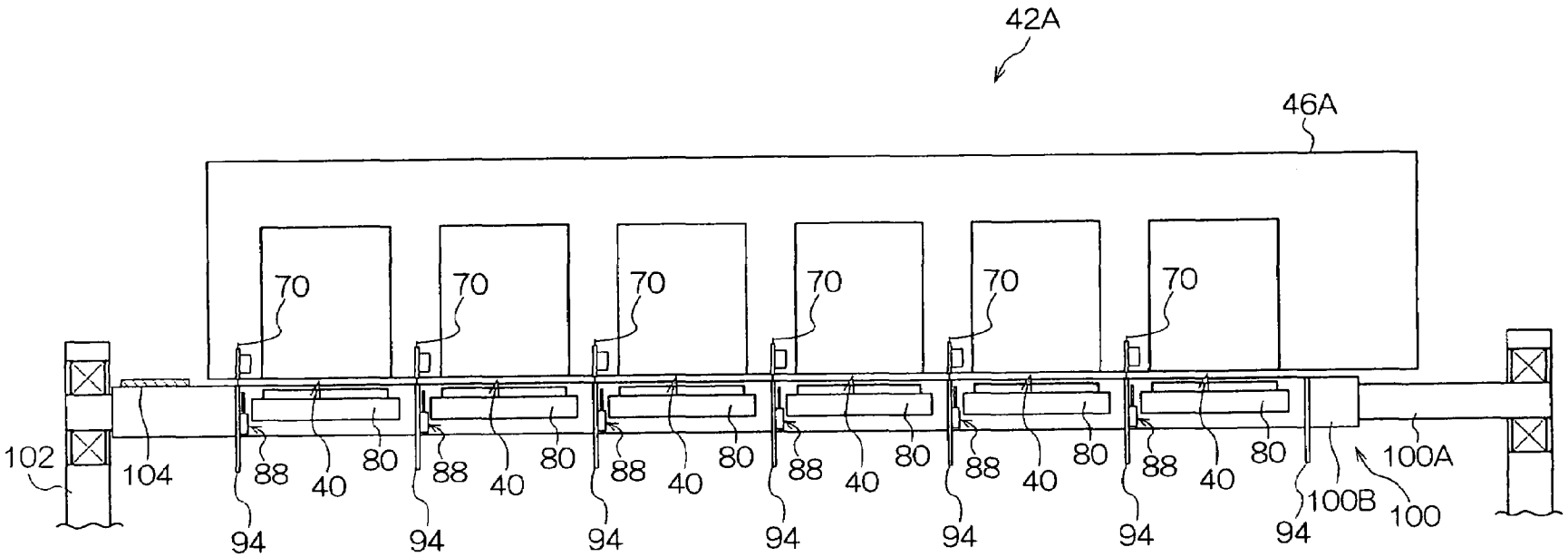
FIG. 17 is a longitudinal sectional view of a recording section relating to Example 1 of the present invention.

As shown in FIG. 17, at the recording head array 42A structuring the recording head 44, six of the unit recording heads 40 are attached at predetermined intervals to the common substrate 46A which extends in the sheet widthwise direction.

Namely, as shown in FIG. 16, by attaching the unit recording heads 40 to the common substrate 46A, the nozzle rows thereof are lined up along the widthwise direction.

Further, in the recording head section 16, three star wheel groups 72A through 72C are disposed, along the conveying direction, between the recording head arrays 42, and at the upstream side of the upstream-most recording head array 42YA, and at the downstream side of the downstream-most recording head array 42KB (see FIG. 14). At the respective star wheel groups 72A through 72C, six of the star wheels 70 are rotatably supported at predetermined intervals at three shafts 74A through 74C which are disposed so as to be continuous in the widthwise direction. Each of the shafts 74A through 74C is urged at both ends toward the conveying roller 100, which will be described later, by the springs 75. Note that a restricting member 77 (see FIG. 18) is provided such that the amount of displacement of the star wheel 70 toward the conveying roller 100 is restricted such that the star wheel 70 stops at a position of slightly biting into the surface of the conveying roller 100 (see FIG. 18).

Here, the widthwise direction interval between the star wheels 70 is 25.4 mm at the widest place. In order to suppress local floating up and deformation of the sheet, this interval is preferably 50 mm or less.

Further, the force by which the star wheel 70 is pushed toward the conveying roller 100 by the springs 75 is 10 gf per star wheel 70. If the pushing force is less than 5 gf, the sheet cannot be sufficiently pushed toward the conveying roller 100, whereas if the pushing force is greater than 30 gf, the star wheel 70 damages the sheet.

Figure 19A:
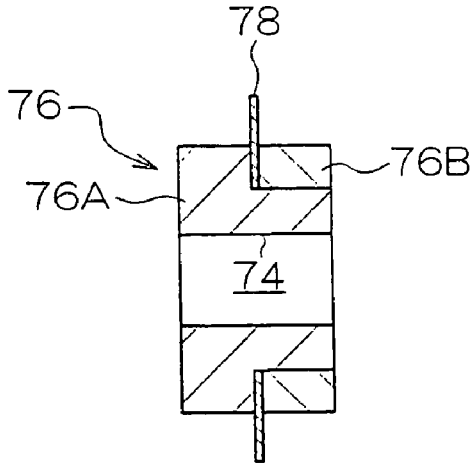
FIG. 19A is a sectional view of a star wheel.
Figure 19B:
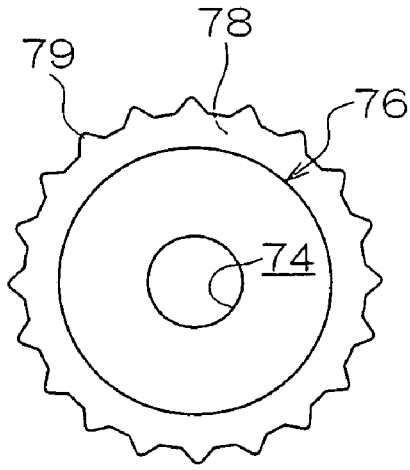
FIG. 19B is a side view thereof.
Figure 19C:
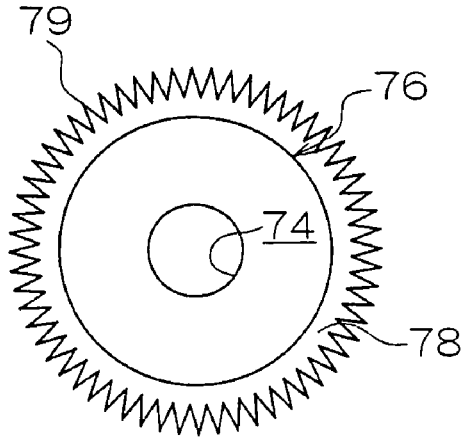
FIG. 19C is a side view relating to another example thereof.

As shown in FIG. 19A, the star wheel 70 is structured by a holding body 76 and a wheel 78. The holding body 76 is made of resin, is circular, and a hole 74 is formed therein. The wheel 78 is made of stainless steel and is held by the holding body 76.

The holding body 76 is structured from a first member 76A and a second member 76B. At the axial direction center, the diameter of the first member 76A is small and the wheel can be inserted in. The second member 76B fits together with this small diameter portion and, together with the first member 76A, nips the wheel 78. A large number of teeth 79 are formed at uniform intervals at the outer periphery of the wheel 78. The configurations of the distal ends of the teeth 79 are obtuse angles and are rounded (see FIG. 19B). However, it suffices for the surface area of contact for contacting the ink which has not yet dried on the sheet to be kept as small as possible, and the configurations of the distal ends of the teeth 79 may be acute angles (see FIG. 19C).

In the present Example, the thickness of the wheel 78 is 0.1 mm. Only the distal ends (the addenda) are made to be thin to about 0.01 to 0.02 mm by taper processing. Further, the outer shape and the tapered configurations of the distal ends of the wheel 78 are formed by simultaneous machining by both-surface step etching an SUS 631 EH material. The surface is coated by a fluorine resin so as to be water-repellant.

At the recording head array 42A, the star wheels 70 are disposed next to the respective unit recording heads 40. The star wheels 70 are rotatably supported elastically via plate springs 73 at the distal ends of supporting members 71 which fit together with the common substrate 46 (see FIG. 18).

(Structure of Maintenance Section)

Figure 20:
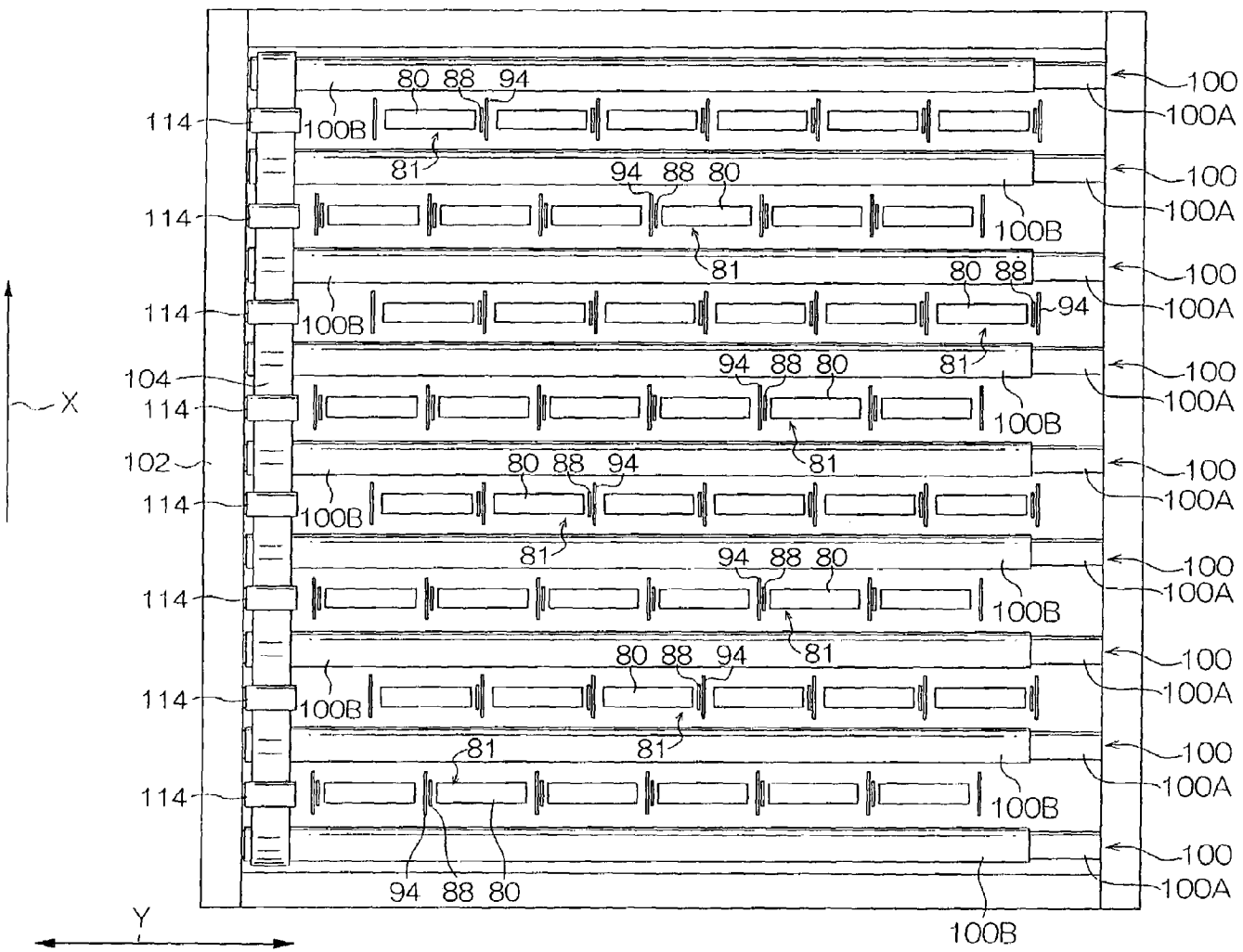
FIG. 20 is a schematic plan view of a maintenance section relating to Example 1 of the present invention.

The structure of the maintenance section 18, which is disposed so as to face the recording section 20, will be described with reference to FIGS. 20 through 25. FIG. 20 is a plan view of the maintenance section 18 as seen from the conveying position.

The maintenance section 18 is disposed so as to oppose the recording section 20 across the sheet conveying position. As shown in FIG. 20, maintenance devices 81 are disposed at positions opposing the respective unit recording heads 40 of the recording section 20 (see FIG. 14). The maintenance device 81 is structured by a capping member 80 and a wiping member 88.

Figure 21:
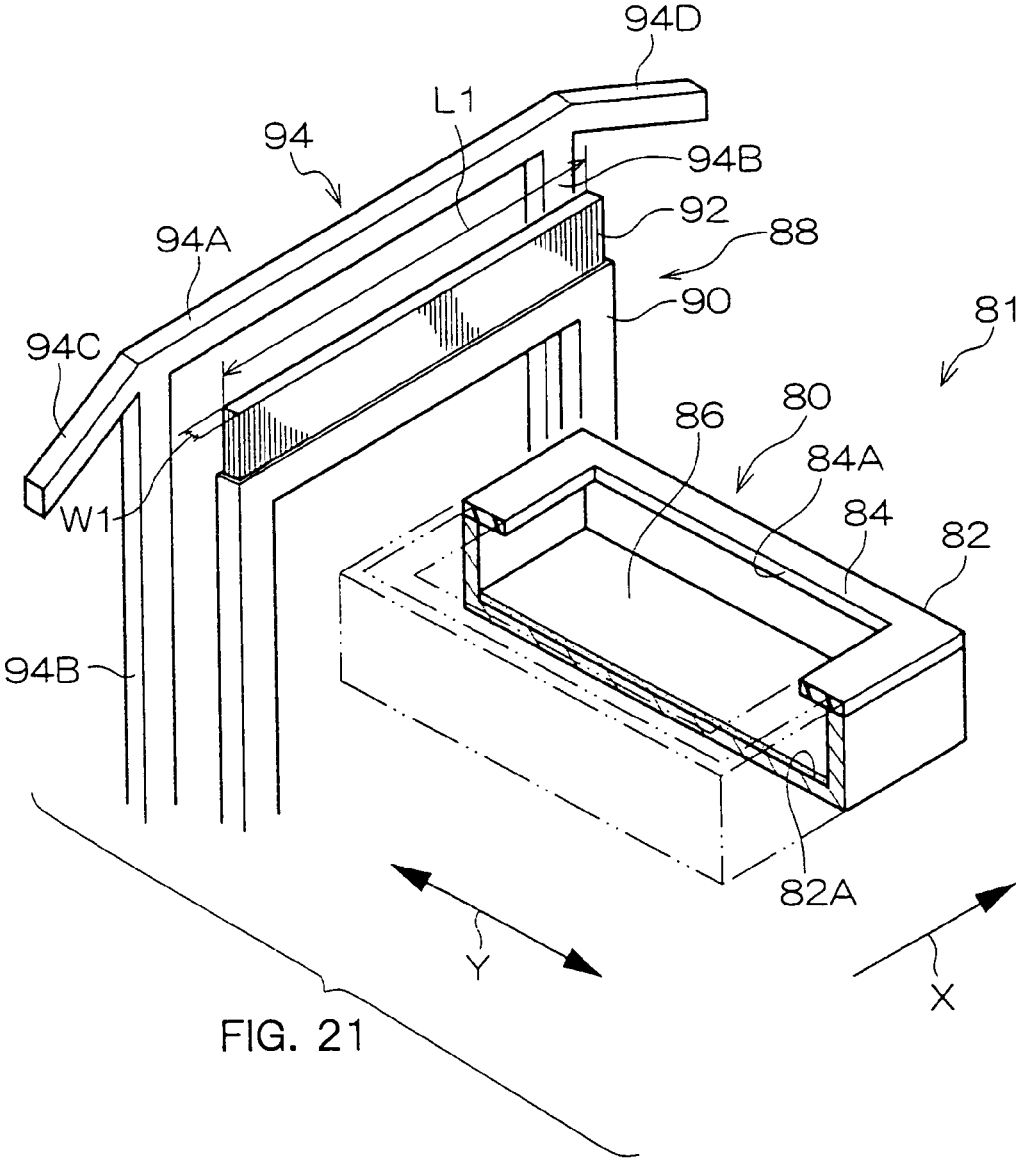
FIG. 21 is a perspective view for explanation of main portions of the maintenance section relating to Example 1 of the present invention.

As shown in FIG. 21, the capping member 80 is structured from a receiving portion 82, a rubber portion 84, and an ink absorbing body 86. The receiving portion 82 is formed from PBT resin, and a rectangular concave portion 82A of a depth of 8 mm is formed therein. The rubber portion 84 is formed from silicone rubber (degree of hardness: 40 Hs), at the top portion of the receiving portion 82. The ink absorbing body 86 is formed from polypropylene and polyethylene, and is disposed over the entire floor surface of the concave portion 82A. Accordingly, at the time of dummy jetting which will be described later, ink drops are discharged from the nozzles 58 of the unit recording head 40 into the concave portion 82A via an opening 84A of the capping member 80, and are absorbed by the ink absorbing body 86.

Figure 22:
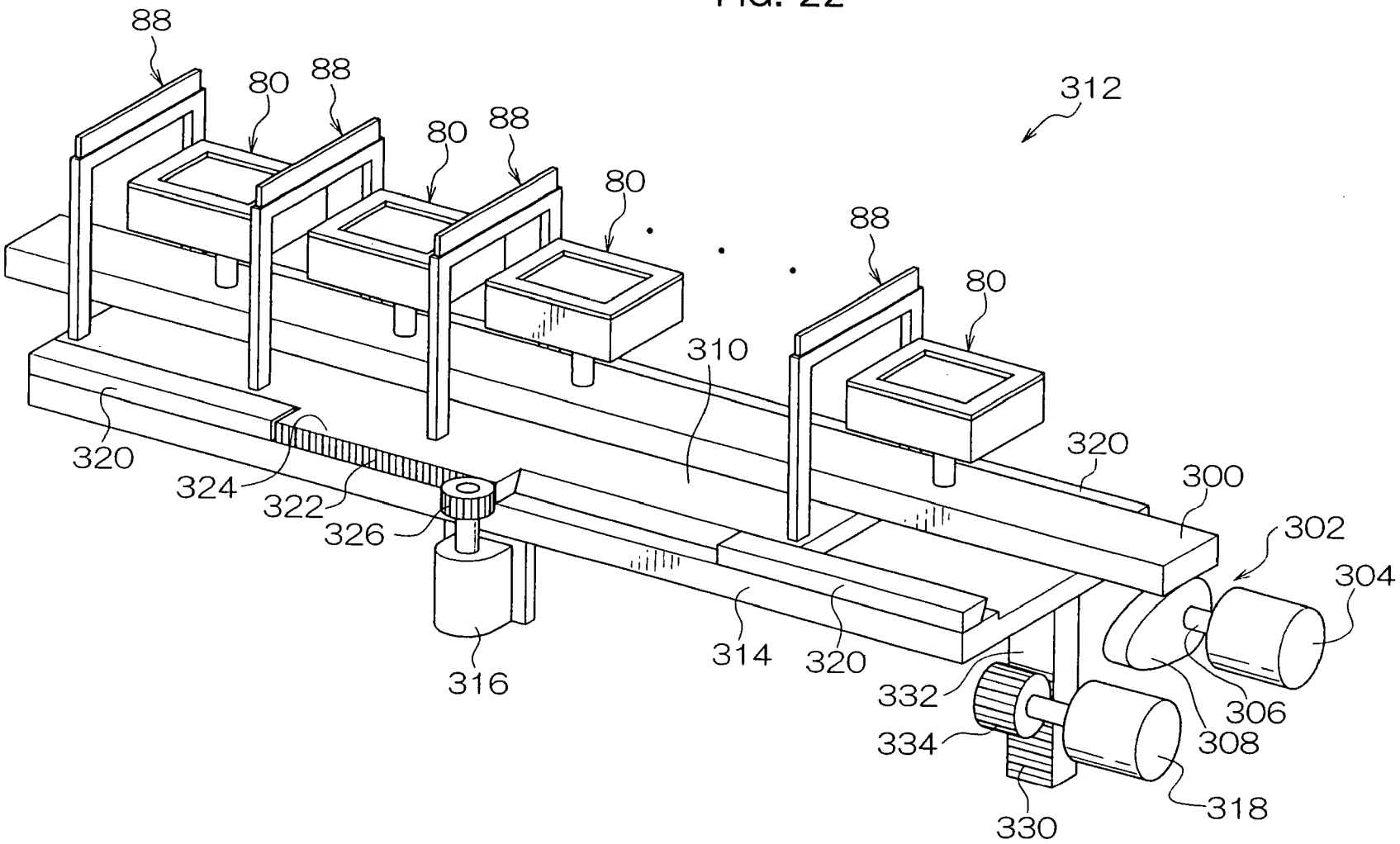
FIG. 22 is a diagram for explanation of a raising/lowering mechanism and a moving mechanism of the maintenance section relating to Example 1 of the present invention.

As shown in FIG. 22, six of the capping members 80, which respectively correspond to the unit recording heads 40 structuring the recording head array 42, are attached to a common substrate 300 so as to form a unit. The capping members 80 are structured so as to be able to integrally approach and move away from the nozzle surfaces 40A of the unit recording heads 40 by a raising/lowering mechanism 302.

The raising/lowering mechanism 302 is structured from a driving motor 304, and an eccentric cam 308 which is attached to a drive shaft 306 of the driving motor 304 and which is abutted by the bottom surface of the common substrate 300. Accordingly, due to the driving motor 304 being driven, the eccentric cam 308 rotates, and the common substrate 300, which abuts the eccentric cam 308, approaches and moves away from the nozzle surfaces 40A of the unit recording heads 40.

Figure 26A:
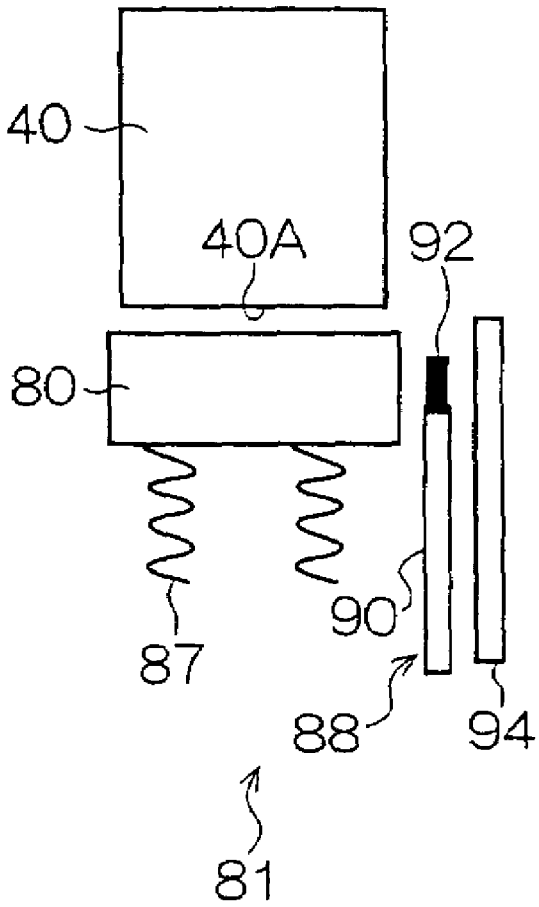
FIGS. 26A and 26B are diagrams for explanation of a capping operation in the recording device relating to Example 1 of the present invention.
Figure 26B:
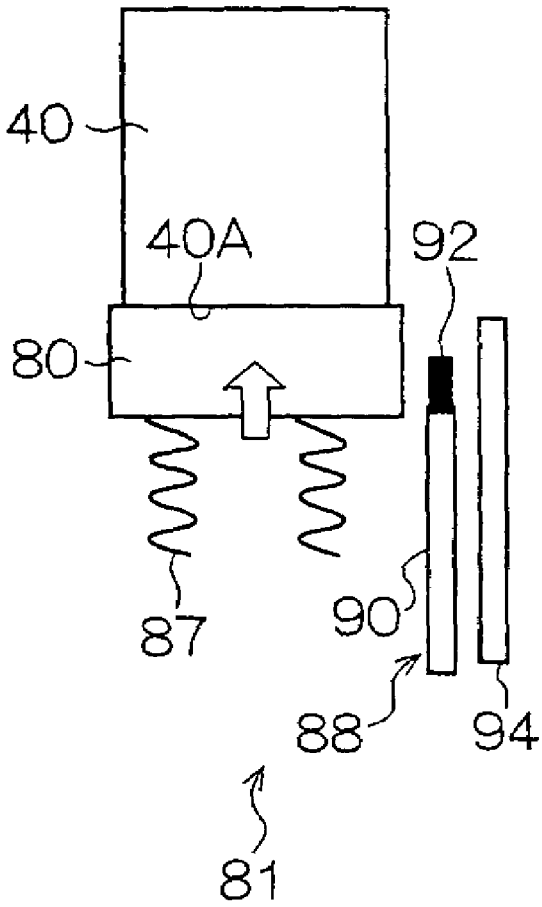

Note that springs 87, which adjust the press-contact force at the time when the capping members 80 press-contact the nozzle surfaces 40A, are disposed at the lower sides of the capping members 80 (see FIGS. 26A and 26B). Accordingly, at the time of a capping operation which will be described later, the capping members 80 are raised, and the rubber portions 84 press-contact the nozzle surfaces 40A such that the nozzle surfaces 40A (including the nozzles 58) are made to be airtight. Drying of the ink is suppressed, and the adhesion of dirt, dust and the like is prevented. Moreover, at the time of a wiping operation which will be described later, the capping members 80 are lowered, and the wiping members 88 can be moved in the widthwise direction.

The wiping members 88, which are for cleaning the nozzle surfaces 40A of the unit recording heads 40, are disposed at positions adjacent, in the widthwise direction, to the respective capping members 80 (see FIGS. 21 and 22).

As shown in FIG. 21, the wiping member 88 is structured from a holding member 90 and a wiper 92. The holding member 90 is formed substantially in the shape of an arch as seen in the widthwise direction. The wiper 92 is disposed at the top portion of the holding member 90 and extends along the conveying direction.

The wiper 92 is formed of a thermoplastic polymer resin (degree of hardness: 65 Hs). A widthwise direction width W1 thereof is 0.8 mm, and a conveying direction length L1 thereof is 8 mm. The height (the free length) of the wiper 92 from the holding member 90 is 6 mm.

The holding member 90 is formed from an SUS material.

The wiping member 88 is disposed at a position which is 1 mm from a widthwise direction end portion of the capping member 80.

As shown in FIG. 22, all of the wiping members 88 corresponding to the unit recording heads 40 structuring the recording head array 42 are attached to a common substrate 310 so as to form a unit. The wiping members 88 are structured so as to be able to integrally move in the widthwise direction and approach and move away from the nozzle surfaces 40A of the unit recording heads 40 by a moving mechanism 312.

The moving mechanism 312 is basically structured from a slider 314, a driving motor 316, and a driving motor 318. The slider 314 supports the common substrate 310 such that the common substrate 310 is movable along the widthwise direction. The driving motor 316 moves the common substrate 310 in the widthwise direction on the slider 314. The driving motor 318 raises and lowers the slider 314. The slider 314 has guides 320 which are provided at both conveying direction ends thereof and which extend in the widthwise direction. The common substrate 310, which is guided by the guides 320, is movable in the widthwise direction. A convex portion 324, at which a rack 322 is formed, is formed at one side surface of the common substrate 310. The rack 322 meshes with a driving gear 326 of the driving motor 316 which is attached to the slider 314. Accordingly, the common substrate 310 can move in the widthwise direction on the slider 314 due to the driving of the driving motor 316.

A convex portion 332, at which is provided a rack 330 which extends along the top-bottom direction, is formed at the lower side of the slider 314. A driving gear 334 of the driving motor 318 meshes with the rack 330. Accordingly, the slider 314 can be raised and lowered due to the driving of the driving motor 318. Namely, the common substrate 310, at which the slider 314 is supported, and the wiping members 88 can be raised and lowered integrally.

In this way, the wiping members 88 are structured so as to be able to, by the moving mechanism 312, approach and move away from the nozzle surfaces 40A (i.e., to be raised and lowered) and to move in the widthwise direction. Namely, at their home positions, the wiping members 88 (the wipers 92) are positioned (see FIG. 23A) at positions which are lower than the capping members 80, so as to not interfere with the sheet which is being conveyed. However, at the time of wiping, the wiping members 88 (the wipers 92) are raised, straddle over the capping members 80 which have been lowered from their home positions, and move in the conveying direction so as to carry out wiping (see FIG. 23C).

At the recording section 20, guiding members 94 (see FIG. 21) are disposed at both widthwise direction sides of each capping member 80, so that the sheet does not project into the concave portion 82A of the capping member 80 at the time when the sheet is conveyed. The guiding member 94 is formed from an SUS material, and as shown in FIG. 21, is structured from a horizontal portion 94A, two vertical portions 94B, and guide portions 94C, 94D. The horizontal portion 94A extends in the conveying direction. The vertical portions 94B extend vertically downward from the both end portions of the horizontal portion 94A. The guide portions 94C, 94D extend, downward at an angle, in the conveying direction from the conveying direction end portions of the horizontal portion 94A.

Figure 18:
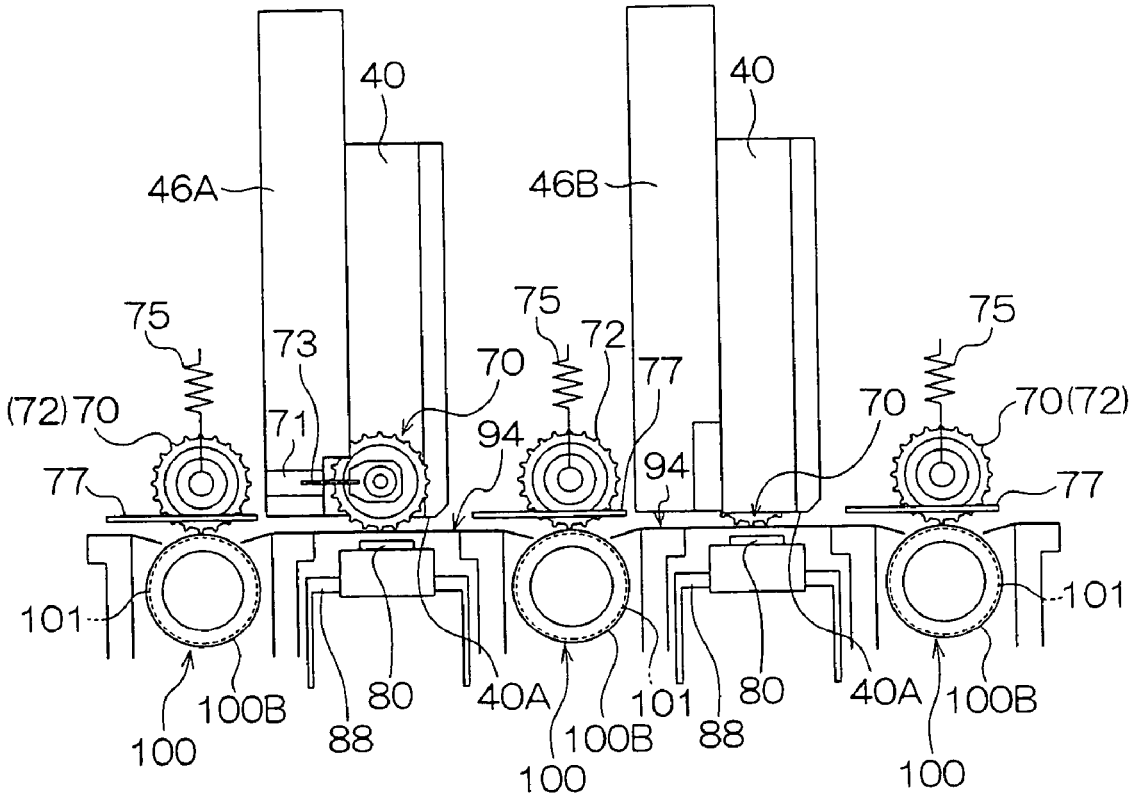
FIG. 18 is a side view of main portions of the recording section relating to Example 1 of the present invention.

Note that the horizontal portions 94A of the guiding members 94 are disposed so as to oppose the star wheels 70 which are disposed between the unit recording heads (see FIGS. 14, 20 and 18). Accordingly, at the printing position in the conveying direction, the sheet which is being conveyed abuts the guiding members 94 (the horizontal portions 94A) due to the star wheels 70, such that the sheet which is deformed due to the adhesion of ink thereto or the like is maintained at a constant distance with respect to the nozzle surfaces 40A (see FIG. 18).

Next, the home positions of the respective members structuring the maintenance device 81 in the present embodiment (i.e., the positions in the state in which maintenance of the unit recording head 40 is not being carried out during image printing) will be described.

The capping members 80 are disposed beneath the nozzle surfaces 40A of the recording heads 40, and are disposed such that the rubber portions 84 cover the entire nozzle surfaces 40A of the unit recording heads 40 as seen in plan view, and such that all of the nozzles 58 of the unit recording heads 40 are positioned within the openings 84A of the rubber portions 84 as seen in plan view.

At the wiping members 88, the wipers 92 are disposed at positions which are separated by 1 mm from the widthwise direction end portions of the unit recording heads 40 (i.e., positions at which the wipers 92 can clean in the short side widthwise direction of the recording heads), at positions at which the distal ends of the wipers 92 are disposed beneath the nozzles surfaces 40A of the unit recording heads 40 and the longitudinal (conveying) direction lengths of the wipers 92 can cover the conveying direction widths of the nozzle surfaces 40A of the unit recording heads 40 in plan view.

At the guiding members 94, the topmost surfaces of the horizontal portions 94A which the sheet contacts are disposed at positions which are separated by 2 mm from the widthwise direction end portions of the unit recording heads 40, at positions at which the topmost surfaces of the horizontal portions 94A which the sheet contacts are disposed beneath the nozzle surfaces 40A of the unit recording heads 40 and the conveying direction lengths of the horizontal portions 94A of the guiding members 94 can cover the nozzle surfaces 40A of the unit recording heads 40 in plan view.

Next, description will be given of the structure for conveying the sheet between the maintenance devices 81 and the unit recording heads 40.

The conveying rollers 100, which transmit driving force to the sheet and convey the sheet, are disposed in the maintenance section 18 at the conveying direction both ends and between the capping members 80 which are adjacent in the conveying direction (see FIG. 20). The conveying rollers 100 are disposed so as to correspond to the positions at which the star wheel groups 72A through 72C are disposed, with the sheet conveying position located therebetween (see FIG. 18). The sheet is made to abut the conveying rollers 100 by the star wheels 70 of the star wheel groups 72A through 72C which are elastically pushed by the springs 75 toward the conveying rollers 100, and the driving force from the conveying rollers 100 is transmitted to the sheet.

The conveying roller 100 is structured from a small diameter portion 100A which is rotatably supported at a casing 102, and a large diameter portion 100B whose diameter is larger than that of the small diameter portion 100A and which the star wheels 72 abut (see FIG. 17). The conveying roller 100 transmits driving force to the sheet via the large diameter portion 100B. The conveying roller 100 should have a large coefficient of friction and should be difficult to wear down. In the present Example, the conveying roller 100 is a structure in which a ceramic fine powder, whose main component is alumina, is spray coated on and sintered to the surface of a metal (SUS 303) roller having a diameter of 10 mm, and satisfies the aforementioned conditions. This processing is carried out not only on the printing region, which the sheet abuts, of the large diameter portion 100B of the conveying roller 100, but also, a similar processing is carried out as well on the non printing region around which the flat belt 104 is trained.

Note that, in order to prevent the addenda of the star wheels 70 from deforming due to the star wheels 70 contacting the surface of the conveying roller 100, the grooves 101 (see FIGS. 10 and 18) having a width of 2 mm and a depth of 2 mm are provided along the circumference at the portions of the conveying rollers 100 facing the star wheels 72. Further, in order to prevent the resistance to the conveying of the sheet from increasing due to an increase in the amounts of the star wheels 72 which enter into the grooves 101, the restricting members 77 (see FIG. 18), which restrict the amounts of entry of the star wheels 72, are provided.

Figure 24:
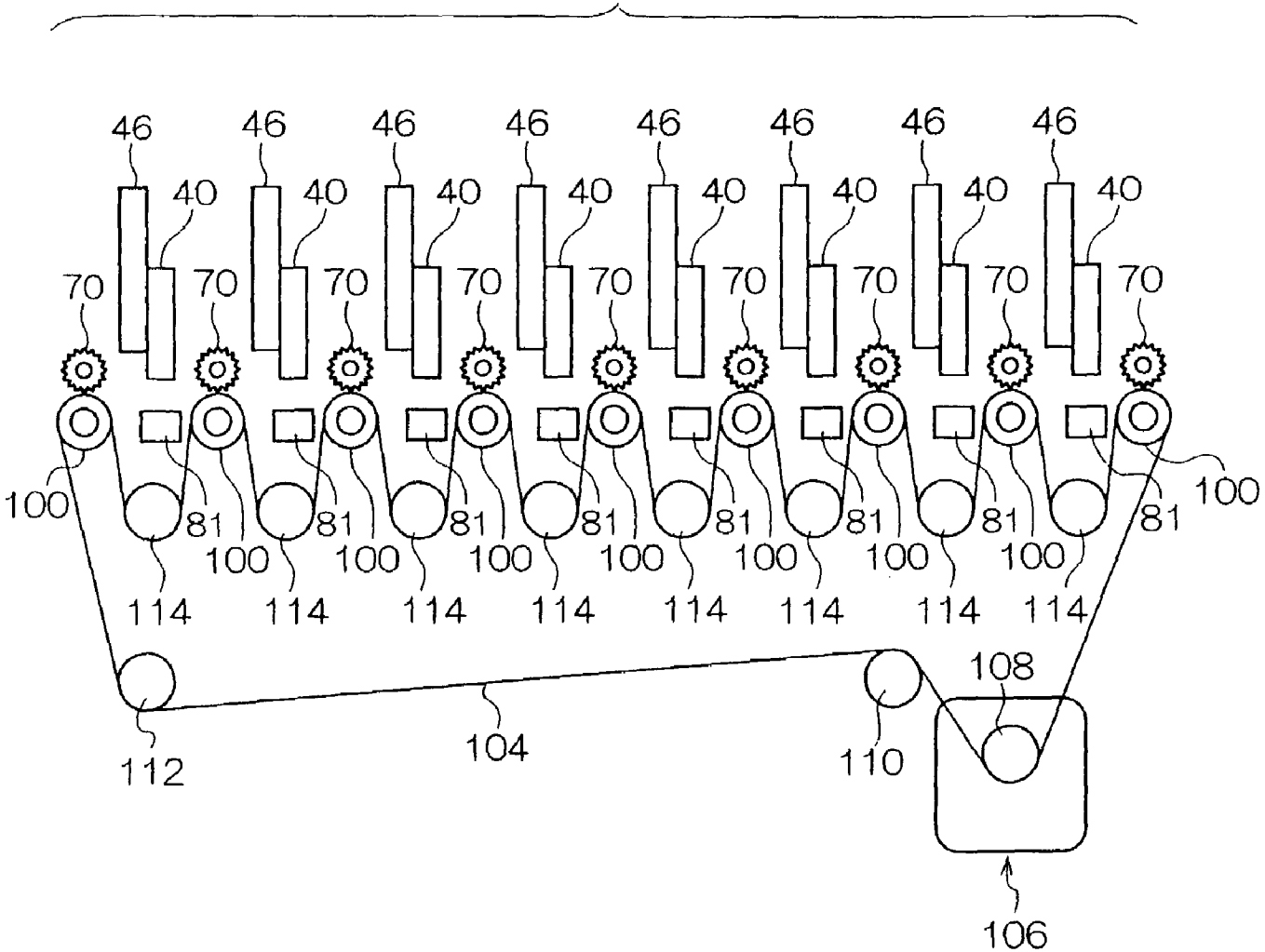
FIG. 24 is a diagram for explanation of a driving mechanism of the recording device relating to Example 1 of the present invention.

As shown in FIG. 24, the driving mechanism which drives the conveying rollers 100 is structured such that the flat belt 104 is trained, from a driving shaft 108 of the single motor 106, around all of the conveying rollers 100 via the idler rollers 110, 112. The idler rollers 114 are disposed between the adjacent conveying rollers 100, and work the angle at which the flat belt is trained around the respective conveying rollers 100 (the large diameter portions 100B).

Figure 25:
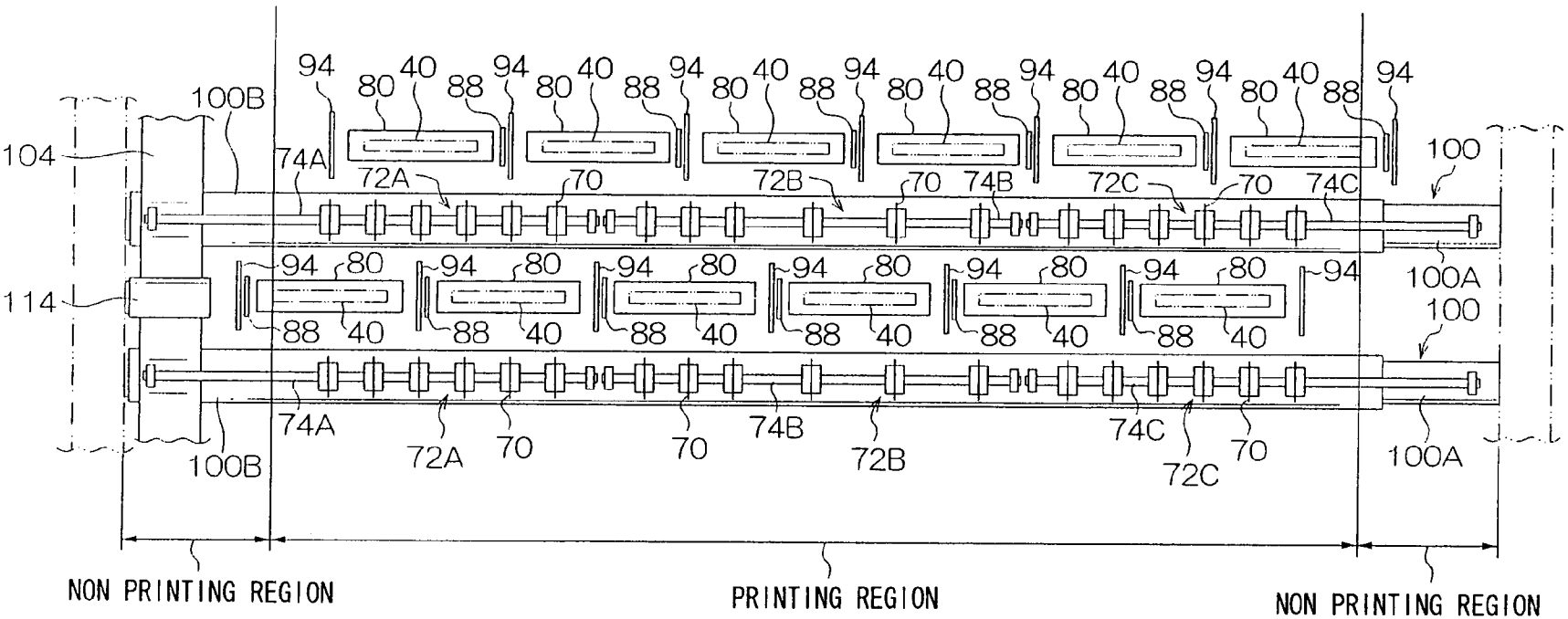
FIG. 25 is a plan view of main portions for explanation of a sheet conveying mechanism relating to Example 1 of the present invention.

Further, as shown in FIG. 25, the flat belt 104 is trained around the conveying roller 100 at the non printing region which is other than the printing region at the large diameter portion 100B which is abutted by the sheet which is being conveyed.

Here, the reason why a single motor 106 is provided is as follows: when there are a plurality of drive sources, it is difficult to make the driving speeds and the fluctuation characteristics of the respective motors strictly uniform, and as a result, the various speed fluctuation components are compounded in the sheet speed. Even if the fluctuations in the speeds of the respective motors are sufficiently small, the fluctuations in the speed of the sheet are problematic due to this compounding of the respective speed fluctuations. Namely, by driving the plural conveying rollers 100 by a single drive source (the motor 106), the conveying speed of the sheet is made uniform, and high image quality printing is achieved.

The flat belt 104 is driven and transmits driving force to the conveying rollers 100 without the meshing of teeth (i.e., by frictional force). Thus, in particular, periodic speed fluctuations of respective teeth, and the like, are eliminated, and the flat belt 104 is therefore suitable.

The flat belt 104 in the present Example has a thickness of 0.4 mm and is formed by thinly coating polyurethane on the surface (one surface) of a base material of woven polyester fibers. The flat belt 104 has both mechanical strength and good wear resistance.

By structuring the recording section 20 in this way, in the present Example, the interval between the nozzle surfaces and the sheet is designed to be 1.5 mm, and the sheet is conveyed therebetween in the horizontal direction. Further, the largest recording region (the maximum sheet width PW) which is the object of printing is the short side of an A3 sized sheet (the long side of an A4 sized sheet). The processing speed of the recording section 20 is 240 mm/s, the printing resolution is 800×800 dpi, and the recording speed is 60 sheets per minute (in the case of A4 LEF (long edge feed)).

Operation of the ink jet recording device 10 which is structured in this way will be described.

Hereinafter, the printing operation and the maintenance operations (dummy jetting, wiping, capping) will be described in that order.

First, the printing operation will be described.

When carrying out the printing operation, a sheet is supplied from the sheet supplying section 12. At the register adjusting section 14, the posture of the sheet and the timing are controlled, and the sheet is conveyed to the recording section 20.

On the other hand, in the recording section 20, the motor 106 is driven, and driving force is transmitted to all of the conveying rollers 100 via the flat belt 104.

Accordingly, the sheet which has reached the recording section 20 is inserted between the conveying roller 100, which is at the most upstream side in the conveying direction, and the star wheel groups 72A through 72C. At this time, the star wheels 70 of the star wheel groups 72A through 72C, which are urged by the springs 75, push the sheet against the conveying roller 100. Therefore, conveying force is reliably transmitted from the conveying roller 100 to the sheet, and the sheet is inserted beneath the unit recording heads 40 at a constant speed. Thereafter, driving force is transmitted to the sheet successively from the conveying rollers 100 disposed between the recording head arrays 42, and the sheet is conveyed.

At this time, because all of the conveying rollers 100 are driven by the single motor 106, fluctuations in the speeds of plural drive sources being compounded and affecting fluctuations in the sheet conveying speed, as in the case in which driving is carried out by plural drive sources, are avoided, and the sheet is conveyed at a more constant speed. Moreover, periodic speed fluctuations, which are a cause of image defects which are easily visually perceived in the image, often arise due to the accuracy of the machining of teeth or the like. However, because the driving force is transmitted via the flat belt 104 (and not by the meshing of teeth), the occurrence of such image defects is prevented. In addition, the flat belt 104 is trained around the non printing region of the large diameter portion 100B of the conveying roller 100 which the sheet abuts. Therefore, even if there is run-out caused by the machining accuracy of or the way of holding (bearings or the like) of the conveying roller 100, periodic fluctuations in speed do not arise, and the sheet is conveyed at the moving speed of the flat belt 104 (which is a constant speed). In a structure in which idler rollers 114 are provided in order to work the angles at which the flat belt 104 is trained around the conveying rollers 100, strictly speaking, period fluctuations in speed do arise due to the machining accuracy of or the way of holding of the idler rollers 114. However, because the idler rollers 114 are relatively small and may be formed of a single material, inexpensive and highly accurate machining thereof is easy. On the other hand, the conveying rollers 100 are large sized, and also are structured of plural materials, e.g., a metal core and a covering material. Therefore, highly accurate machining of the conveying rollers 100 is difficult. Or, the conveying rollers 100 become extremely expensive parts. The method of driving by surface friction by the flat belt 104 has the effect that, even if there is some dispersion in the radii or the rotational centers of the conveying rollers 100, periodic fluctuations caused thereby do not arise.

Moreover, the star wheel groups 72A through 72C are divided into three groups in the widthwise direction, and the lengths of the shafts 74A through 74C thereof are made to be short. Therefore, flexure of the shafts 74A through 74C can be avoided, and the plurality of star wheels 70, which are urged by the springs 75, can push the sheet uniformly. Accordingly, driving force can be transmitted uniformly to the sheet.

In particular, because the sheet is pushed against the conveying rollers 100 by the star wheels 70, the driving force is reliably transmitted to the sheet, and the sheet can be conveyed at a uniform speed. In particular, because an electrostatic attraction method is not employed, the sheet can be conveyed stably regardless of the thickness, the material or the like of the sheet.

Further, the star wheels 70 are disposed between the unit recording heads 40 in the widthwise direction, and the guiding members 94 are disposed at positions opposing the star wheels 70. Therefore, even at the printing positions (the positions of the recording head arrays 42) in the conveying direction, floating-up of the sheet and the like is prevented, and the planarity of the sheet can be ensured (the sheet can be kept at a uniform distance from the nozzle surfaces 40A).

Conversely speaking, by disposing the star wheels 70 in this way, the planarity of the sheet can be ensured (the sheet can be kept at a uniform distance from the nozzle surfaces 40A) even if the maintenance devices 81 such as the capping members 80 and the like are disposed at positions opposing the unit recording heads 40.

On the other hand, when a print signal from a control section of the device for the recording head section 16 is inputted to the respective unit recording heads 40, the heat-generating elements of the corresponding nozzles generate heat in accordance with the print signal. Ink drops are discharged from the corresponding nozzles onto the sheet which is being conveyed while being held at a fixed distance from the nozzle surfaces 40A.

Accordingly, due to printing being carried out at the recording head array 42A and then printing being carried out at the recording head array 42B, printing of one color onto that portion of the sheet is completed. Accordingly, as the sheet is conveyed in the recording section 20, printing is carried out at the recording heads 44Y, 44M, 44C, 44K in that order, such that full color printing is carried out.

In this way, a high-quality image can be formed by carrying out printing on the sheet which is conveyed at a constant speed and whose planarity is ensured (i.e., which is kept at a fixed distance with respect to the nozzle surfaces). In particular, the planarity of the sheet is always ensured by the star wheels 70 while the sheet is being conveyed in the recording section 20. Therefore, with respect to sheets of various thicknesses, deformation of the sheet which arises during printing can be corrected well, the distance of the sheet with respect to the nozzle surfaces 40A is maintained constant, and high image quality printing can be achieved.

In particular, in the recording section 20, the conveying rollers 100 are disposed between the recording head arrays 42, and are disposed at the upstream side of the upstream-most recording head array 42YA and at the downstream side of the downstream-most recording head array 42KB. Moreover, the plurality of conveying rollers 100 are driven by a single drive source. Therefore, the sheet is reliably conveyed at a constant speed, and high image quality printing can be achieved.

Next, the dummy jetting operation will be described.

Dummy jetting is carried out at times when printing is not carried out, or each time printing of a predetermined number of sheets during continuous printing of plural sheets has been completed, and before the leading end of the subsequent sheet arrives. Namely, among all of the unit recording heads 40 structuring the recording heads 44Y through 44K, the discharging of ink drops from arbitrary nozzles toward the capping members 80 (i.e., dummy jetting) is carried out. Dummy jetting may be carried out at all of the nozzles of all of the unit recording heads 40, or at all of the nozzles 58 of selected unit recording heads 40 or recording head arrays 42, or only at nozzles 58 at which discharging of ink drops has not been carried out for a predetermined period of time.

For example, the distance between the nozzle surface 40A and the top surface of the capping member 80 at the time when dummy jetting is carried out at the time of continuous printing of plural sheets, is set to be 3 mm. 500 drops are discharged from all of the nozzles at a time after the preceding sheet has passed by and before the following sheet has arrived, each time 30 sheets (of A4 size) are printed.

At this time, because the ink absorbing members 86 are disposed at the floor surfaces of the concave portions 82A of the capping members 80, the discharged ink does not overflow from or fly out from the concave portions 82A.

For example, by carrying out discharging of ink drops (dummy jetting) from all of the nozzles of the unit recording heads 40, the discharging performance which has changed due to the drying of the ink (water-based inks and solvent inks in particular) is returned to its initial state. Further, even in the cases of oil-based inks and solid inks which hardly dry at all, air bubbles which have adhered to the ink flow paths or the like within the heads due to printing can be removed, or dirt adhering to the nozzle surfaces can be removed, and the ink discharging performance of the nozzles can be returned to its initial state.

As in the present Example, dummy jetting can be carried out during the printing of plural sheets which are printed (conveyed) continuously, without moving the recording heads 44 and the capping members 80. Therefore, an improvement in the printing speed (the produceability) is achieved. Moreover, owing to the dummy jetting, the printing performances of the recording heads 44 are maintained constant, and high image quality printing is possible.

Next, the wiping operation will be described.

The wiping operation is carried out before printing starts or the like. Wiping of the recording heads 40 (the nozzle surfaces 40A) is carried out by the wiping members 88 of the maintenance section 18. The specific operations will be described on the basis of the schematic diagrams of FIGS. 23A–23G.

First, the driving motor 304 of the raising/lowering mechanism 302 shown in FIG. 22 is driven, and the common substrate 300 is lowered due to the rotation of the eccentric cam 306. Further, the driving motor 318 of the moving mechanism 312 is driven, and the slider 314 and the common substrate 310, which is supported at the slider 314, are raised. Namely, the six capping members 80 attached to the common substrate 300 are lowered from their home positions (move in the direction of moving away from the recording heads 40), and the six wiping members 88 attached to the common substrate 310 are raised from their home positions (move toward the nozzle surfaces 40A of the recording heads 40) (see FIGS. 23A→23B).

In the present Example, the capping members 80 are lowered to positions which are 6 mm from the nozzle surfaces 40A of the unit recording heads 40, and the distal ends (top ends) of the wipers 92 of the wiping members 88 are raised to positions which are 1.5 mm higher than the nozzle surfaces 40A (hereinafter called abutment amount 1.5 mm).

As a result, the holding members 90 of the wiping members 88 can move in the widthwise direction while straddling the capping members 80. Further, the wipers 92 of the wiping members 88 are in a state of overlapping the nozzle surfaces 40A of the recording heads 40 in the vertical direction (the direction of arrow Z in FIGS. 23A–23G) (see FIG. 23B).

In this state, due to the driving motor 316 of the moving mechanism 312 shown in FIG. 22 being driven, the common substrate 310 moves in the widthwise direction on the slider 314 via the rack 322 which is meshed with the driving gear 326. Accordingly, the wiping members 88 which are attached to the common substrate 310 move in the widthwise direction. The wipers 92 of the wiping members 88, whose distal ends are at positions higher than the nozzle surfaces 40A, move while slidingly-contacting the nozzle surfaces 40A of the unit recording heads 40. As a result, the dust, dried ink, and the like which have adhered to the nozzle surfaces 40A are removed (see FIG. 23C). At this time, the wiping members 88 move while straddling the capping members 80 which have been lowered.

In the present Example, the wipers 92 slidingly-contact the nozzle surfaces 40A while an abutment amount of 1.5 mm is maintained. Therefore, dirt adhering to the nozzle surfaces 40A is reliably removed.

Figures 23A, 23B, 23C, 23D, 23E, 23F, 23G:
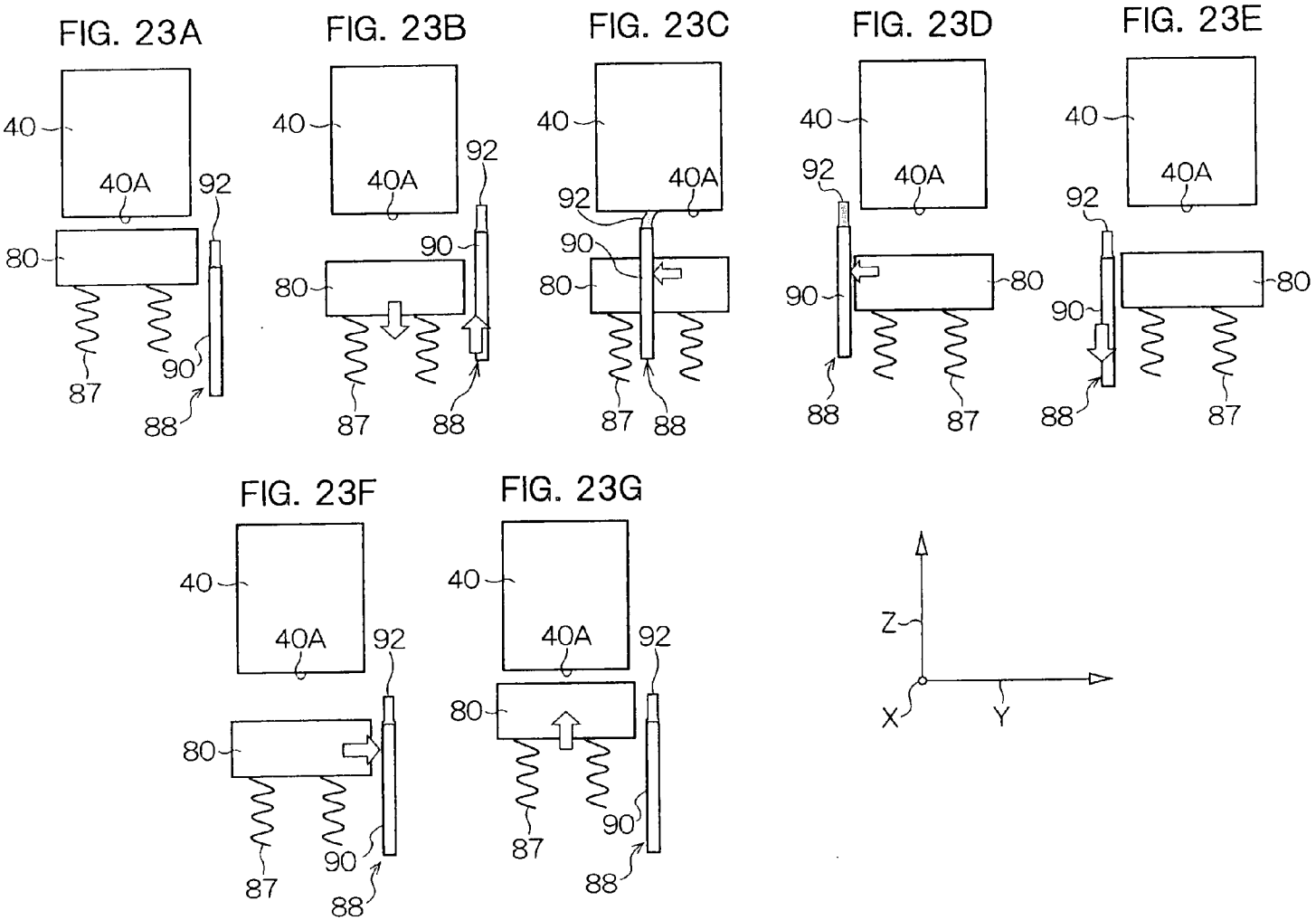
FIGS. 23A through 23G are diagrams for explanation of a wiping operation in the recording device relating to Example 1 of the present invention.

The wiping members 88 come out from beneath the nozzle surfaces 40A, and movement of the wiping members 88 and the guiding members 94 in the widthwise direction is completed (see FIG. 23D). Next, the common substrate 310, i.e., the wiping members 88, are lowered due to the driving of the driving motor 318 of the moving mechanism 312, and are moved to the height of their home positions (see FIG. 23E).

Next, the common substrate 310, i.e., the wiping members 88, are moved together toward the opposite side in the widthwise direction by the driving of the driving motor 318 of the moving mechanism 312 shown in FIG. 20, and are returned to their home positions (see FIG. 23F). Moreover, the driving motor 304 of the raising/lowering mechanism 302 is driven such that the capping members 80 are raised and returned to their home positions near the nozzle surfaces 40A of the recording heads 40. The wiping operation is thereby completed (see FIG. 23G).

Next, the capping operation will be described.

The capping operation is carried out when the non printing state has continued for a long period of time, or when the power source is off, or the like. Specifically, due to the driving of the driving motor 304 of the raising/lowering mechanism 302 shown in FIG. 22, the common substrate 300 is raised, and the rubber portions 84 of the capping members 80 attached to the common substrate 300 press-contact the nozzle surfaces 40 of the recording heads 40 (see FIG. 26A→FIG. 26B). As a result, the airtightness of the nozzle surfaces 40 (the nozzles 58) is ensured. Thickening and drying of the ink are prevented, and the adhesion of dirt is prevented.

As shown in FIG. 16, the recording head 44 of the present Example is structured by the recording head arrays 42A, 42B, at which a plurality of the short unit recording heads 40 are lined up, being attached to the common substrates 46A, 46B, respectively. Therefore, inexpensive devices (recording heads) which are mass produced can be used in the present invention as well, and the recording head 40 which is low cost and can print over the entire width can be structured.

Moreover, by attaching the recording head arrays 42A, 42B to the common substrates 46A, 46B respectively, the structures of the recording head arrays 42A, 42B are simplified, and manufacturing and highly precise adjustment also are easier. In addition, there is the merit that the structures of the maintenance section (the capping members 80 and the wiping members 88) can be used in common with structures used at the short recording heads. Still further, a device for making the distance between the nozzle surfaces 40A and the sheet constant (the star wheels 70 and the like in the present Example) can be disposed by utilizing the gaps (the spaces) between the unit recording heads in the widthwise direction. Or, there is the advantage that the degrees of freedom in design in the arranging of the capping members 80 and the like can be increased.

In the present Example, the capping members 80 are provided so as to correspond to the unit recording heads 40. However, a single capping member 80 may be made to correspond to a plurality of the unit recording heads 40.

EXPERIMENTAL EXAMPLE

The following experiment for confirmation was carried out by using the recording device of the present Example, in order to confirm that sheets could be conveyed stably, regardless of the type of the sheet and the ambient environmental temperature and humidity. By using the following four types of recording sheets (sheets (1) through (4)), a total of 12 types of printing tests were carried out on the sheets under the following three environmental conditions (environments (1) through (3)).

Sheet (1): "ST paper" (a thin, light-weight paper for laser printer use, basis weight: 52.3 g/m$^2$, thickness: 79 μm)

Sheet (2): "J paper" (a standard paper for color laser printer use, basis weight: 82.0 g/m$^2$, thickness: 97 μm)

Sheet (3): "color copy paper" (a thick, heavy paper for color laser printer use, basis weight: 200.0 g/m$^2$, thickness: 220 μm)

Sheet (4): "OHP (overhead projector) film for ink jet printing" (an ink protecting layer is coated on the surface of a polyester base material, thickness: 100 μm)

All were products of Fuji Xerox Office Supply KK.

Environment (1): a low temperature, low humidity environment of 10° C. and 15% RH Environment (2): an ordinary temperature, ordinary humidity environment of 22° C. and 55% RH Environment (3): a high temperature, high humidity environment of 28° C. and 85% RH As the result of carrying out the printing test continuously on 1000 sheets under each of the aforementioned 12 types of conditions, it was found that the sheets could be stably conveyed without paper jamming or paper skewing arising. Further, the printed image quality of the initial stages was maintained until the end. Namely, it was confirmed that the sheets could be conveyed stably and printing at a high image quality was possible, regardless of differences in the stiffnesses of the sheets, differences in the electrical characteristics thereof, changes in the properties due to the adhesion of water-based ink, and changes in the environmental conditions caused by external changes, which were difficult to handle in the electrostatic attraction method.

THIRD EMBODIMENT

Figure 28:
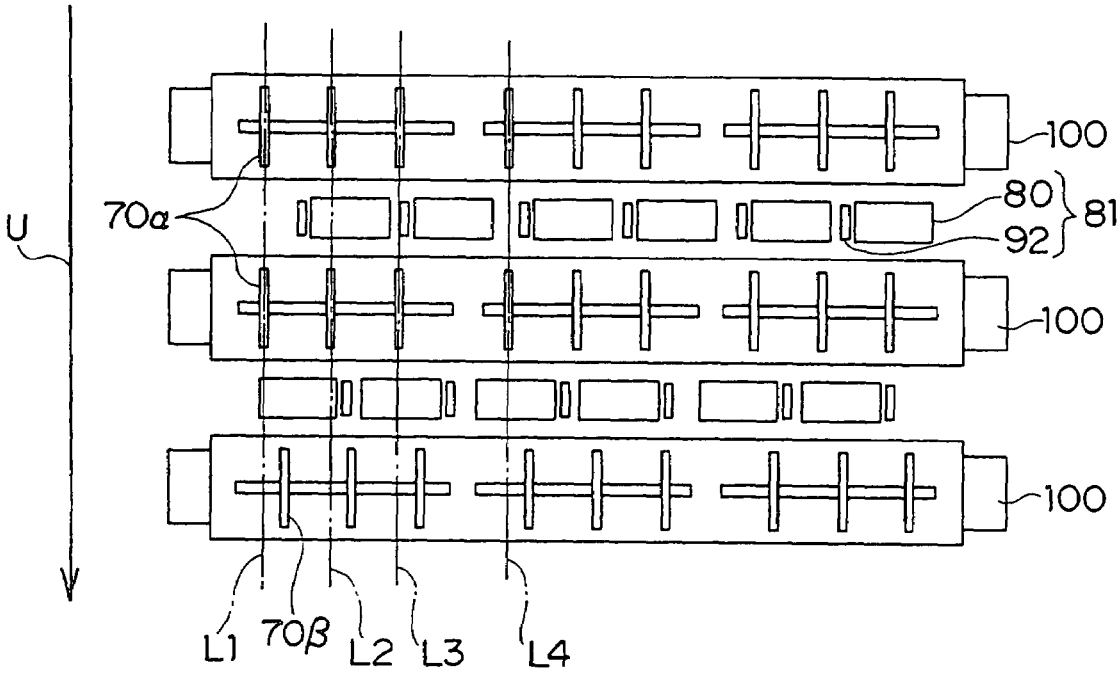
FIG. 28 is a plan view of main portions for explanation of a sheet conveying mechanism of a recording device relating to a third embodiment of the present invention.

Next, a third embodiment will be described. As shown in FIG. 28, in the ink jet recording device relating to the third embodiment, the plurality of conveying rollers 100, which are provided along the widthwise direction of the recording sheet which is orthogonal to the conveying direction U of the recording sheet, are successively lined up in the conveying direction U. It suffices for the conveying rollers 100 to be able to transmit driving force to the recording sheet. The conveying rollers 100 preferably have a high coefficient of friction and are difficult to wear down. For example, rubber rollers in which a rubber material is covered on a metal core, or rollers formed by coating a ceramic powder on a metal core, or the like are preferable.

The maintenance devices 81, which carry out maintenance of the recording heads, are lined up in a row in the same direction as the conveying rollers 100, between adjacent conveying rollers 100. The above-described capping member, cleaning member and the like are provided at each of the maintenance devices 81.

A plurality of the shafts 74 (e.g., three of the shafts 74 as shown in FIG. 28) are provided above each of the conveying rollers 100. A plurality of the star wheels (spurs) 70 (e.g., three as shown in FIG. 28) are attached to each of the shafts 74. Structures, which are used for various purposes, may be utilized for the star wheels 70.

At least one of the positions at which the star wheels 70 are mounted, as seen from the conveying direction U, is offset from the position on the straight line along the conveying direction. For example, at line L1 at the left end as seen from the conveying direction U, the position at which at least one star wheel 70β is disposed is offset from the positions at which other star wheels 70α are disposed, such that the positions at which the star wheels 70 are disposed are not on a single straight line. The same holds for the adjacent line L2 as well. At all of the lines seen from the conveying direction U, such as the lines L3, L4 and the like, the position at which at least one of the star wheels is disposed is offset from the positions at which the other star wheels are disposed.

In this way, when the recording sheet is conveyed, traces of the star wheels formed on the recording sheet by the star wheels 70 can be made to be inconspicuous.

EXAMPLE 2

Example of the Third Embodiment

Figure 29:
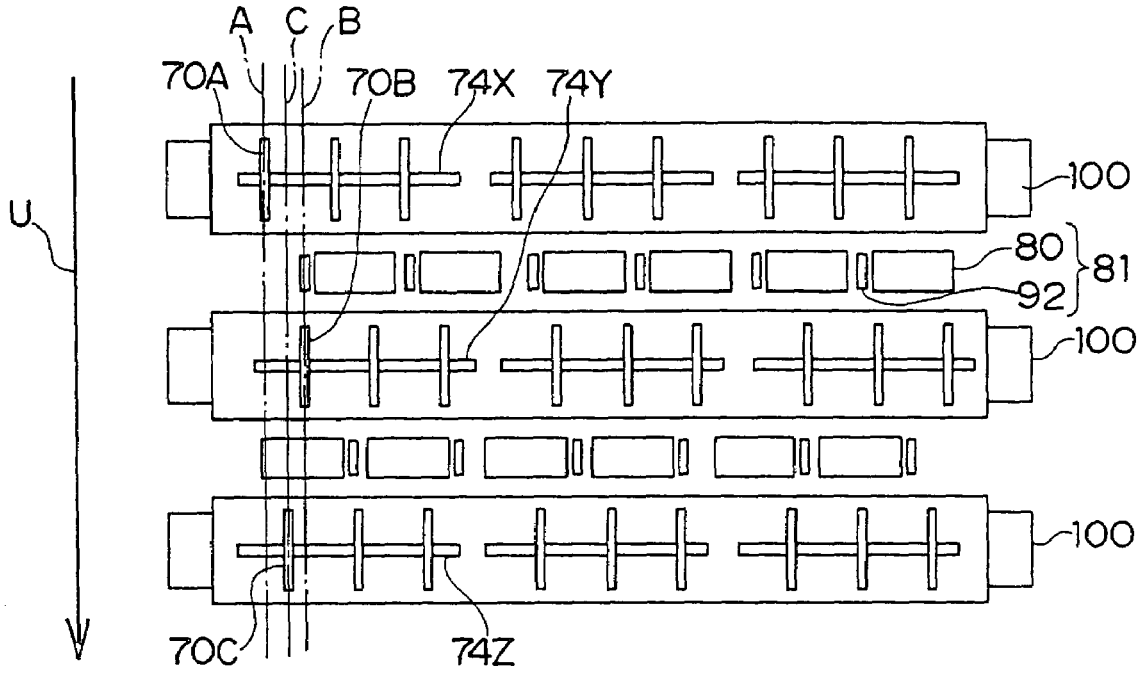
FIG. 29 is a plan view of main portions for explanation of a sheet conveying mechanism of a recording device relating to Example 2 of the present invention.

As shown in FIG. 29, in the present Example, the positions at which the star wheels 70 are attached as seen from the conveying direction U are efficiently offset. For example, star wheels 70A, 70B are disposed such that a conveying direction line A of the star wheel 70A which is attached to a shaft 74X, and a conveying direction line B of the star wheel 70B which is attached to a shaft 74Y which is adjacent to the shaft 74X in the conveying direction, do not overlap. Moreover, a star wheel 70C is disposed such that the conveying direction line B and a conveying direction line C of the star wheel 70C, which is attached to a shaft 74Z which is adjacent to the shaft 74Y in the conveying direction, do not overlap.

In this way, the positions of attachment of the star wheels 70 which are adjacent in the conveying direction U are different from one another as seen from the conveying direction U. In this way, it can be understood very clearly that the star wheels are offset from one another, and vertical stripes (stripes along the conveying direction U) which are formed on the recording sheet by the star wheels 70 can be made to be extremely inconspicuous.

Note that the intervals between the star wheels attached to the respective shafts may be made to be the same. (For example, the interval between adjacent star wheels attached to the shaft 74X may be the same as the interval between adjacent star wheels attached to the shaft 74Y.) In this way, structures in which the star wheels 70 are attached in advance to the shafts 74 can be mass produced, and when they are mounted above the conveying rollers, it suffices to dispose them such that the positions of star wheels adjacent in the conveying direction U are offset. Therefore, the time required for manufacturing the recording device can be greatly reduced.

FOURTH EMBODIMENT

Figure 30:
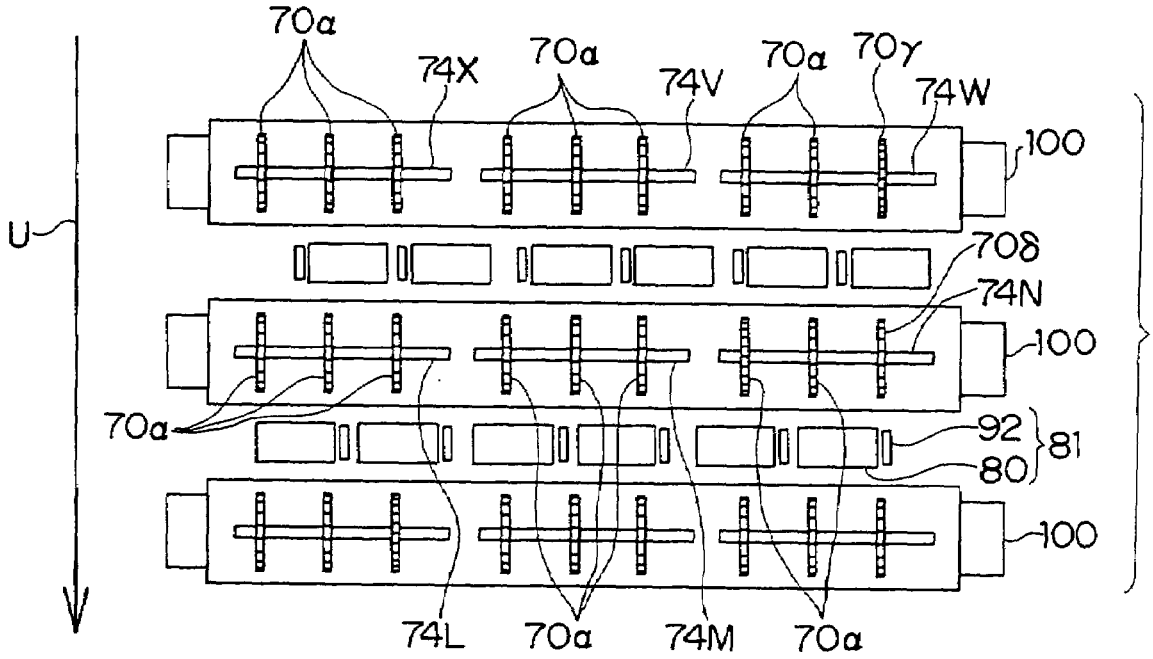
FIG. 30 is a plan view of main portions for explanation of a sheet conveying mechanism of a recording device relating to a fourth embodiment of the present invention.

As shown in FIG. 30, in the ink jet recording device of the present embodiment, the configuration of at least one star wheel 70 is different than the others, in the direction orthogonal to the conveying direction U (in the widthwise direction of the recording sheet which is being conveyed).

For example, as shown in FIG. 30, among the star wheels which are attached to three shafts 74X, 74V, 74W, a star wheel 70γ attached to the shaft 74W has a different configuration than the other star wheels (70α). Similarly, among the star wheels which are attached to three shafts 74L, 74M, 74N which are adjacent to the three shafts 74X, 74V, 74W in the conveying direction U, a star wheel 70δ attached to the shaft 74N has a different configuration than the other star wheels (70α). Note that the star wheel 70γ and the star wheel 70δ may have the same configuration.

In this way, it is possible to avoid the star wheels rotating synchronously during the conveying of the recording sheet, and effects can be seen with regard to reducing irregularities in the conveying speed which are generated locally at the recording sheet, and reducing waviness arising in the conveyed posture of the recording sheet.

EXAMPLE 3

Example of the Fourth Embodiment

Figure 31:
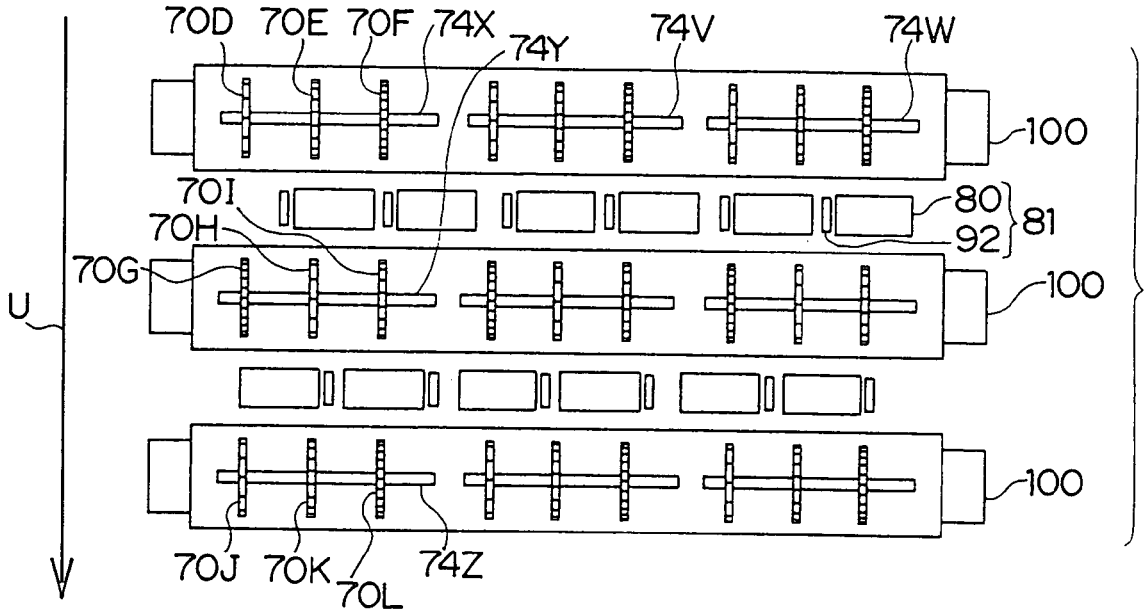
FIG. 31 is a plan view of main portions for explanation of a sheet conveying mechanism of a recording device relating to Example 3 of the present invention.

In the present Example, the configurations of the star wheels which are lined up in the widthwise direction of the recording sheet which is being conveyed are made to be different from one another. Specifically, the numbers of teeth of the star wheels attached to the same shaft are made to be non-integer multiples of one another. Hereinafter, description will be given with reference to FIG. 31.

In the present Example, the numbers of teeth of star wheels 70D, 70E, 70F which are successively attached to the shaft 74X are 20, 23, 25, respectively. The same holds for the numbers of teeth of the star wheels which are attached to the shafts 74V, 74W.

Further, the numbers of teeth of star wheels 70G, 70H, 70I which are attached to the shaft 74Y, which is adjacent to the shaft 74X in the conveying direction, are 27, 31, 21, respectively. The numbers of teeth of star wheels 70J, 70K, 70L which are attached to the shaft 74Z, which is adjacent to the shaft 74Y in the conveying direction, are 29, 20, 22, respectively.

In accordance with the present Example, the same effects as those described in the fourth embodiment can be achieved by, with a simple structure, making different the configurations of star wheels which are adjacent to one another in the widthwise direction of the recording sheet which is orthogonal to the conveying direction U. Further, because star wheels having configurations different from one another are attached to the same shaft, the effect which is obtained is great.

Note that, in the present Example, an example is given in which three types of star wheels whose numbers of teeth are non-integer multiples of one another are used as the star wheels which are lined up in the widthwise direction of the recording sheet. However, sufficient effects are recognized even if two types of star wheels, whose numbers of teeth are non-integer multiples of one another, are used. Moreover, even more marked effects are exhibited by four or more types of star wheels, whose numbers of teeth are non-integer multiples of one another, being lined up.

EXAMPLE 4

Example of Fourth Embodiment

Figure 32:
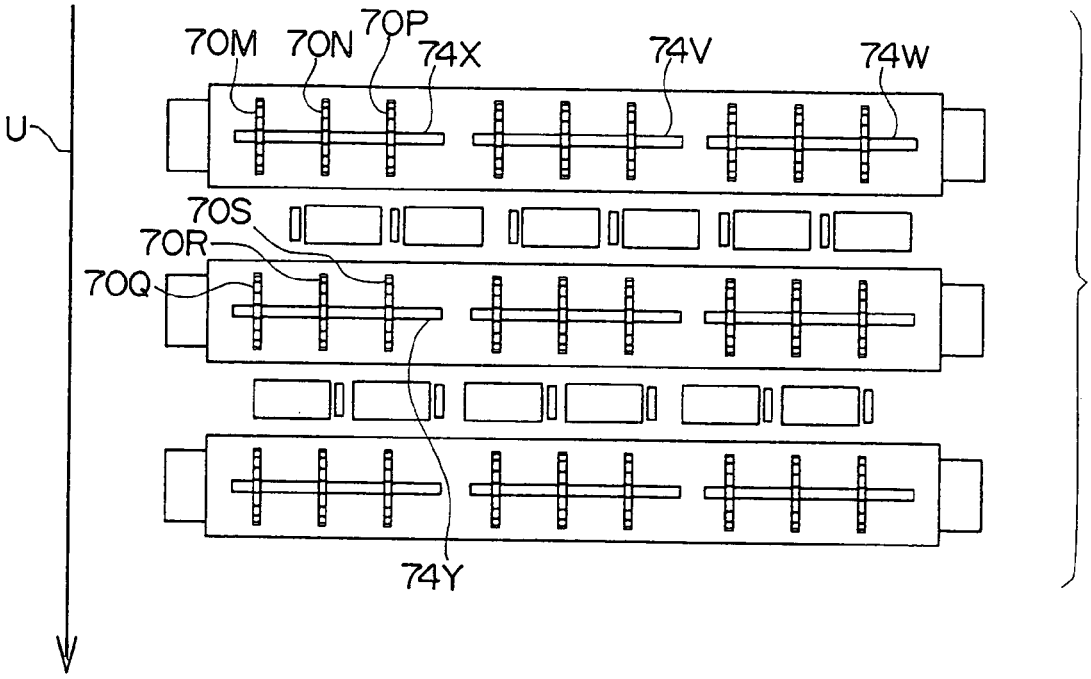
FIG. 32 is a plan view of main portions for explanation of a sheet conveying mechanism of a recording device relating to Example 4 of the present invention.

In the present Example, the configurations of the star wheels which are lined up in the widthwise direction of the recording sheet which is being conveyed are made to be different from one another. Specifically the configurations of the addenda of the star wheels attached to the same shaft are made to be different from one another. Hereinafter, description will be given with reference to FIG. 32.

In the present Example, the configurations of the addenda of star wheels 70M, 70N, 70P, which are successively attached to the shaft 74X, are such that the addenda of the star wheel 70M are formed to curve at obtuse angles, the addenda of the star wheel 70N are sharp at acute angles and the distal ends are subjected to taper processing, and the addenda of the star wheel 70P are the most sharp at acute angles. The same holds for the configurations of the addenda of the star wheels which are attached to the shafts 74V, 74W.

A structure which is the same as the star wheel 70M is used as star wheel 70Q attached to the shaft 74Y. A structure which is the same as the star wheel 70N is used as star wheel 70R attached to the shaft 74Y. A structure which is the same as the star wheel 70P is used as star wheel 70S attached to the shaft 74Y.

In accordance with the present Example, the same effects as those described in the fourth embodiment can be achieved by, with a simple structure, making different the configurations of star wheels which are adjacent to one another in the widthwise direction of the recording sheet which is orthogonal to the conveying direction U. Further, because star wheels having configurations different from one another are attached to the same shaft, the effect which is obtained is great.

Note that, in the present Example, an example is given in which three types of star wheels, at which the configurations of the addenda are different from one another, are used as the star wheels which are lined up in the widthwise direction of the recording sheet. However, sufficient effects are recognized even if two types of star wheels, at which the configurations of the addenda are different from one another, are used. Moreover, even more marked effects are exhibited by four or more types of star wheels, at which the configurations of the addenda are different from one another, being lined up.

FIFTH EMBODIMENT

In the ink jet recording device of the present embodiment, the central axes of rotation of at least the spurs 70 which contact the widthwise direction end portions of the recording sheet are tilted toward the central portion in the widthwise direction of the recording sheet.

In accordance with the present embodiment, when the recording sheet is conveyed while printing is carried out, the recording sheet can be conveyed while the both widthwise direction end portions thereof are pulled toward the widthwise direction outer sides by the star wheels 70. Therefore, the recording sheet can be conveyed well without any slack arising thereat. This results in the marked effect that, even if ink drops adhere to the recording sheet, it is possible to prevent wrinkles from forming in the recording sheet.

EXAMPLE 5

Example of Fifth Embodiment

Figure 33:
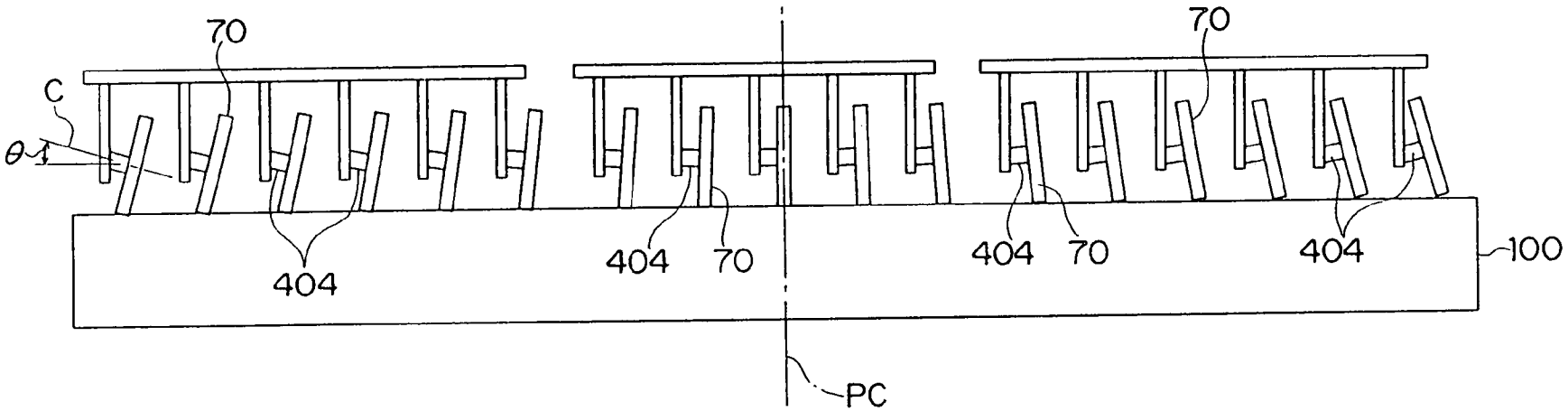
FIG. 33 is a front view of main portions, as seen from a conveying direction, for explanation of a sheet conveying mechanism of a recording device relating to Example 5 of the present invention.

As shown in FIG. 33, in the present Example, central axes of rotation C of the star wheels 70, which are lined up in the widthwise direction of the recording sheet which is being conveyed, are gradually inclined toward the widthwise direction central portion of the recording sheet, i.e., toward a widthwise direction central line PC, from the widthwise direction central portion of the recording sheet to the widthwise direction end portions thereof. An angle of inclination θ of the central axis of rotation C with respect to the axial direction of the conveying roller 100 is preferably a maximum of 45° or less such that the star wheel 70 can be sufficiently held and rotated.

In the present Example, in order to hold star wheels whose angles of inclination are respectively different, the star wheels 70 are attached to holding blocks 404 respectively, and the holding blocks 404 are attached to a common holding plate or the like via springs (not illustrated).

In accordance with the present Example, when the recording sheet is conveyed, the recording sheet can be conveyed while being pulled by the star wheels 70 toward the widthwise direction both end sides from the widthwise direction central line PC of the recording sheet. Therefore, the recording sheet can be conveyed well without slack arising thereat.

EXAMPLE 6

Example of Fifth Embodiment

Figure 34:
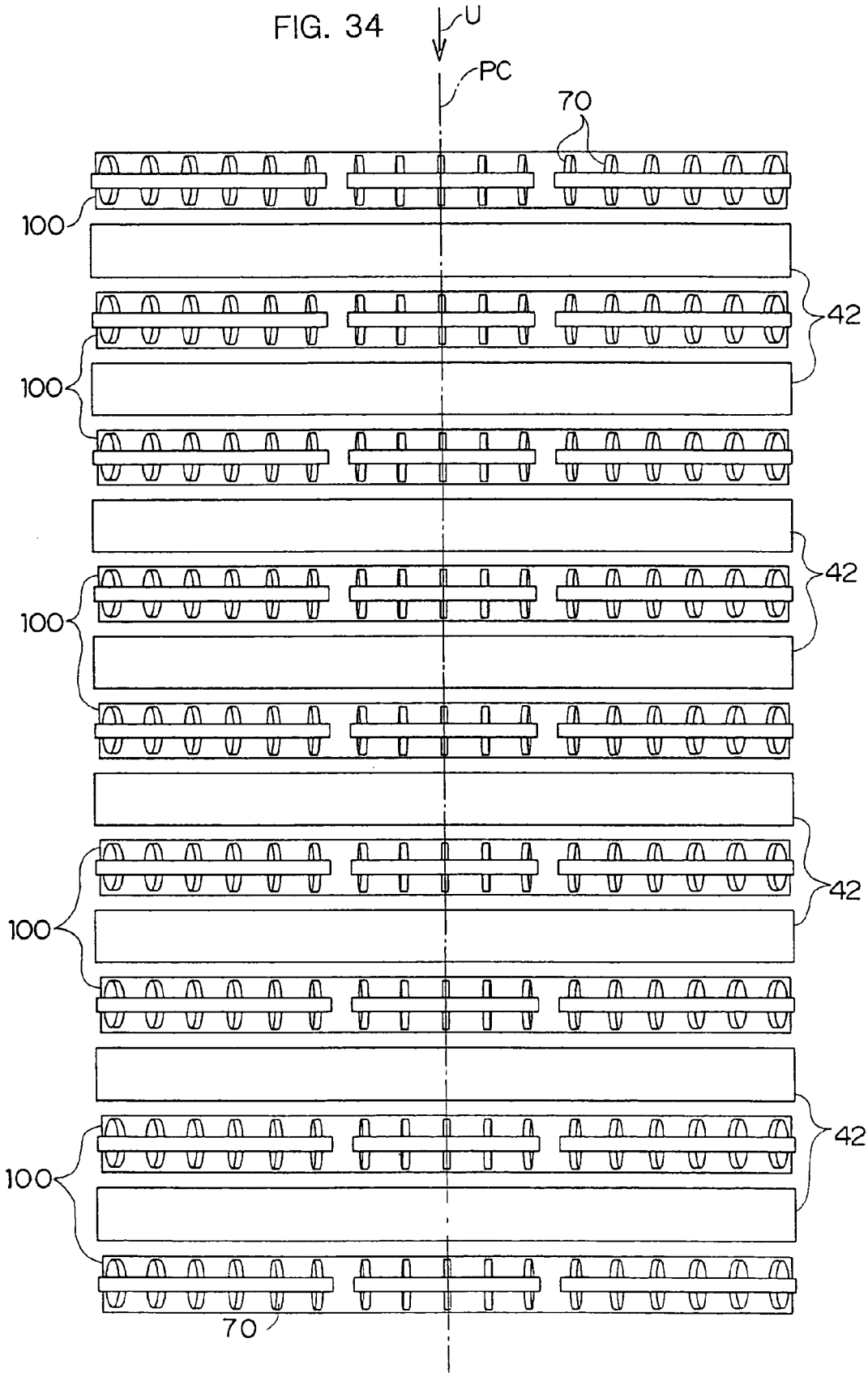
FIG. 34 is a plan view of main portions for explanation of a sheet conveying mechanism of a recording device relating to Example 6 of the present invention.

As shown in FIG. 34, the ink jet recording device of the present Example is for full-color printing. As seen in plan view, eight of the recording head arrays 42 are provided in parallel thereat. A total of nine of the conveying rollers 100 are provided in a row and parallel to the recording head arrays 42, between the respective recording head arrays and at the conveying direction outer sides of the recording head arrays which are positioned at the both ends in the conveying direction U.

The star wheels 70 are lined up along the longitudinal direction of each conveying roller 100. The central axes of rotation C of the star wheels 70, which are lined up in the widthwise direction of the recording sheet which is being conveyed, are inclined toward the widthwise direction central line PC such that the angles of inclination θ (see FIG. 33) increase 1° by 1°, from the widthwise direction central line PC of the recording sheet being conveyed to the widthwise direction end portions thereof.

The interval between the adjacent star wheels is usually about 15 mm, in consideration of the dimensions of the recording head arrays 42, the ability to convey the recording sheet well, and the like. Further, the force of pushing the recording sheet is usually set to be 10 gf per star wheel, so that traces of the star wheels formed on the recording sheet are not conspicuous and so that the recording sheet may be conveyed well.

In accordance with the present Example, with a simple structure, the effects described in the fifth embodiment can be achieved.

SIXTH EMBODIMENT

In the ink jet recording device of the present embodiment, the central axes of rotation of at least the star wheels 70 which contact the widthwise direction end portions of the recording sheet are inclined in directions in which the recording sheet widthwise direction central portion sides of the central axes of rotation push out toward the conveying direction side of the recording sheet.

In accordance with the present embodiment, in the same way as in the fifth embodiment, when the recording sheet is conveyed while printing is being carried out thereon, the recording sheet can be conveyed while the widthwise direction both end portions thereof are pulled by the star wheels 70 toward the widthwise direction outer sides. Therefore, the recording sheet can be conveyed well without slack arising thereat. In the same way as in the fifth embodiment, this results in a great effect with respect to the prevention of the formation of wrinkles in the recording sheet even if ink drops adhere to the recording sheet.

EXAMPLE 7

Example of Sixth Embodiment

Figure 35:
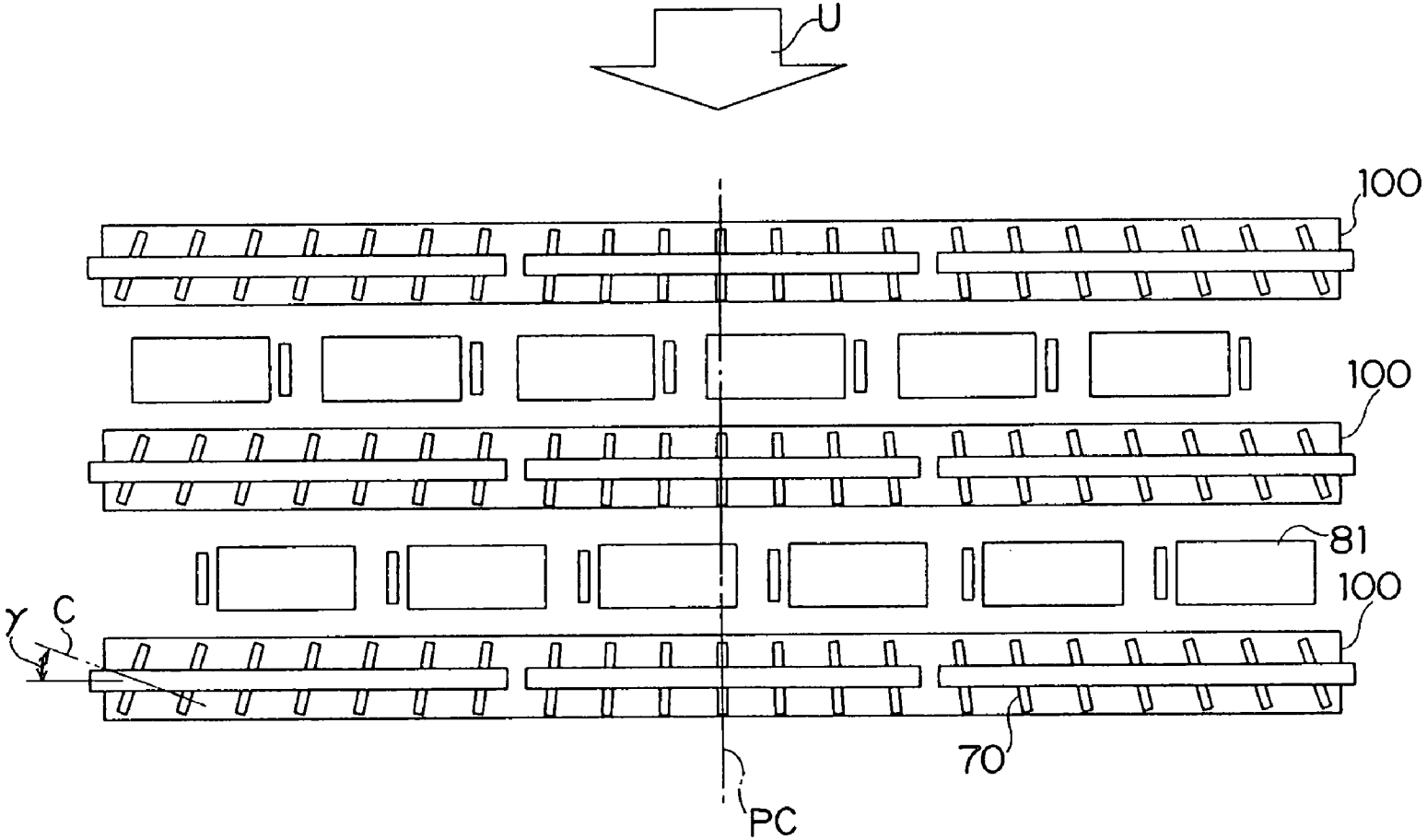
FIG. 35 is a plan view of main portions for explanation of a sheet conveying mechanism of a recording device relating to Example 7 of the present invention.

As shown in FIG. 35, in the ink jet recording device of the present Example, from the widthwise direction central portion of the recording sheet to the widthwise direction end portions thereof, the central axes of rotation C of the star wheels 70 are gradually inclined in directions in which the recording sheet widthwise direction central portion sides of the central axes of rotation C (i.e., the central line PC sides in the widthwise direction) push out toward the conveying direction side of the recording sheet. An angle of inclination γ of the central axis of rotation of the star wheel 70 with respect to the axial direction of the conveying roller 100 is preferably a maximum of 45° or less such that the star wheel 70 can be sufficiently held and rotated.

In accordance with the present Example, in the same way as in Example 6, when the recording sheet is conveyed, the recording sheet can be conveyed while being pulled by the star wheels 70 toward the widthwise direction both end sides from the widthwise direction central line PC of the recording sheet. Therefore, the recording sheet can be conveyed well without slack arising thereat.

EXAMPLE 8

Example of Sixth Embodiment

Figure 36:
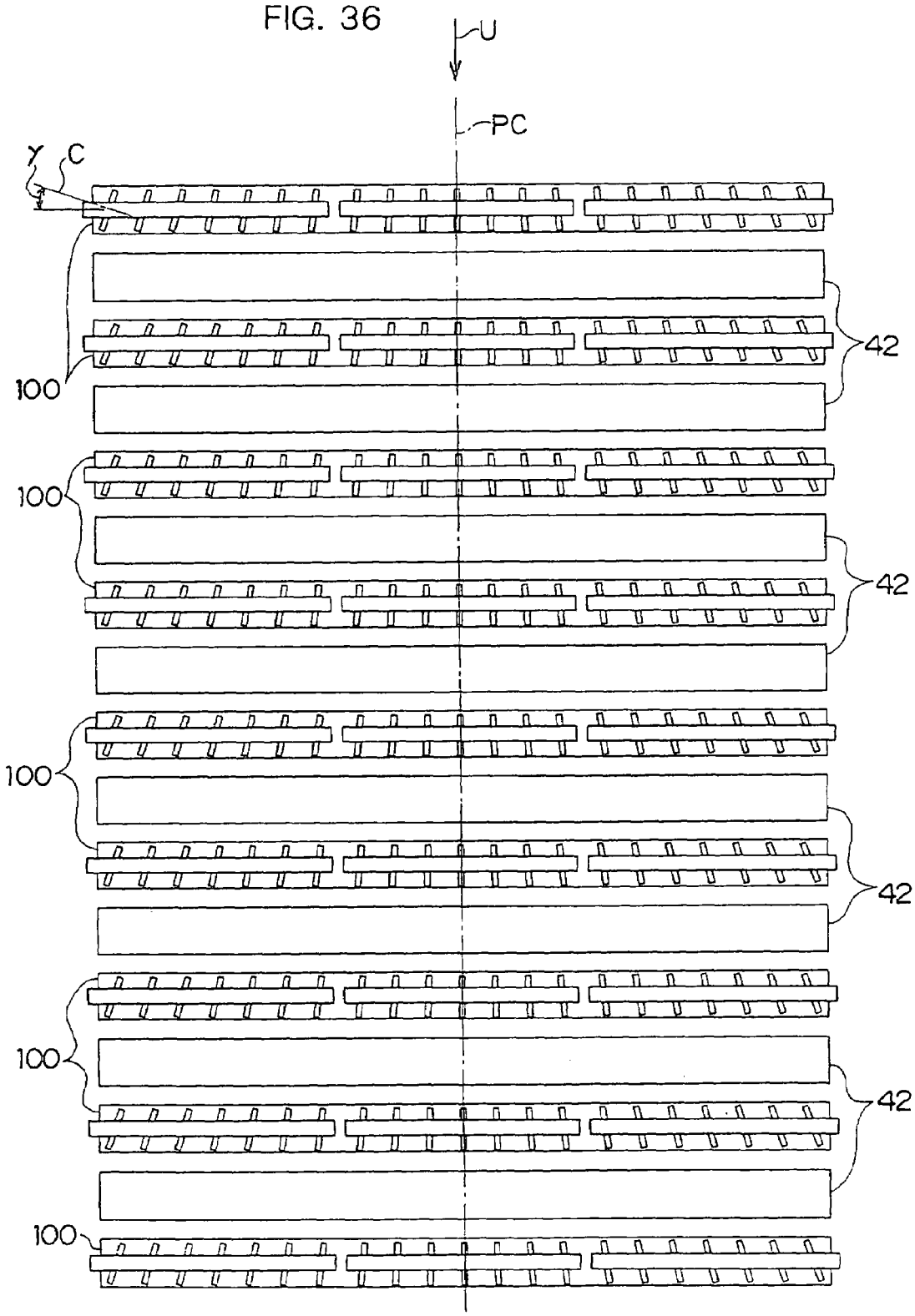
FIG. 36 is a plan view of main portions for explanation of a sheet conveying mechanism of a recording device relating to Example 8 of the present invention.

As shown in FIG. 36, the ink jet recording device of the present Example is for full-color printing. As seen in plan view, eight of the recording head arrays 42 are provided in parallel thereat. A total of nine of the conveying rollers 100 are provided in a row and parallel to the recording head arrays 42 between the respective recording head arrays and at the conveying direction outer sides of the recording head arrays which are positioned at the both ends in the conveying direction U.

The star wheels 70 are lined up along the longitudinal direction of each conveying roller 100. From the widthwise direction central portion of the recording sheet to the widthwise direction end portions thereof, the central axes of rotation C of the star wheels 70 are inclined in directions in which the recording sheet widthwise direction central line PC sides of the central axes of rotation C push out toward the conveying direction side of the recording sheet such that the angles of inclination γ increase 1° by 1°.

In the present Example, in order to hold star wheels whose angles of inclination are respectively different, in the same way as in Example 4, the star wheels are respectively attached to holding blocks having inclined surfaces, and the holding blocks are attached to a common holding plate via springs (not illustrated).

In accordance with the present Example, with a simple structure, the effects described in the sixth embodiment can be achieved.

SEVENTH EMBODIMENT

Figure 37:
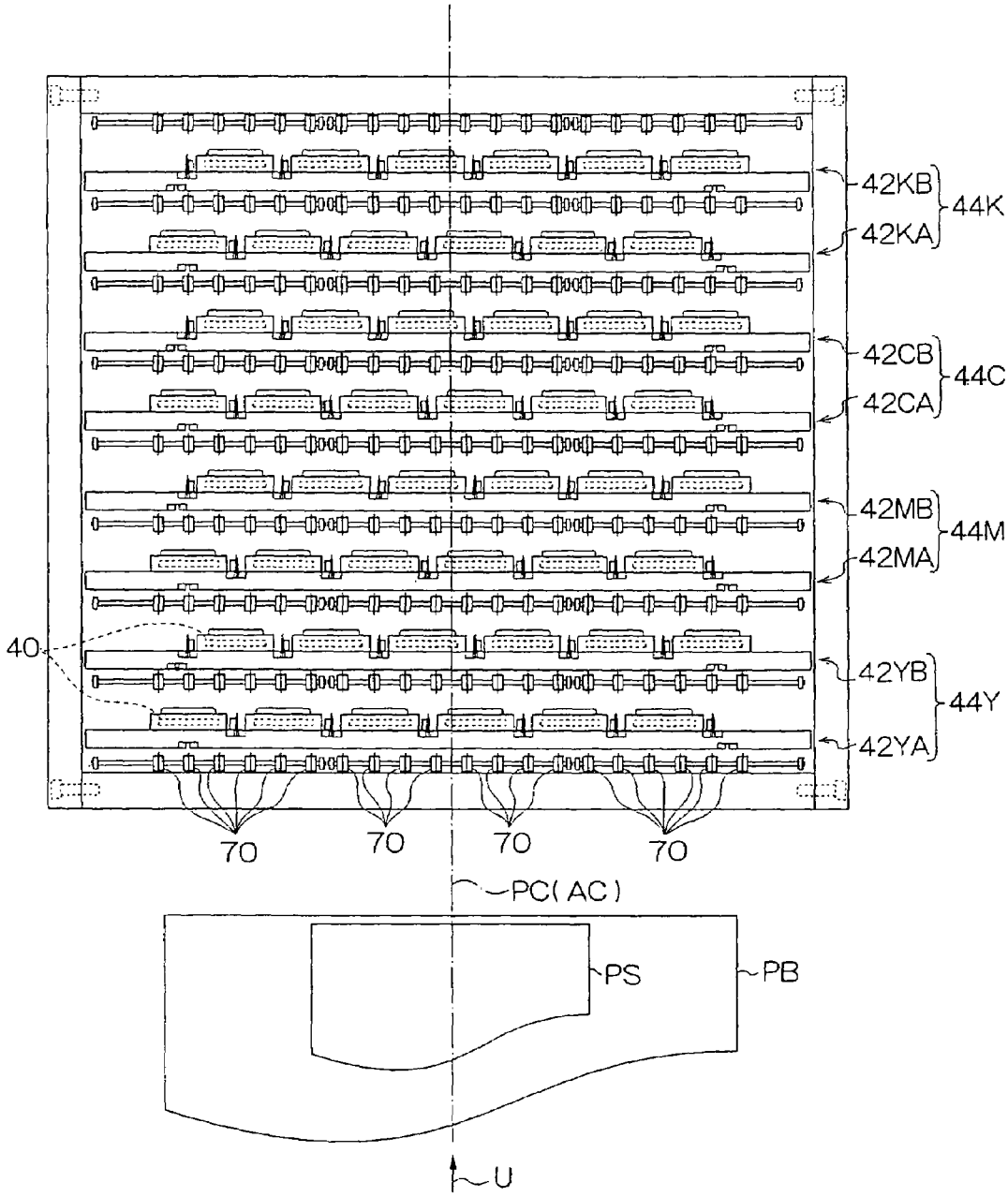
FIG. 37 is a plan view of main portions for explanation of a sheet conveying mechanism of a recording device relating to a seventh embodiment of the present invention.

As shown in FIG. 37, the ink jet recording device of the present embodiment is structured such that the above-described conveying device 202 convey the recording sheet while making the widthwise direction central line PC of the recording sheet and a widthwise direction central line AC of the printing region coincide with one another, i.e., while carrying out so-called center registration.

Accordingly, even in the case of a large-sized recording sheet PB or in the case of a small-sized recording sheet PS, the recording sheet can be conveyed with its center aligned (i.e., while being centrally registered), regardless of the sheet size. Therefore, the pushing forces (the urging forces) in the recording sheet widthwise direction, which forces are applied from the star wheels 70 to the recording sheet, do not become unbalanced. Accordingly, it is possible to prevent the recording sheet from being conveyed at an angle such that the image is formed on a slant, and to prevent the occurrence of wrinkles in the sheet and paper jamming.

Note that it is preferable that the pushing forces in the recording sheet widthwise direction are symmetrical at the left and the right (in FIG. 35) with respect to the central line PC. In this way, even in the case in which the conveying roller 100 is a both-end supported beam structure, in which both end portions of the conveying roller 100 are held by bearings or the like, and a slight amount of flexure arises at the conveying roller 100 (the smaller the diameter of the conveying roller 100, the greater the flexure), this flexure is symmetrical at the left and the right of the central line PC. Therefore, there is no fear that the recording paper which is being conveyed will be conveyed in an inclined manner, nor that wrinkles will arise in the sheet.

EIGHTH EMBODIMENT

In the ink jet recording device of the present embodiment, an assistant conveying device is provided at the upstream side of the upstream-most recording head. The assistant conveying device is structured so as to convey the recording sheet by applying, to the recording sheet, a conveying force which is equivalent to that which the above-described conveying device 202 applies to the recording sheet.

At the time when printing starts, the majority of the recording sheet is conveyed to the printing region of the recording device while being conveyed by this assistant conveying device. Therefore, owing to the assistant conveying device, the conveying speed of the recording sheet at the time of the start of printing can be made to be the same speed as the speed at which the sheet is conveyed by the conveying device 202, and high image quality printing can be carried out.

Note that the structure of the assistant conveying device is not particularly limited, provided that the assistant conveying device is structured so as to convey the recording sheet by applying thereto a conveying force which is equivalent to that which the conveying device 202 applies to the recording sheet.

NINTH EMBODIMENT

In the ink jet recording device of the present embodiment, an assistant conveying device is provided at the downstream side of the downstream-most recording head. The assistant conveying device is structured so as to convey the recording sheet by applying, to the recording sheet, a conveying force which is equivalent to that which the conveying device 202 applies to the recording sheet.

At the time when printing ends, the majority of the recording sheet is conveyed out from the printing region of the recording device while being conveyed by this assistant conveying device. Therefore, owing to the assistant conveying device, the conveying speed of the recording sheet at the time of the completion of printing can be made to, be the same speed as the speed at which the sheet is conveyed by the conveying device 202, and high image quality printing can be carried out.

EXAMPLE 9

Example of the Eighth Embodiment and the Ninth Embodiment

Figure 38A:
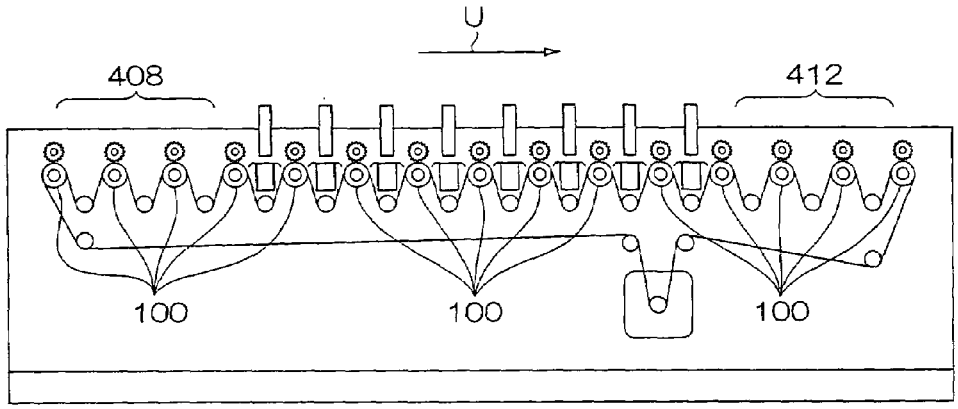
FIGS. 38A and 38B are respectively a side view and a plan view for explanation of the structure of a sheet conveying mechanism of a recording device relating to Example 9 of the present invention.
Figure 38B:
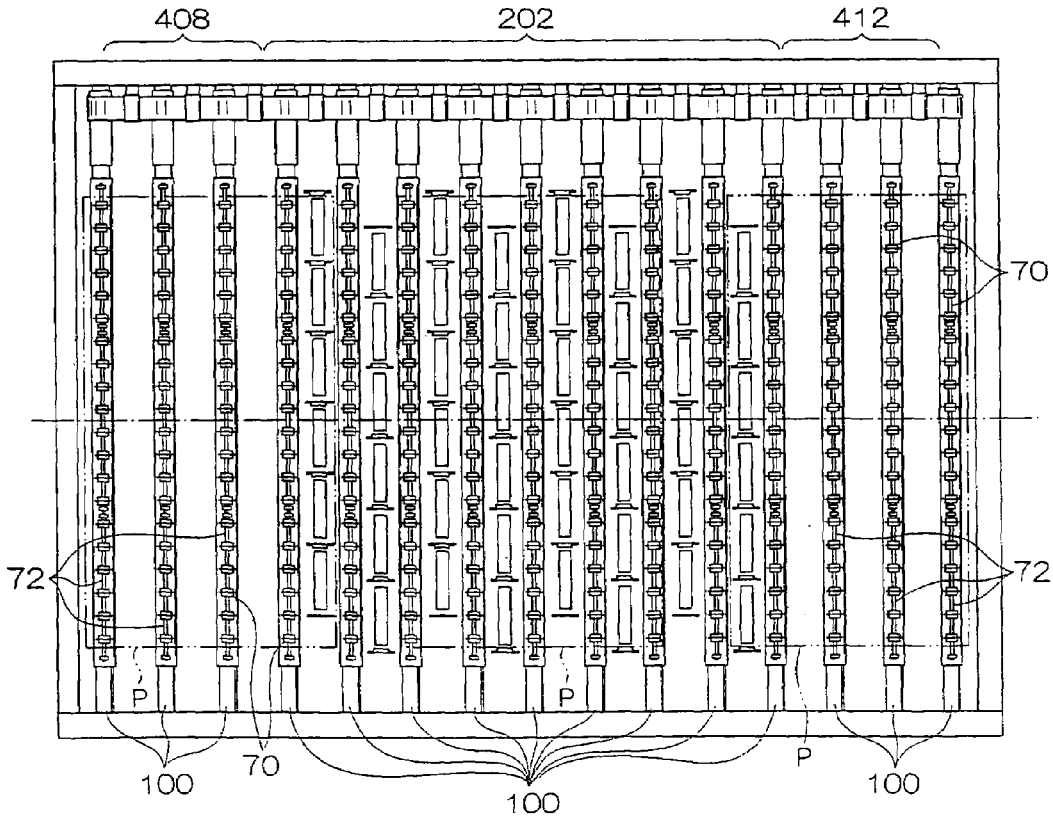

As shown in FIGS. 38A and 38B, the present Example is structured such that an upstream side assistant conveying section 408, which is provided at the upstream side of the upstream-most recording head, and a downstream side assistant conveying section 412, which is provided at the downstream side of the downstream-most recording head, are further provided at the ink jet recording device relating to the first embodiment or the second embodiment.

The upstream side assistant conveying section 408 has three of the conveying rollers 100 which are provided successively at an orientation orthogonal to the conveying direction U.

The interval between the adjacent conveying rollers 100 structuring the upstream side assistant conveying device 408 and structuring the conveying device 202 are the same. Further, the plurality of the star wheels 70 which are attached to the shafts 72 are provided in the same arrangement along the conveying rollers 100, above each of the conveying rollers 100 structuring the upstream side assistant conveying device 408 and the conveying device 202. The pushing force by which the star wheels 70 push the recording sheet toward the conveying rollers 100 are the same at each conveying roller. The positions at which the plural star wheels 70 are disposed are positioned so as to be symmetrical to the left and the right of the widthwise direction central line PC of the recording sheet. Further, the conveying distance of the upstream side assistant conveying section 408 is longer than the length of the longest recording sheet which can be subjected to printing processing. In accordance with this structure, the conveying force which the upstream side assistant conveying device 408 applies to the recording sheet P is the same as the conveying force which the conveying device 202 applies to the recording sheet P.

The structure of the downstream side assistant conveying section 412 is the same as that of the upstream side assistant conveying section 408. The conveying force which the downstream side assistant conveying device 412 applies to the recording sheet P is the same as the conveying force which the conveying device 202 applies to the recording sheet P.

In this way, in the present embodiment, the upstream side assistant conveying section 408 and the downstream side assistant conveying section 412 are provided. Accordingly, at the time when the recording sheet P reaches the printing start position, the recording sheet is nipped along the entire conveying direction length thereof by the upstream side assistant conveying section 408. Similarly, at the time when the recording sheet P reaches the printing end position, the recording sheet is nipped along the entire conveying direction length thereof by the downstream side assistant conveying section 412.

In this way, from the start of printing to the completion of printing, the conveying force applied to the recording sheet P can be maintained constant. Therefore, the moving speed of the recording sheet from the start of printing to the completion of printing can be maintained constant, and a high-quality image can be formed over the entire surface of the recording sheet.

When manufacturing the upstream side assistant conveying section 408 and the downstream side assistant conveying section 412, it suffices to provide conveying rollers and pushing device which are similar to those of the conveying device 202. Therefore, the structures of the upstream side assistant conveying section 408 and the downstream side assistant conveying section 412 can be simplified, and the time required to manufacture the upstream side assistant conveying section 408 and the downstream side assistant conveying section 412 can be greatly reduced.

With the recording device relating to the present invention, it is possible to realize high produceability and high image quality printing.

As noted in the above SUMMARY OF THE INVENTION section, other aspects of the present invention will be described hereinbelow.

In a recording device of a second aspect, the conveying device comprises: a conveying roller abutting a reverse surface of the recording medium which is opposite a recording surface of the recording medium, and applying driving force to the recording medium; and a pushing device for pushing the recording medium toward the conveying roller.

In this way, by pushing the recording medium toward the conveying roller by the pushing device, the driving force is reliably transmitted from the conveying roller to the recording medium and the recording medium can be conveyed stably, regardless of the thickness, the material or the like of the recording medium.

In a recording device of a third aspect, the conveying device is disposed at a position different than the recording head in a conveying direction of the recording medium.

In this way, it is easy to dispose a maintenance device or the like at the position opposing the recording head.

In a recording device of a fourth aspect, the pushing device comprises an urging member which contacts the recording medium and urges the recording medium toward the conveying roller.

In this way, with a simple structure, it is easy to make the pushing force of the pushing device be a proper amount of force.

In a recording device of a fifth aspect, the urging member comprises a spur which is elastically urged.

In this way, the surface area of contact over which the urging member contacts the recording medium can be made to be small. Therefore, effects on image quality can be markedly reduced.

In a recording device of a sixth aspect, a plurality of the spurs which are urged toward one conveying roller are rotatably supported at a plurality of shafts which are disposed in a widthwise direction which is orthogonal to the conveying direction of the recording medium.

In this way, it is easy to prevent the recording medium from floating up or deforming locally.

In a recording device of a seventh aspect, the conveying roller has a spur breakage avoiding portion, at a region corresponding to the spur.

In this way, the addenda of the star wheel which contacts the conveying roller can be prevented from breaking.

In a recording device of an eighth aspect, the spur breakage avoiding portion comprises a concave portion.

In this way, with a simple structure, the effects obtained by the seventh aspect can be reliably exhibited.

In a recording device of a ninth aspect, the spur breakage avoiding portion comprises an elastic body provided at least at a position of the conveying roller which position contacts the spur.

In this way, by forming at least the surface portion of the conveying roller of an elastic body such as a rubber member or the like, the spur breakage avoiding portion can be formed by the elastic body. Moreover, it is easy to provide the spur breakage avoiding portion.

In a recording device of a tenth aspect, the pushing device does not contact the recording medium.

In this way, the recording medium can be conveyed without the pushing device contacting the recording medium.

In a recording device of an eleventh aspect, the pushing device comprises a blowing device for blowing air toward the recording medium.

In this way, the pushing device can be structured by a simple structure.

In a recording device of a twelfth aspect, the recording head has a printing region of a width which is larger than or equal to at least a maximum recording region of the recording medium which is printed at the recording head.

In this way, it is possible to record along the entire width of the recording medium, without scanning the recording head. Further, even if the recording medium is conveyed so as to be tilted at a predetermined angle with respect to the conveying direction, or the like, recording over the entire width of the recording medium is possible.

In a recording device of a thirteenth aspect, the recording head is configured by a combination of a plurality of unit recording heads.

When short unit recording heads are manufactured, the yield is greater than in a case in which monolithic, elongated recording heads are manufactured. Therefore, recording heads which are inexpensive and which are mass produced can be realized.

In a recording device of a fourteenth aspect, the recording head is configured by a plurality of recording head arrays, each of which is structured by the plurality of unit recording heads being disposed in the widthwise direction, being disposed at different positions in the conveying direction.

In this way, the structure of each recording head array can be simplified, the positions of the unit recording heads can be adjusted with high accuracy, and a highly accurate recording head array can be manufactured easily.

In a recording device of a fifteenth aspect, a plurality of the recording heads are disposed along the conveying direction of the recording medium.

In this way, it is easy to realize uninterrupted recording within the recording region.

In a recording device of a sixteenth aspect, the plurality of recording heads discharge liquid drops of different colors.

In this way, multicolor printing is possible.

In a recording device of a seventeenth aspect, the conveying device is disposed at one of between the plurality of recording heads, and between the recording head arrays.

In this way, it is possible to prevent the portions of the recording medium between the recording head arrays from floating up and poor recording from being carried out.

In a recording device of an eighteenth aspect, in a case in which the plurality of recording heads or the recording head arrays are lined up along the conveying direction, the conveying device is provided at an upstream side of an upstream-most recording head or recording head array.

In this way, floating-up and deformation of the portion of the recording medium at the upstream side of the upstream-most recording head or recording head array can be suppressed. Therefore, it is possible to prevent poor recording due to the floating-up or deformation of this portion.

In a recording device of a nineteenth aspect, in a case in which the plurality of recording heads or the recording head arrays are lined up along the conveying direction, the conveying device is provided at a downstream side of a downstream-most recording head or recording head array.

In this way, floating-up and deformation of the portion of the recording medium at the downstream side of the downstream-most recording head or recording head array can be suppressed. Therefore, it is possible to prevent poor recording due to the floating-up or deformation of this portion.

In a recording device of a twentieth aspect, the conveying device is driven by a single drive source.

In this way, it is possible to avoid fluctuations in the conveying speed of the recording medium due to the compounding of speed fluctuations of plural drive sources, and the recording medium is conveyed at a more constant speed.

In a recording device of a twenty-first aspect, the conveying device has a plurality of the conveying rollers, and the plurality of the conveying rollers are driven from a single drive source via a common driving member.

In this way, it is possible to avoid fluctuations in the conveying speed of the recording medium due to driving force being transmitted via a plurality of driving members, and the recording medium is conveyed at a more constant speed.

Here, when a gear (the meshing of teeth) is used as the common driving member, there is the concern that defects in image quality, which can be perceived by humans, will arise in the printed image due to periodic speed fluctuations of the respective teeth.

Thus, in a recording device of a twenty-second aspect, the common driving member comprises a flat belt, and portions of the conveying rollers around which portions the flat belt is trained have a same diameter as portions of the conveying rollers which portions the recording medium contacts.

In this way, there is absolutely no fear that image defects will arise such as in the case when a gear is used.

In a recording device of a twenty-third aspect, a float-up preventing device, for preventing the recording medium from floating upward, is provided between recording medium widthwise direction end portions of the unit recording heads structuring the recording head.

In this way, it is possible to prevent the recording medium, which is being conveyed in the recording region, from floating up.

In a recording device of a twenty-fourth aspect, the float-up preventing device comprises a spur provided at the unit recording head, and a guiding member provided at a position opposing the spur and guiding the recording medium from a reverse surface side.

In this way, the structure of the floating-up preventing device can be simplified.

In a recording device of a twenty-fifth aspect, at least one of positions, at which the spurs are disposed as seen from the conveying direction of the recording medium, is offset from a position on a straight line along the conveying direction.

In this way, spur traces formed on the recording medium by the spurs at the time when the recording medium is conveyed can be made to be inconspicuous.

In a recording device of a twenty-sixth aspect, there are two or more types of configurations of the spurs attached to the shaft.

In this way, it is possible to avoid synchronous rotation of the spurs during the conveying of the recording medium. Irregularities in the conveying speed which arise locally at the recording medium, and waviness which arises in the conveyed posture of the recording medium, can be mitigated.

In a recording device of a twenty-seventh aspect, there are two or more types of numbers of teeth of the spurs which are non-integer multiples of one another.

In this way, the effects of the twenty-sixth aspect can be exhibited by a simple structure.

In a recording device of a twenty-eighth aspect, there are two or more types of configurations of addenda of the spurs.

In this way, in the same way as in the twenty-seventh aspect, the effects of the twenty-sixth aspect can be exhibited by a simple structure.

In a recording device of a twenty-ninth aspect, central axes of rotation of at least the spurs contacting widthwise direction end portions of the recording medium are inclined toward a widthwise direction central portion of the recording medium.

In this way, when the recording medium is conveyed while recording onto the recording medium is carried out, the recording medium can be conveyed while the widthwise direction both end portions thereof are pulled by the spurs toward the widthwise direction outer sides. Accordingly, slack does not arise at the recording medium, and the recording medium is conveyed well.

In a recording device of a thirtieth aspect, central axes of rotation of at least the spurs contacting widthwise direction end portions of the recording medium are inclined in directions in which recording medium widthwise direction central portion sides of the central axes of rotation push out toward a conveying direction side of the recording medium.

In this way, in the same way as in the invention of the twenty-ninth aspect, when the recording medium is conveyed while recording onto the recording medium is carried out, the recording medium can be conveyed while the widthwise direction both end portions thereof are pulled by the spurs toward the widthwise direction outer sides. Accordingly, slack does not arise at the recording medium, and the recording medium is conveyed well.

In a recording device of a thirty-first aspect, the conveying device conveys the recording medium while making a widthwise direction central line of the recording medium coincide with a widthwise direction central line of a printing region.

In this way, the recording medium can be conveyed while centrally aligned (centrally registered), regardless of the size of the recording medium. Therefore, the pushing forces in the recording medium widthwise direction, which are applied from the spurs to the recording medium, do not become unbalanced. Accordingly, it is possible to prevent the recording medium from moving along an incline such that the image is formed at a slant, and to prevent wrinkling of the sheet and paper jamming from occurring at the time of recording onto the recording sheet.

In a recording device of a thirty-second aspect, pushing forces, which the pushing device applies to the recording medium, are made to be symmetrical by disposing the pushing device at positions which are symmetrical with respect to the widthwise direction central line of the printing region.

In this way, even in the case in which the conveying roller is a both-end supported beam structure, in which both end portions of the conveying roller are held by bearings or the like, and a slight amount of flexure arises at the conveying roller, this flexure is symmetrical at the left and the right of the widthwise direction central line of the printing region. Therefore, it is possible to prevent the recording medium from moving along an incline such that the image is formed at a slant, and to prevent wrinkling of the sheet and paper jamming from occurring at the time of recording onto the recording sheet.

In a recording device of a thirty-third aspect, an assistant conveying device, for conveying the recording medium by applying thereto conveying force which is equivalent to conveying force which the conveying device applies to the recording medium, is provided at an upstream side of an upstream-most recording head.

In this way, at the start of recording, the majority of the recording medium is conveyed to the recording region of the recording device while being conveyed by the assistant conveying device. Therefore, the conveying speed of the recording medium at the time of the start of recording can be made to be the same speed as the speed of conveying by the conveying device. Accordingly, high image quality recording can be carried out.

Note that the structure of the assistant conveying device is not particularly limited provided that the assistant conveying device is structured so as to convey the recording medium by applying thereto a conveying force which is equivalent to the conveying force which the conveying device applies to the recording medium In a recording device of a thirty-fourth aspect, an assistant conveying device, for conveying the recording medium by applying thereto conveying force which is equivalent to conveying force which the conveying device applies to the recording medium, is provided at a downstream side of a downstream-most recording head.

In this way, in the same way as in the invention of the thirty-third aspect, at the end of recording, the majority of the recording medium is conveyed out from the recording region of the recording device while being conveyed by the assistant conveying device. Therefore, the conveying speed of the recording medium at the time of the completion of recording can be made to be the same speed as the speed of conveying by the conveying device. Accordingly, high image quality recording can be carried out.

In a recording device of a thirty-fifth aspect, the conveying device has a plurality of conveying rollers which abut the reverse surface of the recording medium which is opposite the recording surface of the recording medium and apply driving force to the recording medium, and a plurality of pushing device which push the recording medium toward the conveying rollers, the assistant conveying device has at least one of the conveying rollers and at least one of the pushing device, and distances between adjacent conveying rollers provided at the conveying device and at the assistant conveying device are all the same, and pushing forces of the pushing devices provided at the conveying device and at the assistant conveying device are all the same.

In this way, when the assistant conveying device is manufactured, conveying rollers and pushing device are provided in the same way as at the conveying device. Therefore, the effects obtained by the inventions of the thirty-third and thirty-fourth aspects can be exhibited. Thus, the structure of the assistant conveying device is simple, and the time required for manufacturing the assistant conveying device can be greatly reduced.

What is claimed is:

1. A recording device for recording an image on a recording medium, the recording device comprising:

a recording head having a liquid drop discharging surface for discharging liquid drops toward a recording medium;

a liquid receptacle disposed at a position opposing a liquid drop discharging surface of the recording head, and able to accommodate the liquid drops; and a conveying device for conveying the recording medium between the recording head and the liquid receptacle, by a non-electrostatic attraction method, the conveying device including, a conveying roller abutting a reverse surface of the recording medium, which is opposite a recording surface of the recording medium, and applying driving force to the recording medium, and a pushing device for pushing the recording medium toward the conveying roller, the pushing device includes, an urging member, which contacts the recording medium and urges the recording medium toward the conveying roller, the urging member including at least one spur, which is elastically urged, and the conveying roller has a spur breakage avoiding portion, at a region corresponding to the spur, the spur breakage avoiding portion includes an elastic body provided at least at a position of the conveying roller, which contacts the spur.

2. The recording device of claim 1, wherein the conveying device is disposed at a different position from the recording head in a conveying direction of the recording medium.

3. The recording device of claim 1, wherein the urging member includes a plurality of the spurs, which are urged toward one conveying roller are rotatably supported at a plurality of shafts which are disposed in a widthwise direction which is orthogonal to a conveying direction of the recording medium.

4. The recording device of claim 3, wherein there are two or more types of configurations of the spurs attached to at least one shaft.

5. The recording device of claim 4, wherein there are two or more types of numbers of teeth of the spurs which are non-integer multiples of one another.

6. The recording device of claim 4, wherein there are two or more types of configurations of addenda of the spurs.

7. The recording device of claim 1, wherein the spur breakage avoiding portion comprises a concave portion.

8. The recording device of claim 1, wherein the recording head has a printing region of a width which is larger than or equal to at least a maximum recording region of the recording medium which is printed at the recording head.

9. The recording device of claim 8, wherein the recording head is configured by a combination of a plurality of unit recording heads.

10. The recording device of claim 9, wherein the recording head is configured by a plurality of recording head arrays, each of which is structured by the plurality of unit recording heads being disposed in a widthwise direction that is orthogonal to the conveying direction, being disposed at different positions in the conveying direction.

11. The recording device of claim 10, wherein the conveying device is disposed between the recording head arrays.

12. The recording device of claim 10, wherein, when the plurality of recording heads or the recording head arrays are lined up along the conveying direction, the conveying device is provided at an upstream side of an upstream-most recording head or recording head array.

13. The recording device of claim 10, wherein, when the plurality of recording heads or the recording head arrays are lined up along the conveying direction, the conveying device is provided at a downstream side of a downstream-most recording head or recording head array.

14. The recording device of claim 1, wherein a plurality of the recording heads are disposed along a conveying direction of the recording medium.

15. The recording device of claim 14, wherein the plurality of recording heads discharge liquid drops of different colors.

16. The recording device of claim 1, wherein the conveying device is driven by a single drive source.

17. The recording device of claim 16, wherein the conveying device has a plurality of the conveying rollers, and the plurality of the conveying rollers are driven from a single drive source via a common driving member.

18. The recording device of claim 17, wherein the common driving member comprises a flat belt, and portions of the conveying rollers around which portions the flat belt is trained have a same diameter as portions of the conveying rollers which portions the recording medium contacts.

19. The recording device of claim 1, wherein a float-up preventing device, for preventing the recording medium from floating upward, is provided between recording medium widthwise direction end portions of unit recording heads structuring the recording head.

20. The recording device of claim 19, wherein the float-up preventing device comprises a spur provided at the unit recording head, and a guiding member provided at a position opposing the spur and guiding the recording medium from a reverse surface side.

21. The recording device of claim 1, wherein, at least a position, at which the spur is disposed as seen from the conveying direction of the recording medium, is offset from a position on a straight line along the conveying direction.

22. The recording device of claim 1, wherein central axis of rotation of at least one spur contacting widthwise direction end portion of the recording medium is inclined toward a widthwise direction central portion of the recording medium.

23. The recording device of claim 1, wherein central axis of rotation of at least one spur contacting widthwise direction end portion of the recording medium is inclined in a direction in which recording medium widthwise direction central portion sides of the central axes of rotation push out toward a conveying direction side of the recording medium.

24. The recording device of claim 1, wherein the conveying device is configured to convey the recording medium so that a widthwise direction central line of the recording medium coincide with a widthwise direction central line of a printing region.

25. The recording device of claim 24, wherein pushing forces, which the pushing device applies to the recording medium, are made to be symmetrical by disposing the pushing device at positions which are symmetrical with respect to the widthwise direction central line of the printing region.

26. The recording device of claim 1, wherein an assistant conveying device, for conveying the recording medium by applying thereto conveying force which is equivalent to conveying force which the conveying device applies to the recording medium, is provided at an upstream side of an upstream-most recording head.

27. The recording device of claim 1, wherein an assistant conveying device, for conveying the recording medium by applying thereto conveying force which is equivalent to conveying force which the conveying device applies to the recording medium, is provided at a downstream side of a downstream-most recording head.

28. The recording device of claim 27, wherein the conveying device has a plurality of conveying rollers which abut the reverse surface of the recording medium which is opposite the recording surface of the recording medium and apply driving force to the recording medium, and a plurality of pushing devices, which push the recording medium toward the conveying rollers, the assistant conveying device has at least one of the conveying rollers and at least one of the pushing device, and distances between adjacent conveying rollers provided at the conveying device and at the assistant conveying device are all the same, and pushing forces of the pushing devices provided at the conveying device and at the assistant conveying device are all the same.

* * * * *